US007708865B2

(12) United States Patent
Holtzapple et al.

(10) Patent No.: US 7,708,865 B2
(45) Date of Patent: May 4, 2010

(54) VAPOR-COMPRESSION EVAPORATION SYSTEM AND METHOD

(75) Inventors: Mark T. Holtzapple, College Station, TX (US); Gary P. Noyes, Houston, TX (US); George A. Rabroker, College Station, TX (US)

(73) Assignees: Texas A&M University System, College Station, TX (US); StarRotor Corporation, College Station, TX (US)

( * ) Notice: Subject to any disclaimer, the term of this patent is extended or adjusted under 35 U.S.C. 154(b) by 1413 days.

(21) Appl. No.: 10/944,317

(22) Filed: Sep. 17, 2004

(65) Prior Publication Data

US 2005/0072662 A1 Apr. 7, 2005

Related U.S. Application Data

(60) Provisional application No. 60/504,138, filed on Sep. 19, 2003.

(51) Int. Cl.
*B01D 1/26* (2006.01)
*B01D 1/28* (2006.01)
*B01D 3/00* (2006.01)

(52) U.S. Cl. ..... 203/25; 159/2.3; 159/17.1; 159/24.1; 159/47.1; 159/DIG. 8; 202/155; 202/174; 202/182; 203/26; 203/27; 203/71; 203/88; 203/DIG. 8

(58) Field of Classification Search ..... 159/2.1, 159/2.3, 17.1, 24.1–24.3, 47.1, DIG. 8; 202/155, 202/174, 182, 185.1; 203/25–27, 71, 88, 203/DIG. 8; 127/53
See application file for complete search history.

(56) References Cited

U.S. PATENT DOCUMENTS 1,415,406 A 5/1922 Scanes (Continued)

FOREIGN PATENT DOCUMENTS

DE 1111 221 1/1955

(Continued)

OTHER PUBLICATIONS

Notification of Transmittal of the International Search Report and Written Opinion of the International Searching Authority for International Application No. PCT/US2004/030660 filed Sep. 20, 2004. (15 pages) Jan. 14, 2005.

(Continued)

*Primary Examiner*—Virginia Manoharan
(74) *Attorney, Agent, or Firm*—Conley Rose, P.C.

(57) ABSTRACT

According to one embodiment of the invention, a vapor-compression evaporation system includes a plurality of vessels in series each containing a feed having a nonvolatile component, a mechanical compressor coupled to the last vessel in the series and operable to receive a vapor from the last vessel in the series, a pump operable to deliver a cooling liquid to the mechanical compressor, a tank coupled to the mechanical compressor and operable to separate liquid and vapor received from the mechanical compressor, a plurality of heat exchangers coupled inside respective ones of the vessels, the heat exchanger in the first vessel in the series operable to receive the vapor from the tank, at least some of the vapor condensing therein, whereby the heat of condensation provides the heat of evaporation to the first vessel in the series, and wherein at least some of the vapor inside the first vessel in the series is delivered to the heat exchanger in the next vessel in the series, whereby the condensing, evaporating, and delivering steps continue until the last vessel in the series is reached.

18 Claims, 39 Drawing Sheets

U.S. PATENT DOCUMENTS

| | | | | | |
|---|---|---|---|---|---|
| 1,421,844 | A | | 7/1922 | Schmidt | |
| 2,941,787 | A | | 6/1960 | Ramén et al. | |
| 3,607,668 | A | * | 9/1971 | Williamson | 203/11 |
| 3,763,020 | A | * | 10/1973 | Drew et al. | 203/14 |
| 3,875,017 | A | * | 4/1975 | Saari et al. | 202/174 |
| 3,892,361 | A | | 7/1975 | Mocarski | |
| 3,926,739 | A | * | 12/1975 | Izumi | 202/173 |
| 3,951,753 | A | * | 4/1976 | Roller | 203/7 |
| 4,035,243 | A | * | 7/1977 | Katz et al. | 203/24 |
| 4,054,493 | A | * | 10/1977 | Roller | 203/7 |
| 4,238,296 | A | * | 12/1980 | Sadhukhan | 203/23 |
| 4,379,734 | A | * | 4/1983 | Franzen | 159/17.1 |
| 4,696,625 | A | | 9/1987 | Greenberg | |
| 4,756,797 | A | * | 7/1988 | Elmore et al. | 159/13.1 |
| 5,076,895 | A | * | 12/1991 | Greenfield | 203/10 |
| 5,837,096 | A | | 11/1998 | Fagerlind et al. | |
| 6,484,501 | B1 | * | 11/2002 | Mieth et al. | 60/618 |
| 7,251,944 | B2 | * | 8/2007 | Holtzapple et al. | 62/93 |
| 2007/0240446 | A1 | * | 10/2007 | Holtzapple et al. | 62/333 |

FOREIGN PATENT DOCUMENTS

| | | | |
|---|---|---|---|
| DE | 3244761 | A1 | 6/1983 |
| DE | 39 18 189 | | 6/1989 |
| DE | 3924581 | | 1/1991 |
| DE | 4019991 | | 1/1992 |
| EP | 0 193 206 | A1 | 2/1986 |
| EP | 0 280 676 | A2 | 2/1988 |
| EP | 0 411 123 | A1 | 2/1991 |
| EP | 0741241 | A1 | 11/1996 |
| FR | 1050094 | | 1/1954 |
| FR | 2230403 | | 12/1974 |
| FR | 2 505 667 | | 5/1981 |
| FR | 2 545 372 | A1 | 11/1984 |
| GB | 2054819 | | 2/1981 |

OTHER PUBLICATIONS

PCt Invitation to Pay Additional Fees for International Application No. PCt/US2004/030615, filed Sep. 20, 2004. (6 pages) Jan. 28, 2005.

Notification of Transmittal of the International Search Report and the Written Opinion of the International Searching Authority for International Application No. PCTUS2004/030619 filed Sep. 20, 2004 (16 pages) Feb. 10, 2005.

Communication Pursuant to Article 94(3) EPC, Application No. 04 784 508.6 - 1266; Ref JL31713P.EPP, 3 pages, Aug. 24, 2009.

* cited by examiner

*(AR=5)*

*(AR=4)*

*(AR=3)*

*(AR=4)*

*(AR=5)*

*(AR=3)*

*(AR=5)*

*(AR=4)*

*(AR=3)*

*(AR=5)*

*(AR=4)*

(AR=3)

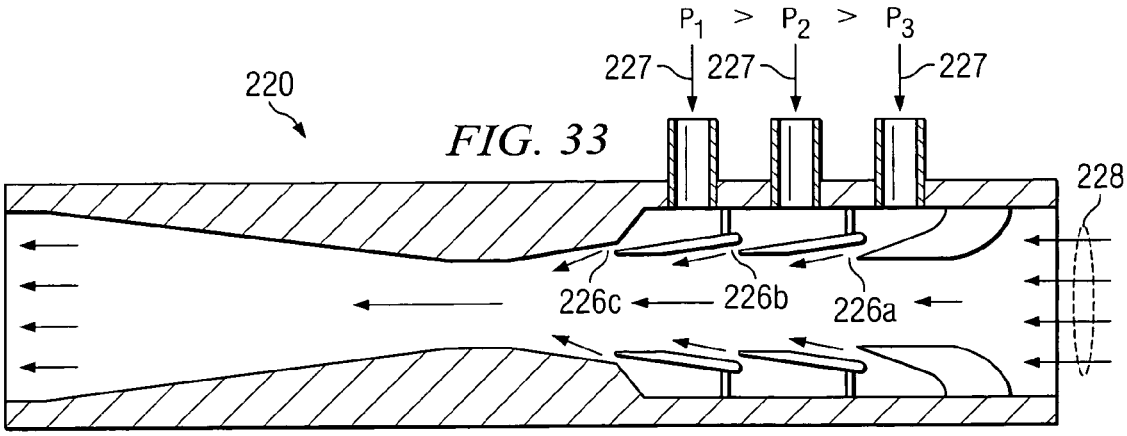
FIG. 33
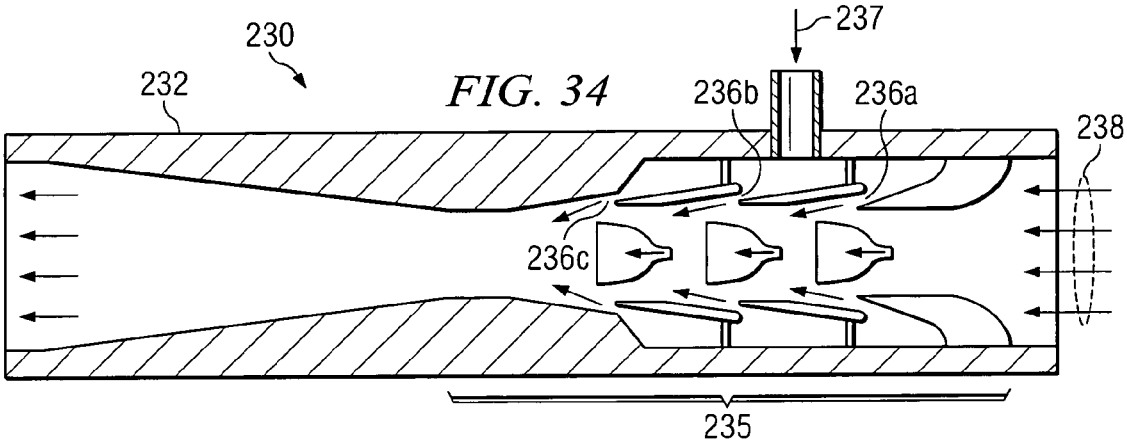
FIG. 34
FIG. 35A
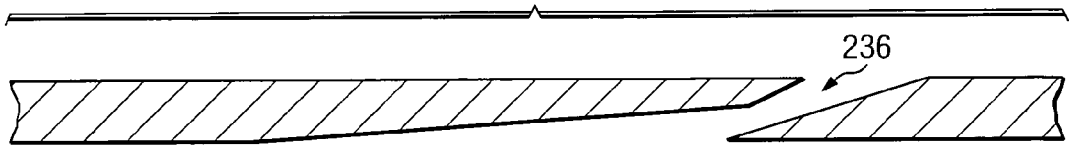
FIG. 35B
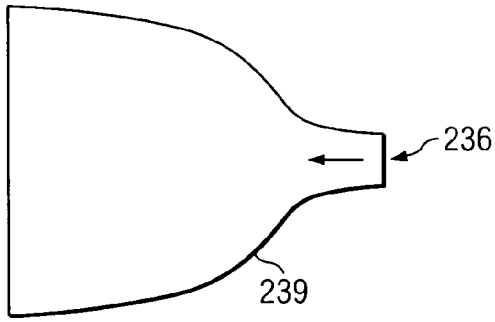

VAPOR-COMPRESSION EVAPORATION SYSTEM AND METHOD

RELATED APPLICATIONS

This application claims the benefit of Ser. No. 60/504,138 titled "Jet Ejector System and Method," filed provisionally on Sep. 19, 2003.

TECHNICAL FIELD OF THE INVENTION

The present invention relates generally to the field of jet ejectors and, more particularly, to an improved, ultra-high efficiency jet ejector system and method.

BACKGROUND OF THE INVENTION

Typical steam jet ejectors feed high-pressure steam, at relatively high velocity, into the jet ejector. Steam is usually used as the motive fluid because it is readily available; however, an ejector may be designed to work with other gases or vapors as well. For some applications, water and other liquids are sometimes good motive fluids as they condense large quantities of vapor instead of having to compress them. Liquid motive fluids may also compress gases or vapors.

The motive high-pressure steam enters a nozzle and issues into the suction head as a high-velocity, low-pressure jet. The nozzle is an efficient device for converting the enthalpy of high-pressure steam or other fluid into kinetic energy. A suction head connects to the system being evacuated. The high-velocity jet issues from the nozzle and rushes through the suction head.

Gases or vapors from the system being evacuated enter the suction head where they are entrained by the high-velocity motive fluid, which accelerates them to a high velocity and sweeps them into the diffuser. The process in the diffuser is the reverse of that in the nozzle. It transforms a high-velocity, low-pressure jet stream into a high-pressure, low-velocity stream. Thus, in the final stage, the high-velocity stream passes through the diffuser and is exhausted at the pressure of the discharge line.

SUMMARY OF THE INVENTION

According to one embodiment of the invention, a vapor-compression evaporation system includes a plurality of vessels in series each containing a feed having a nonvolatile component, a mechanical compressor coupled to the last vessel in the series and operable to receive a vapor from the last vessel in the series, a pump operable to deliver a cooling liquid to the mechanical compressor, a tank coupled to the mechanical compressor and operable to separate liquid and vapor received from the mechanical compressor, a plurality of heat exchangers coupled inside respective ones of the vessels, the heat exchanger in the first vessel in the series operable to receive the vapor from the tank, at least some of the vapor condensing therein, whereby the heat of condensation provides the heat of evaporation to the first vessel in the series, and wherein at least some of the vapor inside the first vessel in the series is delivered to the heat exchanger in the next vessel in the series, whereby the condensing, evaporating, and delivering steps continue until the last vessel in the series is reached.

Embodiments of the invention provide a number of technical advantages. Embodiments of the invention may include all, some, or none of these advantages. An advantage of a jet ejector system according to one embodiment of the invention is that it blends gas streams of similar pressures; therefore, the velocity of each gas stream is similar. This leads to high efficiencies, even using traditional jet ejectors. The efficiency may be improved further by improving the design of the jet ejector.

A jet ejector according to one embodiment of the invention blends gas streams of similar velocities, but does not obstruct the flow of the propelled gas. This jet ejector may be used in many applications, such as compressors, heat pumps, water-based air conditioning, vacuum pumps, and propulsive jets (both for watercraft and aircraft).

An advantage of another jet ejector system according to one embodiment of the invention is it uses a high-efficiency liquid jet ejector in a cost-effective dewatering system. When combined with steam jet ejectors and multi-effect evaporators, any energy inefficiencies of the liquid jet system (liquid jet itself, pump, turbine) produce heat that usefully distills liquid. This liquid jet ejector may be used in water-based air conditioning.

In other embodiments, a heat exchanger is designed to facilitate a lower pressure drop than existing heat exchangers at low cost. Such a heat exchanger may include a plurality of plates (or sheets) inside a tube. The plates may be made of any suitable material; however, for some embodiments in which corrosion is a concern, the plates may be made of a suitable polymer.

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which:

FIG. 33 illustrates a jet ejector according to another embodiment of the invention;

FIGS. 34 and 35 illustrate a jet ejector according to another embodiment of the invention;

DETAILED DESCRIPTION OF THE INVENTION

Figure 1:
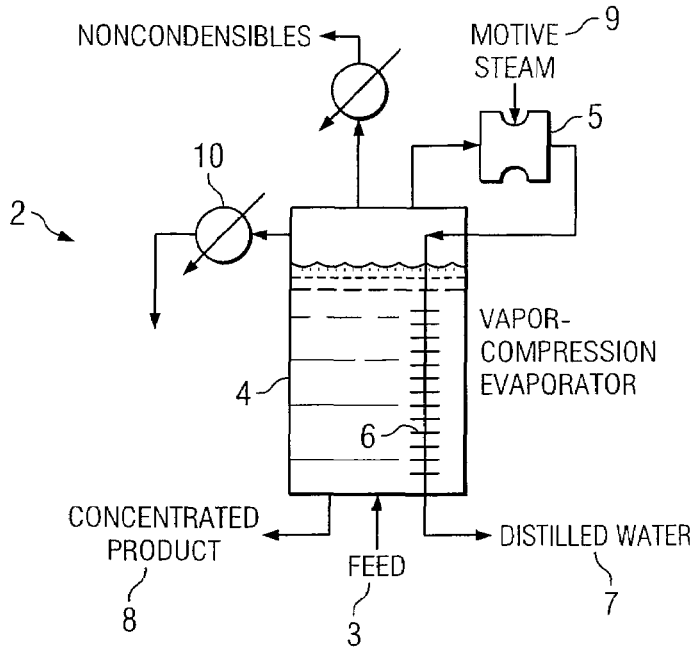
FIG. 1 illustrates a low-pressure vapor-compression evaporator system.

FIG. 1 illustrates a low-pressure vapor-compression evaporator system 2 performing desalination of salt water. A salt-containing feed 3 flows into an evaporator tank 4, which in this embodiment is operated under vacuum. Although, in the illustrated embodiment, feed 3 is a salt-containing feed, a sugar-containing feed or suitable feed is also contemplated by the present invention. The salt-containing feed 3 boils, producing low-pressure vapors. These vapors are removed from evaporator tank 4 using a jet ejector 5. The pressurized vapors exiting jet ejector 5 flow into a heat exchanger 6, where they condense. Because of the interaction of heat exchanger 6 and evaporator tank 4, the heat of condensation provides the heat of evaporation needed by the salt-containing feed 3. Distilled liquid water 7 is recovered from heat exchanger 6 in any suitable manner, and concentrated salt solution 8 is removed from evaporator tank 4 using any suitable devices. The motive steam 9 added to jet ejector 5 may be condensed against cooling water; however, this condensation step may be eliminated if the product water is removed at a higher temperature than the feed water. A small vapor stream may be removed from evaporator tank 4 and sent to a condenser 10 to remove water vapor. The remaining gas is primarily noncondensibles, which may be removed using a vacuum pump (not explicitly illustrated).

Figure 2:
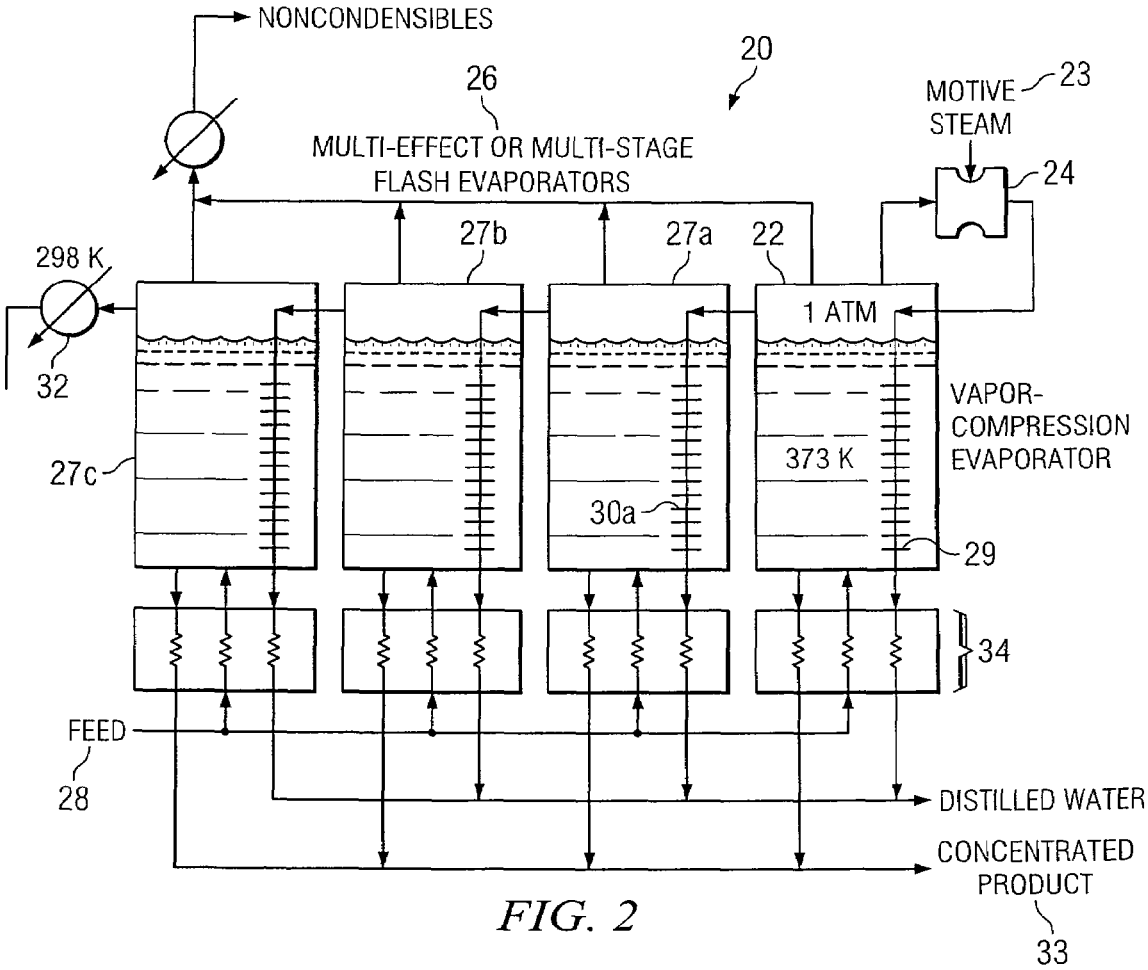
FIG. 2 illustrates a medium-pressure vapor-compression evaporator system.

FIG. 2 illustrates a medium-pressure vapor-compression evaporator system 20 according to an embodiment of the invention. System 20 operates similarly to system 2 in FIG. 1, except that an evaporator tank 22 operates at a moderate pressure, for example one atm. A motive steam 23 is added to a jet ejector 24 and exits evaporator tank 22 at moderate pressure and is useful for evaporating water. In the embodiment illustrated in FIG. 2, this medium-pressure steam may be used in a multi-effect evaporator 26, although a multi-stage flash evaporator may be used as well.

In the illustrated embodiment, multi-effect evaporator 26 includes any suitable number of tanks 27*a*, 27*b*, 27*c* in series each containing a feed 28 having a nonvolatile component, such as salt or sugar. Jet ejector 24 coupled to evaporator tank 22 and receives a vapor from evaporator tank 22. A heat exchanger 29 in evaporator tank 22 receives the vapor from jet ejector 24 where at least some of the vapor condenses therein. The heat of condensation provides the heat of evaporation to evaporator tank 22. At least some of the vapor inside evaporator tank 22 is delivered to a heat exchanger 30*a* in tank 27*a*, whereby the condensing, evaporating, and delivering steps continue through each tank until the last tank in the series (in this embodiment, tank 27*c*) is reached.

System 20 may also include a condenser 32 coupled to tank 27*c* for removing energy from system 20, and a vacuum pump (not illustrated) for removing noncondensibles from system 20. Any suitable devices may be utilized for removing concentrated feed 33 from tanks 22 and 27*a*-27*c*, and a plurality of sensible heat exchangers 34 may be coupled to tanks 22 and 27*a*-27*c* for heating the feed 28 before entering the tanks 22, 27*a*-27*c*. Sensible heat exchangers 34 may also be utilized for other suitable functions.

The pressure difference between the condensing steam and the boiling feed 28 depends upon the temperature difference between heat exchanger 29 and evaporator tank 22. In addition, salts (or other soluble materials) depress the vapor pressure, which increases the pressure difference even further. Table 1 illustrates the required compression ratio for pure water (i.e., no salt) as a function of the temperature difference.

TABLE 1

Required compression ratio for water as a function of temperature difference across the heat exchanger

| Temperature Difference (° C.) | Compression Ratio $T_{evaporator}$ = 100° C. | Compression Ratio $T_{evaporator}$ = 25° C. |
|---|---|---|
| 1 | 1.0362 | 1.0612 |
| 2 | 1.0735 | 1.1256 |
| 3 | 1.1119 | 1.1934 |
| 4 | 1.1514 | 1.2647 |
| 5 | 1.1921 | 1.3397 |
| 6 | 1.2340 | 1.4185 |
| 7 | 1.2770 | 1.5013 |
| 8 | 1.3210 | 1.5883 |

The required temperature difference depends upon the cost of heat exchangers and the cost of capital. In one embodiment, a temperature difference of 5° C. is considered economical. For a medium-pressure vapor-compression evaporator, such as system 20, the required compression ratio is approximately 1.2.

Figure 3:
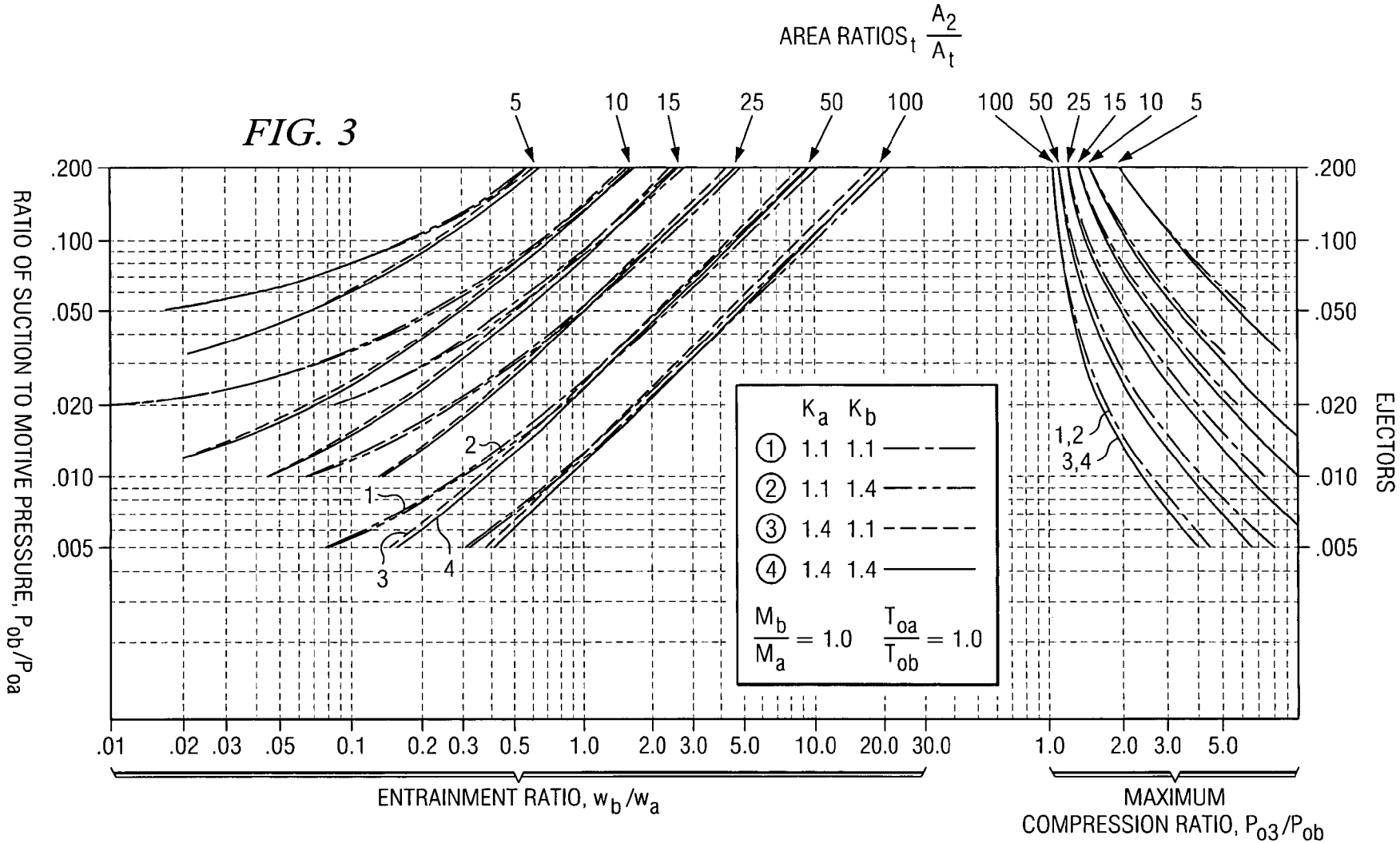
FIG. 3 is a graphical correlation for standard jet ejectors.

FIG. 3 illustrates a correlation for conventional jet ejectors. Table 2 illustrates the properties of a conventional jet ejector, based upon FIG. 3. Table 2 illustrates that using an area ratio of 100, 15.38-atm (226-psi) steam is able to evaporate 6.3 kg of water per kg of steam. Using system 20 (FIG. 2) as an example, the steam exits the evaporator tank 22 at 1 atm and can evaporate more water in multi-effect evaporators 26 or a multi-stage flash evaporator. In industry, multi-stage flash evaporators typically evaporate 8 kg of water per kg of steam, so the entire medium-pressure vapor-compression system 20 can evaporate about 14 kg of distilled water per kg of steam. If the efficiency of jet ejector 24 can be improved, then the yield of distilled water may improve further.

TABLE 2

Required pressure and motive steam consumption for $\Delta T = 5°$ C. and $T_{evaporator} = 100°$ C.

| Compression Ratio | Area Ratio | $\frac{P_{inlet}}{P_{motive}}$ | $P_{motive}$(atm) | $\frac{m_{inlet}}{m_{motive}}$ |
|---|---|---|---|---|
| 1.2 | 100 | 0.065 | 15.38 | 6.3 |
| 1.2 | 50 | 0.115 | 8.70 | 5.7 |
| 1.2 | 25 | 0.200 | 5.00 | 4.5 |

Figure 4:
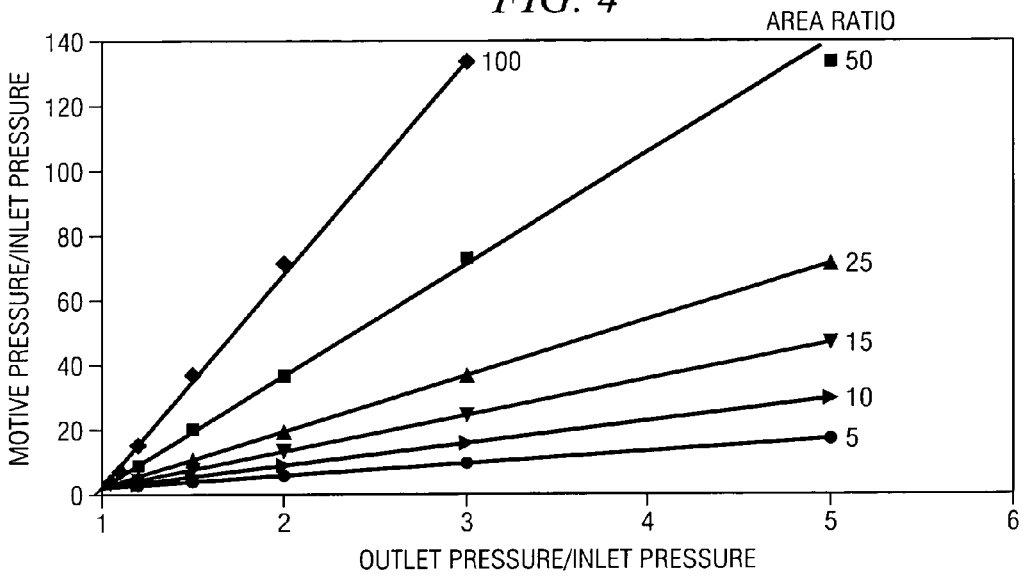
FIG. 4 illustrates $P_{motive}/P_{inlet}$ (the inverse of the y-axis in FIG. 3) as a function of compression ratio ($P_{outlet}/P_{inlet}$) for each area ratio, AR.
Figure 5:
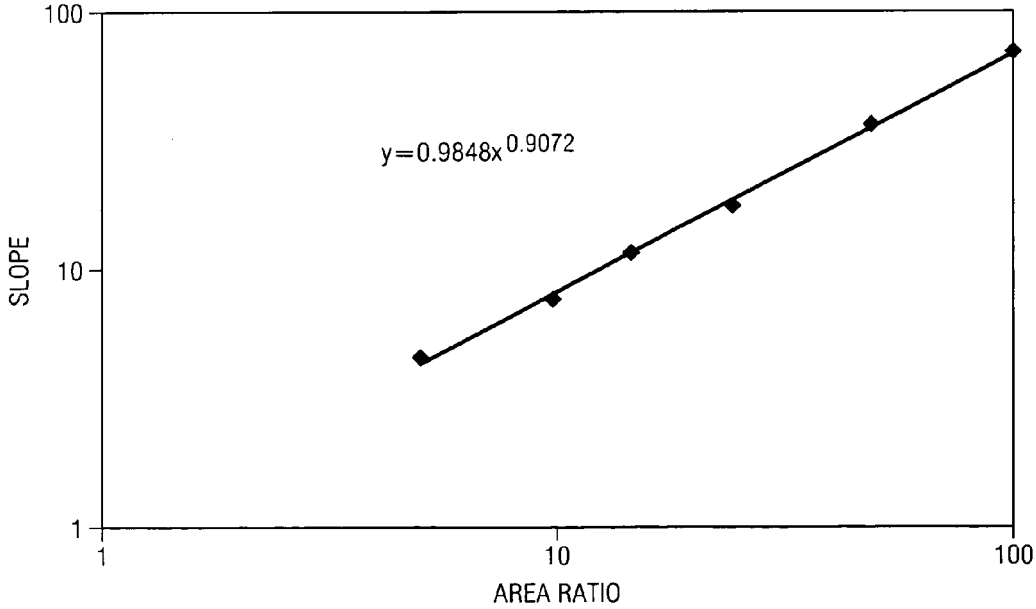
FIG. 5 illustrates the slopes of FIG. 4 on a log-log graph.

For optimization purposes, it is desirable to find equations that present the same information. FIG. 4 illustrates $P_{motive}/P_{inlet}$ (the inverse of the y-axis in FIG. 3) as a function of compression ratio ($P_{outlet}/P_{inlet}$) for each area ratio, AR. As illustrated, each line is straight in FIG. 4. FIG. 5 illustrates the slopes versus area ratio on a log-log graph. From FIGS. 4 and 5, the following equation relates the parameters:

$$\frac{P_{motive}}{P_{inlet}} = 1 + 0.9848(AR)^{0.9072}\left(\frac{P_{outlet}}{P_{inlet}} - 1\right) \quad (1)$$

Figure 6:
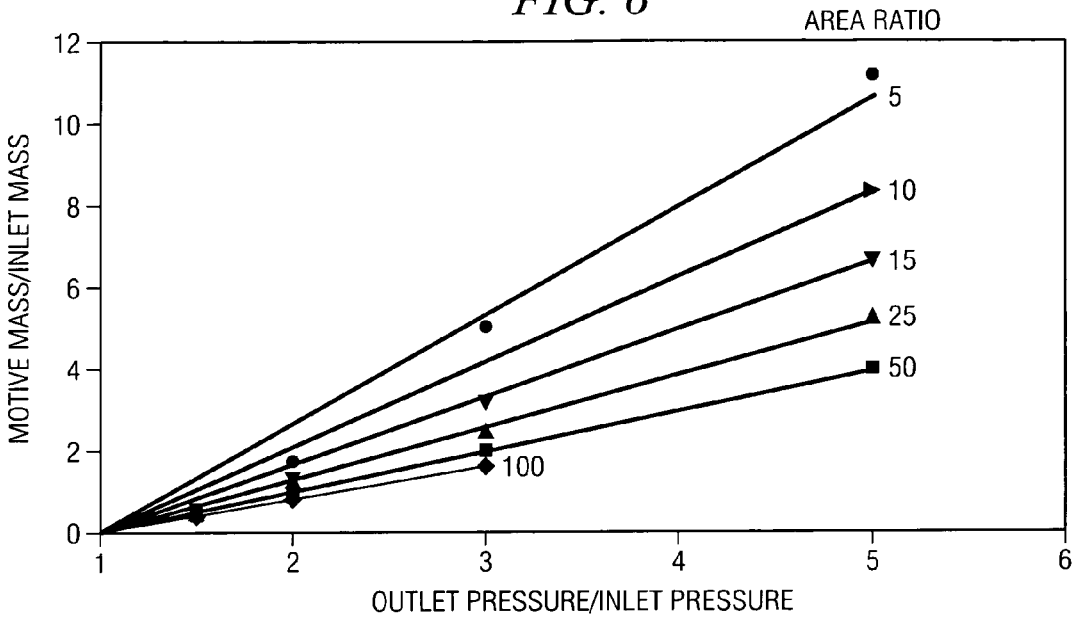
FIG. 6 illustrates $m_{motive}/m_{inlet}$ (the inverse of the x-axis in FIG. 3) as a function of compression ratio ($P_{outlet}/P_{inlet}$ for each area ratio, AR.
Figure 7:
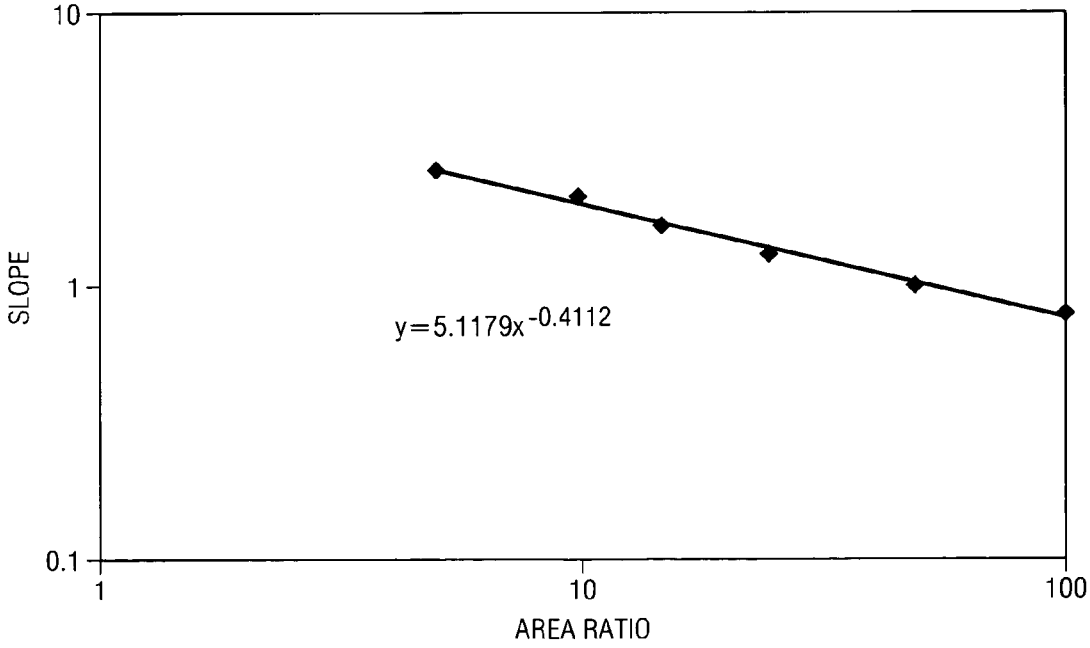
FIG. 7 illustrates the slopes of FIG. 6 on a log-log graph.

FIG. 6 illustrates $m_{motive}/m_{inlet}$ (the inverse of the x-axis in FIG. 3) as a function of compression ratio ($P_{outlet}/P_{inlet}$ for each area ratio, AR. Again, the lines are straight. FIG. 7 illustrates the slopes versus area ratio on a log-log graph. From FIGS. 6 and 7, the following equation relates the parameters:

$$\frac{m_{motive}}{m_{inlet}} = 5.1179(AR)^{-0.4112}\left(\frac{P_{outlet}}{P_{inlet}} - 1\right) \quad (2)$$

One reason jet ejectors may be inefficient is because they blend two gas streams with widely different velocities, which may occur when the motive pressure is significantly different from the inlet pressure. Thus, according to the teachings of one embodiment of the invention, the efficiency of jet ejectors may be improved substantially by developing jet ejectors and/or jet ejector systems that accomplish the required compression task by minimizing $P_{motive}/P_{inlet}$.

FIGS. 8 through 31 illustrate various embodiments of an improved design of a ultrahigh-efficiency jet ejector system that allows motive gas and propelled gas to be blended in a manner that minimizes the velocity differences between the two streams, thus optimizing efficiency. Some embodiments may also allow for the energy to be added in the form of work, rather than heat, which increases efficiency even further.

Figure 8:
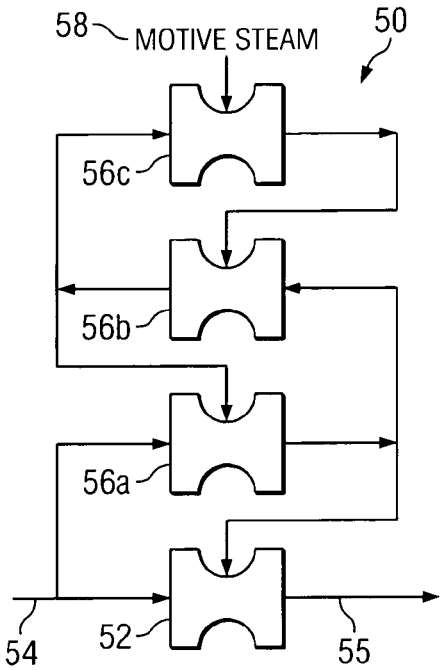
FIG. 8 illustrates a jet ejector system according to one embodiment of the invention.
Figure 9:
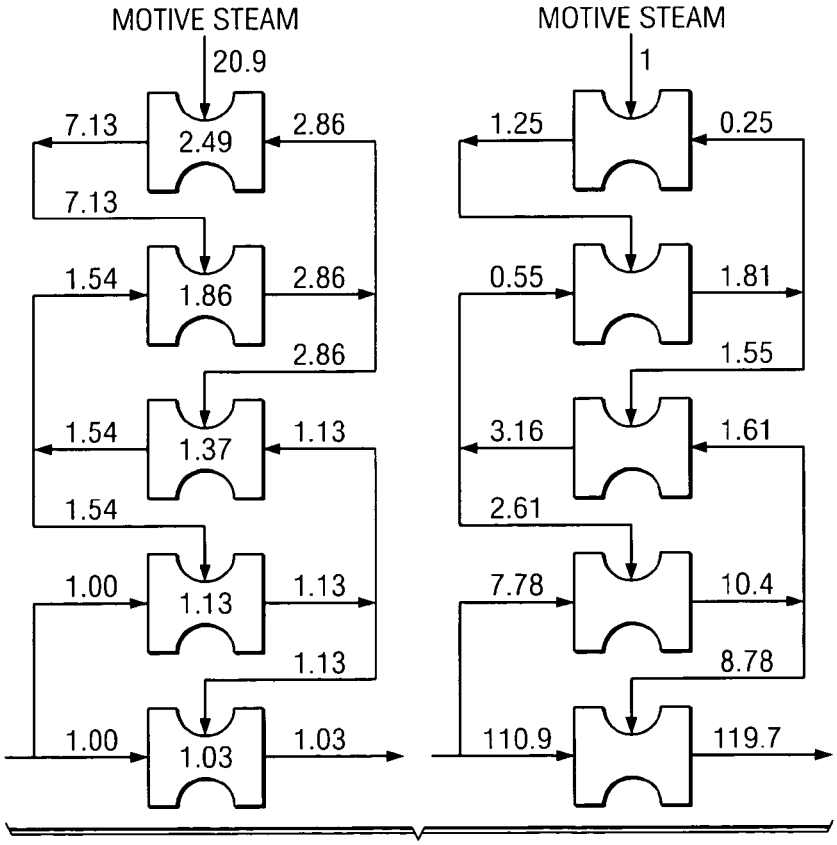
FIGS. 9 through 20 illustrate the pressures and mass flows (using arbitrary units) according to various embodiments of the invention.
Figure 10:
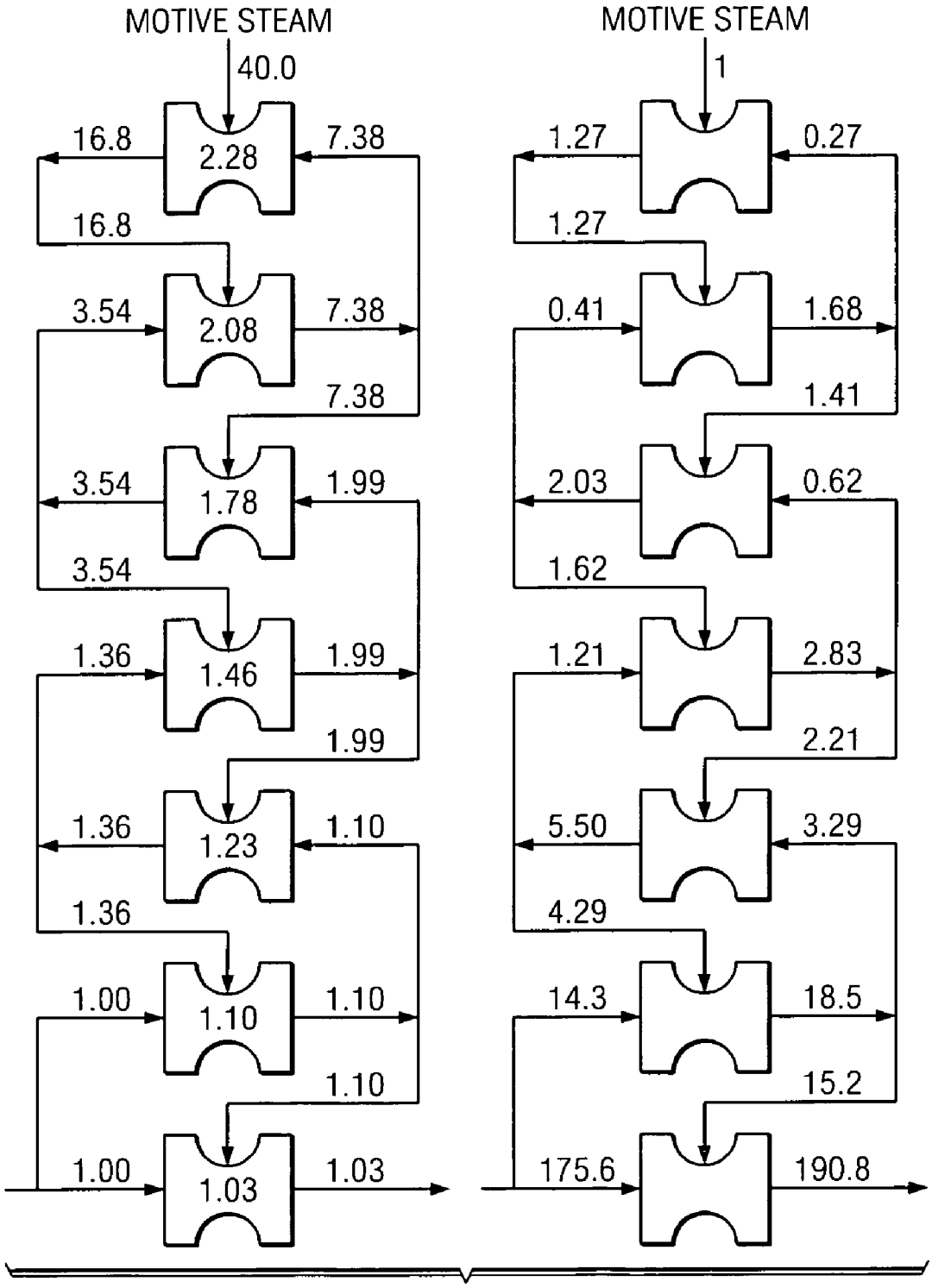
Figure 11:
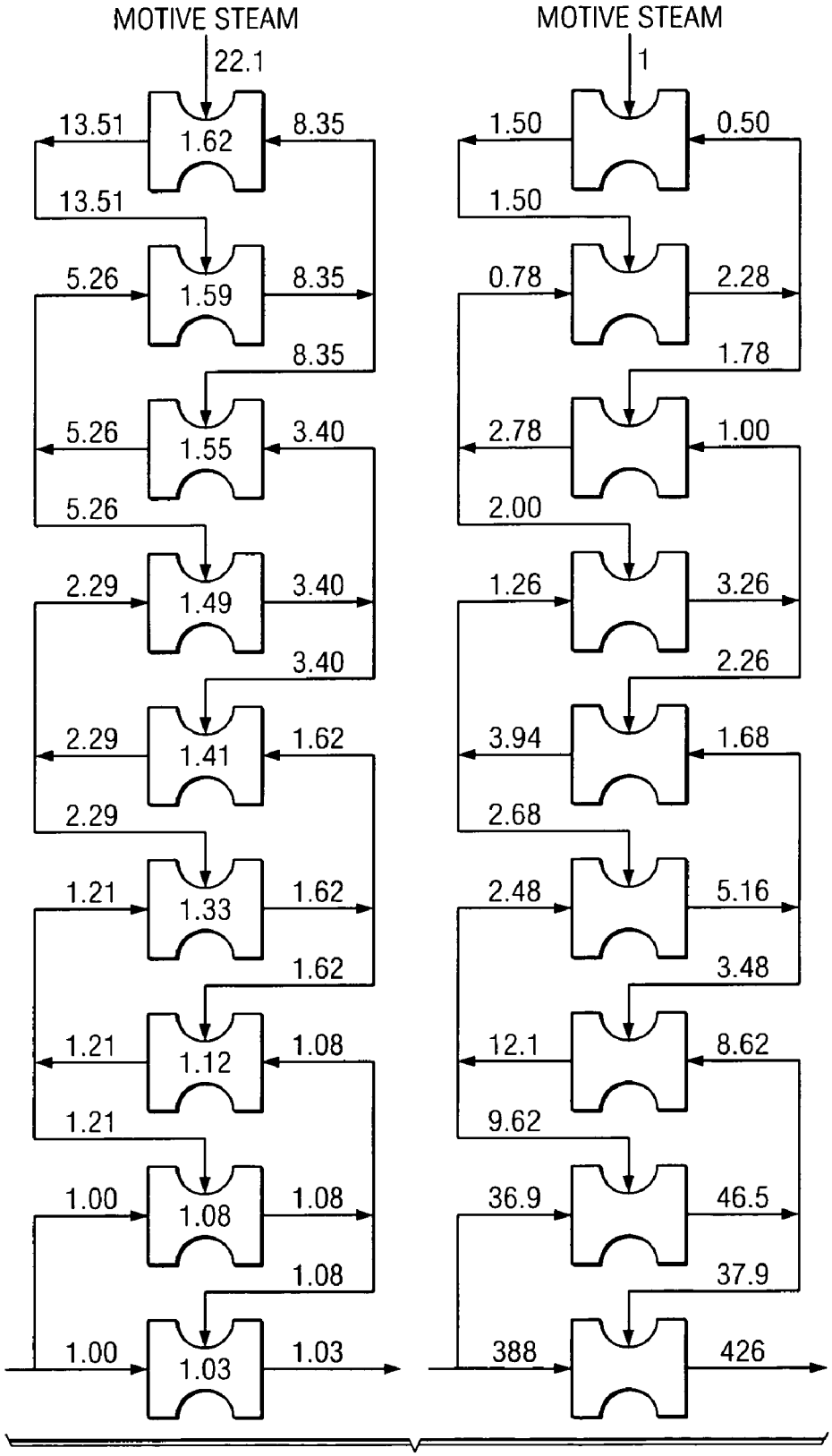
Figure 13:
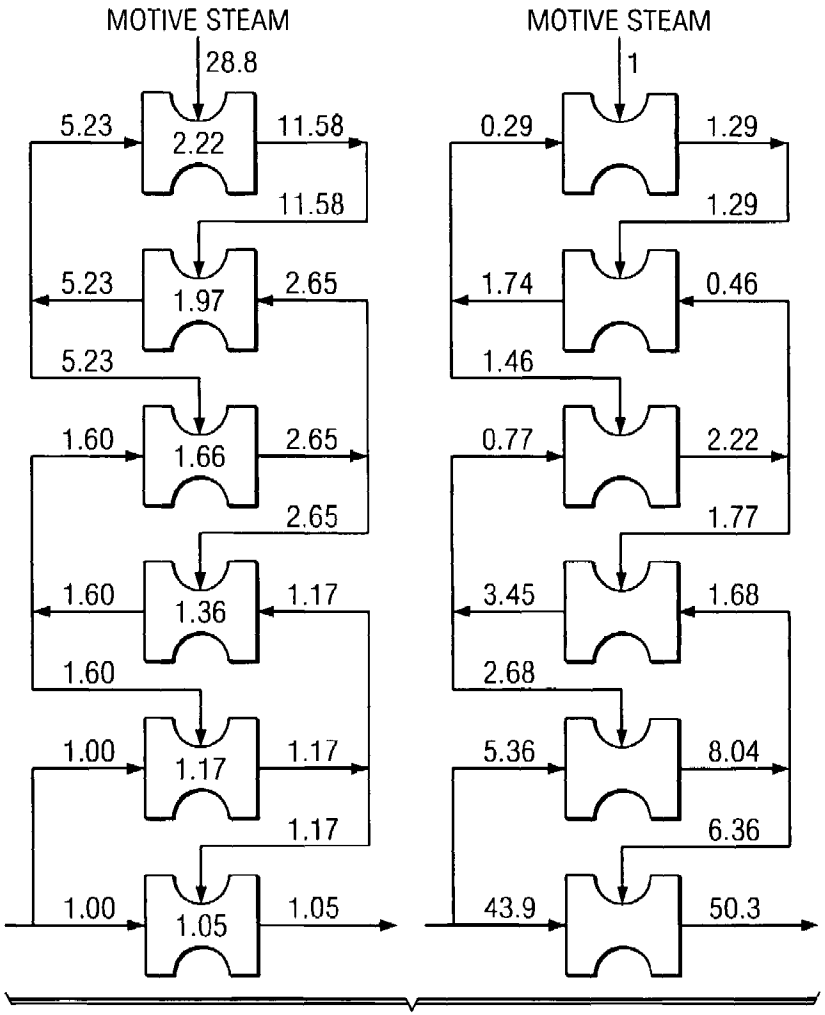
Figure 12:
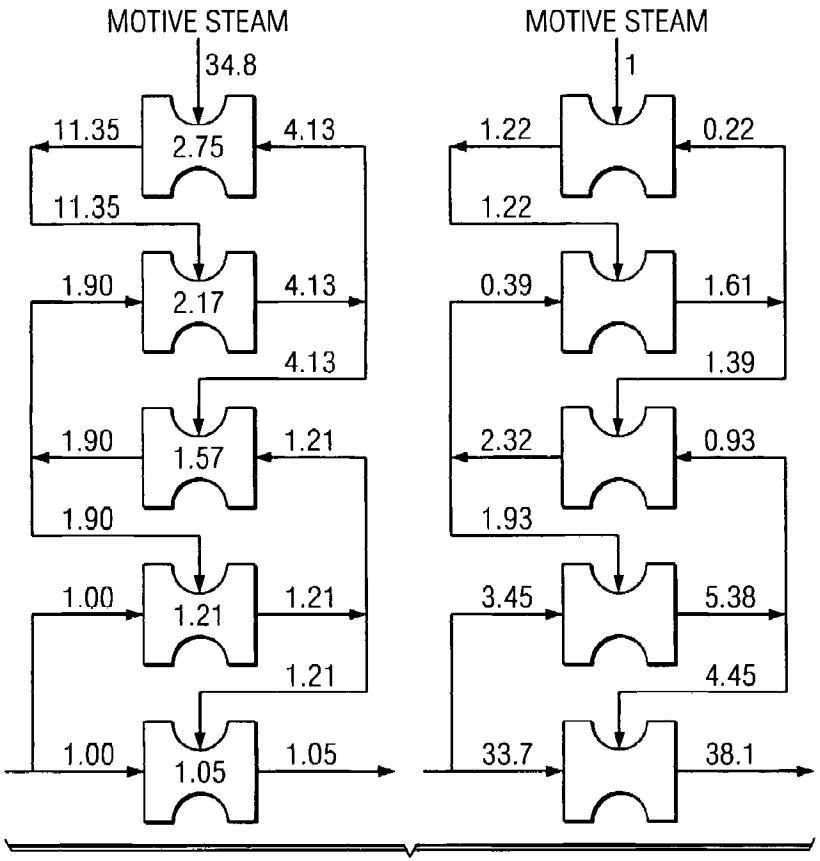
Figure 14:
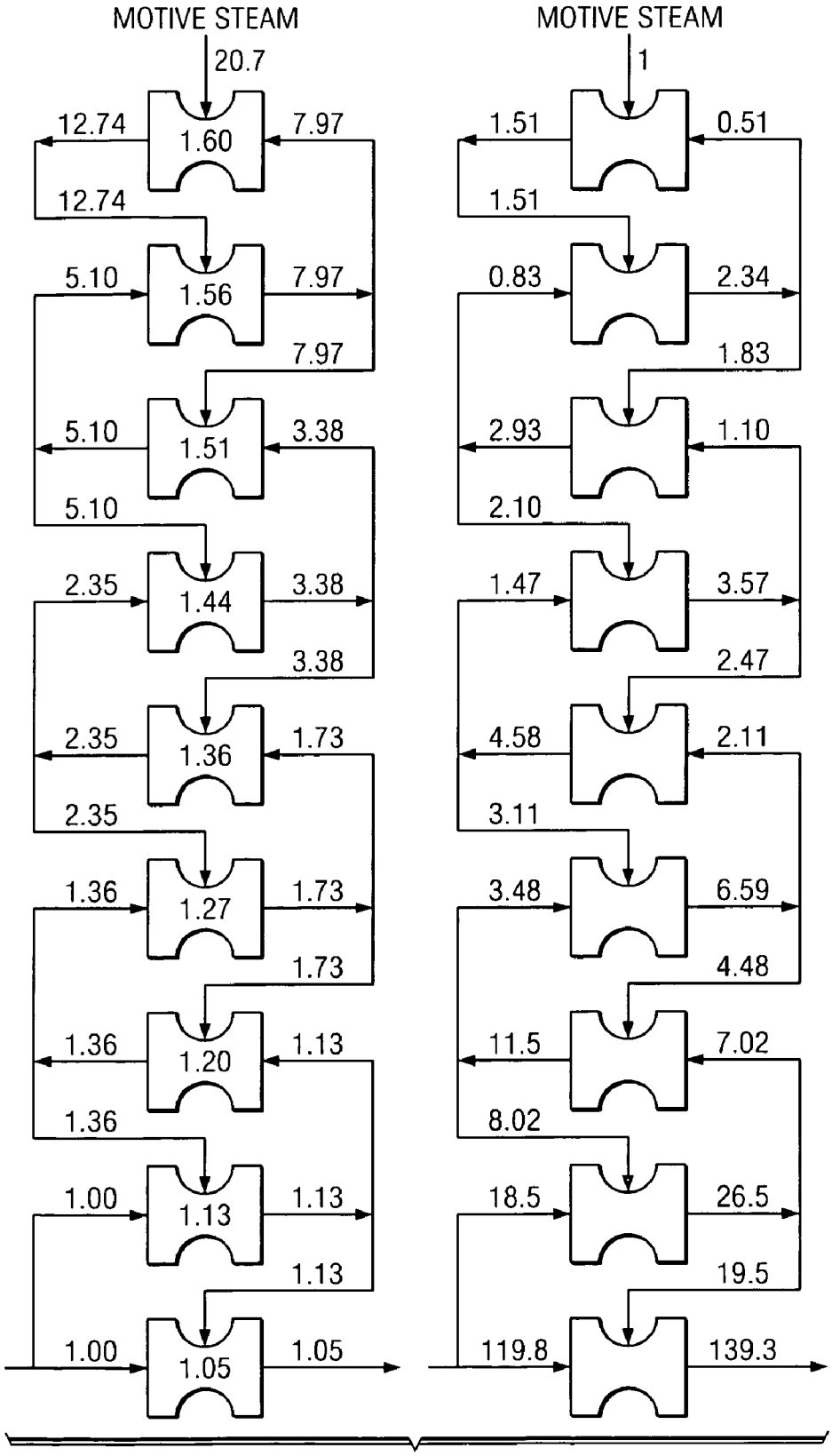
Figure 15:
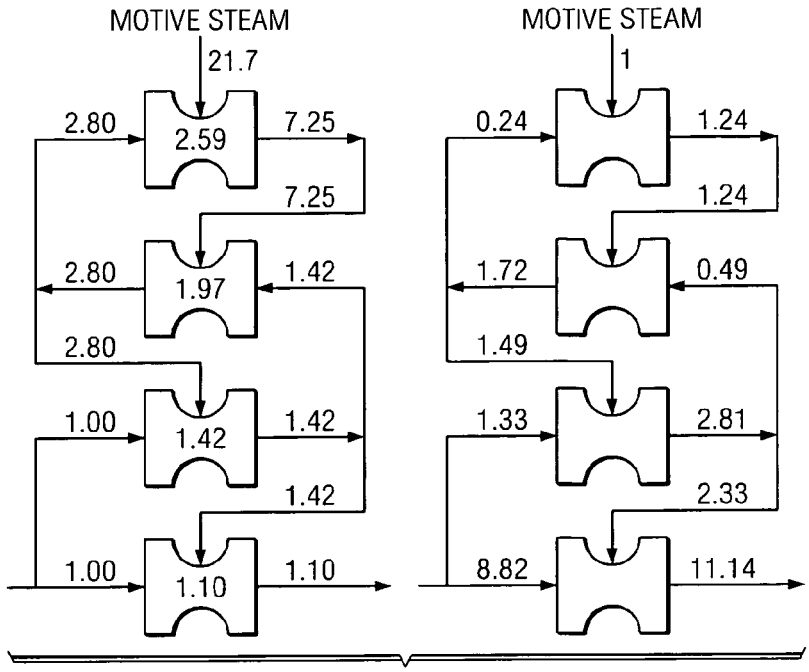
Figure 16:
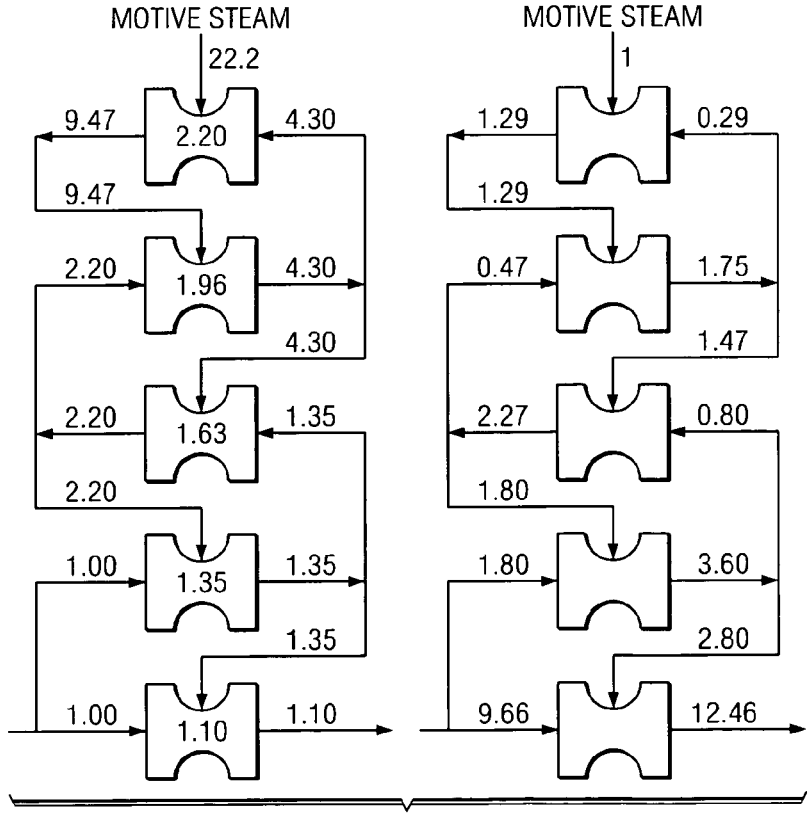
Figure 17:
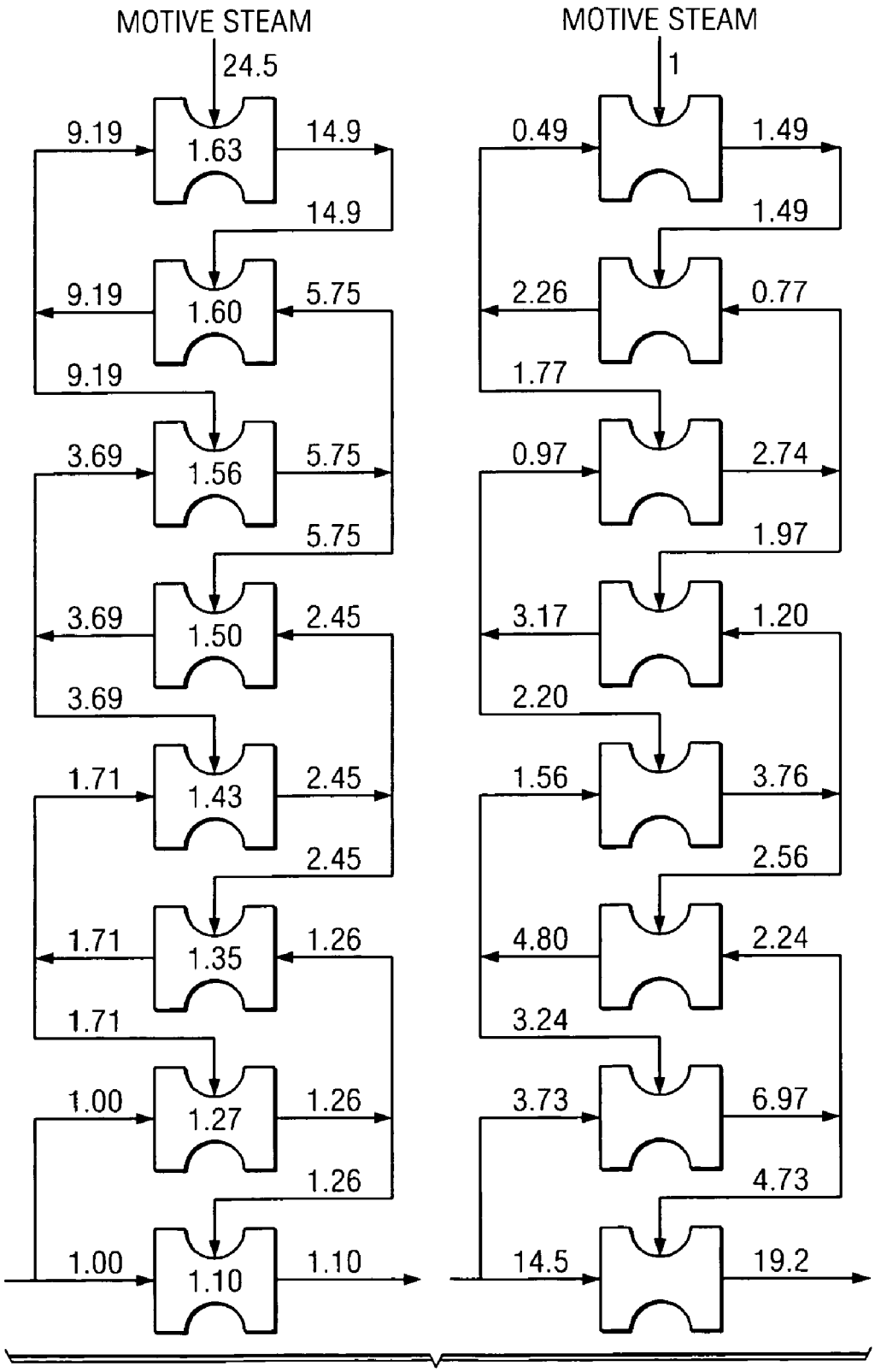
Figure 18:
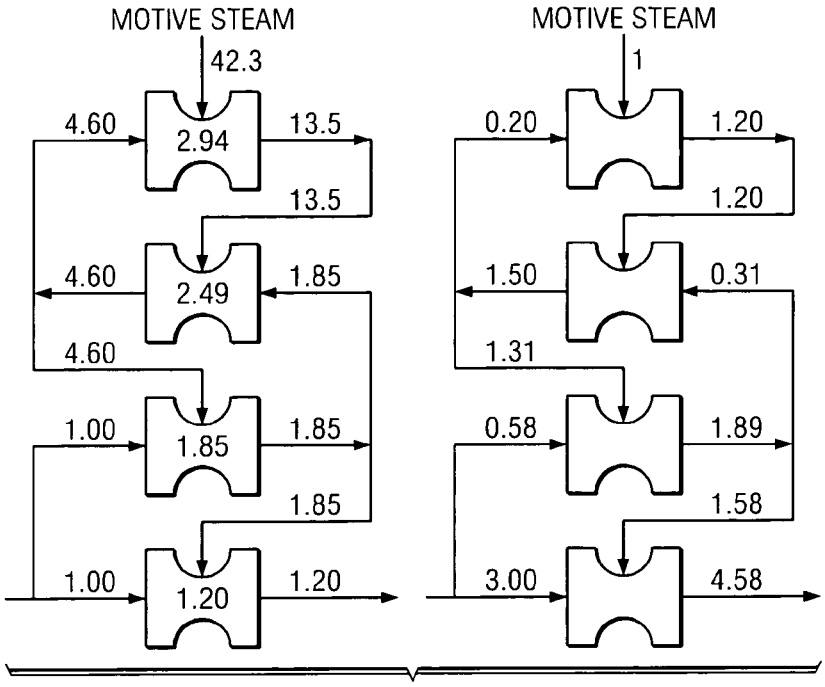
Figure 19:
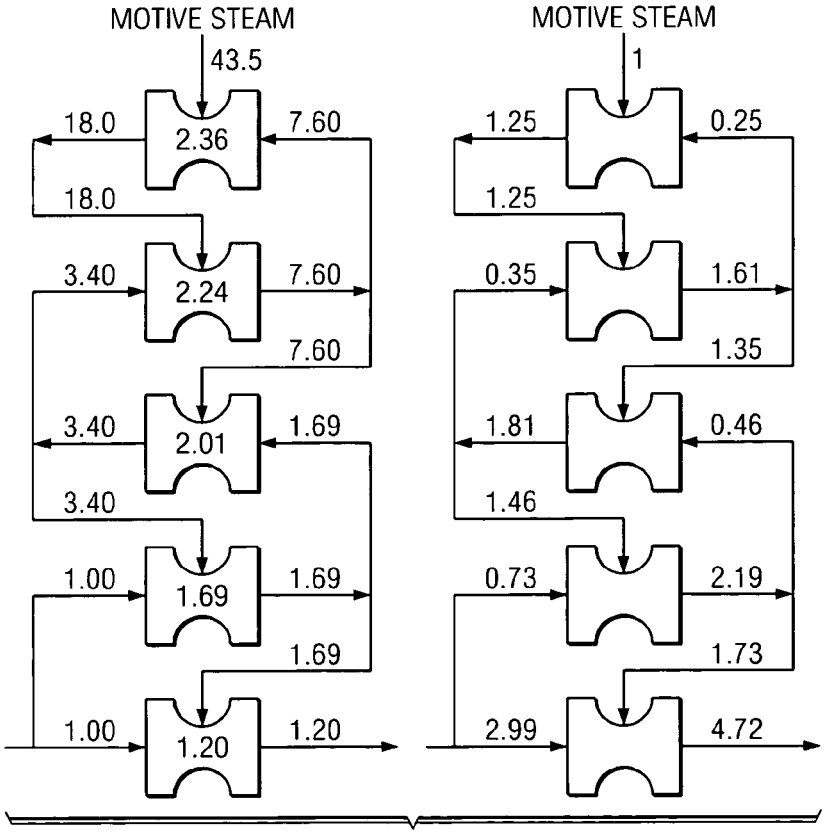

FIG. 8 illustrates a jet ejector system 50, according to one embodiment of the invention, that minimizes $P_{motive}/P_{inlet}$. In the illustrated embodiment, system 50 includes a primary jet ejector 52 and one or more secondary jet ejectors 56*a*, 56*b*, 56*c* coupled to primary jet ejector 52 such that all of the jet ejectors are in a cascaded arrangement. As illustrated by various embodiments below in conjunction with FIGS. 9-31, this cascaded arrangement may be any suitable network of secondary jet ejectors 56 that receive a portion of a primary inlet stream 54 from primary jet ejector 52 and a motive steam 58 and process these streams before feeding a portion of the mixture of these streams back to primary jet ejector 52 for creation of primary outlet stream 55. Primary jet ejector 52 is analogous to jet ejector 5 of FIG. 1 or jet ejector 24 of FIG. 2.

In FIG. 8, a portion of primary inlet stream 54 is bled off and directed to secondary jet ejector 56*a* and, as described above, motive steam 58 is directed into secondary jet ejector 56*c*. At each secondary jet ejector 56, at least some of the portion of primary inlet steam 54 and at least some of motive steam 58 is received to create respective mixtures within secondary jet ejectors 56. And at each secondary jet ejector 56 at least a portion of the respective mixture is directed to adjacent jet ejectors (57 or 56) in the cascaded arrangement.

For various embodiments of the invention utilizing the concept of FIG. 8, Tables 3 through 6 show the required $P_{motive}/P_{inlet}$ (Equation 1) and the resulting $m_{motive}/m_{inlet}$ (Equation 2) for each secondary jet ejector (also referred to as a stage) in the cascade. FIGS. 9 through 20 illustrate the pressures and mass flows for each embodiment shown. Because any suitable operating parameters are contemplated by the present invention, the pressure units and mass units are arbitrarily shown in FIGS. 9 through 20; however, it may be convenient to use atmospheres for pressure and kilograms for mass.

TABLE 3

Analysis of jet ejector for compression ratio of 1.03.

| Area Ratio | Stage | $\frac{P_{outlet}}{P_{inlet}}$ | $\frac{P_{motive}}{P_{inlet}}$ | $\frac{m_{motive}}{m_{inlet}}$ |
|---|---|---|---|---|
| 5 | 1 | 1.03 | 1.127 | 0.079 |
| | 2 | 1.13 | 1.539 | 0.335 |
| | 3 | 1.37 | 2.552 | 0.966 |
| | 4 | 1.86 | 4.647 | 2.271 |
| | 5 | 2.49 | 7.319 | 3.934 |
| 4 | 1 | 1.03 | 1.104 | 0.087 |
| | 2 | 1.10 | 1.360 | 0.301 |
| | 3 | 1.23 | 1.804 | 0.671 |
| | 4 | 1.46 | 2.607 | 1.343 |
| | 5 | 1.78 | 3.704 | 2.260 |
| | 6 | 2.08 | 4.741 | 3.126 |
| | 7 | 2.28 | 5.427 | 3.699 |
| 3 | 1 | 1.03 | 1.080 | 0.098 |
| | 2 | 1.08 | 1.213 | 0.261 |
| | 3 | 1.12 | 1.331 | 0.404 |
| | 4 | 1.33 | 1.883 | 1.078 |
| | 5 | 1.41 | 2.105 | 1.349 |
| | 6 | 1.49 | 2.300 | 1.588 |
| | 7 | 1.55 | 2.457 | 1.779 |
| | 8 | 1.59 | 2.571 | 1.919 |
| | 9 | 1.62 | 2.649 | 2.013 |

TABLE 4

Analysis of jet ejector for compression ratio of 1.05.

| Area Ratio | Stage | $\frac{P_{outlet}}{P_{inlet}}$ | $\frac{P_{motive}}{P_{inlet}}$ | $\frac{m_{motive}}{m_{inlet}}$ |
|---|---|---|---|---|
| 5 | 1 | 1.05 | 1.212 | 0.132 |
| | 2 | 1.21 | 1.899 | 0.560 |
| | 3 | 1.57 | 3.405 | 1.497 |
| | 4 | 2.17 | 5.975 | 3.097 |
| | 5 | 2.75 | 8.421 | 4.621 |
| 4 | 1 | 1.05 | 1.173 | 0.145 |

TABLE 4-continued

Analysis of jet ejector for compression ratio of 1.05.

| Area Ratio | Stage | $\frac{P_{outlet}}{P_{inlet}}$ | $\frac{P_{motive}}{P_{inlet}}$ | $\frac{m_{motive}}{m_{inlet}}$ |
|---|---|---|---|---|
| | 2 | 1.17 | 1.599 | 0.501 |
| | 3 | 1.36 | 2.257 | 1.051 |
| | 4 | 1.66 | 3.269 | 1.896 |
| | 5 | 1.97 | 4.374 | 2.819 |
| | 6 | 2.21 | 5.205 | 3.514 |
| 3 | 1 | 1.05 | 1.133 | 0.163 |
| | 2 | 1.13 | 1.355 | 0.433 |
| | 3 | 1.20 | 1.523 | 0.638 |
| | 4 | 1.27 | 1.731 | 0.893 |
| | 5 | 1.36 | 1.958 | 1.169 |
| | 6 | 1.44 | 2.173 | 1.433 |
| | 7 | 1.51 | 2.358 | 1.658 |
| | 8 | 1.56 | 2.499 | 1.831 |
| | 9 | 1.6 | 2.601 | 1.955 |

TABLE 5

Analysis of jet ejector for compression ratio of 1.1.

| Area Ratio | Stage | $\frac{P_{outlet}}{P_{inlet}}$ | $\frac{P_{motive}}{P_{inlet}}$ | $\frac{m_{motive}}{m_{inlet}}$ |
|---|---|---|---|---|
| 5 | 1 | 1.10 | 1.424 | 0.264 |
| | 2 | 1.42 | 2.798 | 1.120 |
| | 3 | 1.97 | 5.092 | 2.548 |
| | 4 | 2.59 | 7.751 | 4.204 |
| 4 | 1 | 1.10 | 1.346 | 0.289 |
| | 2 | 1.35 | 2.198 | 1.001 |
| | 3 | 1.63 | 3.193 | 1.832 |
| | 4 | 1.96 | 4.308 | 2.764 |
| | 5 | 2.20 | 5.170 | 3.485 |
| 3 | 1 | 1.10 | 1.267 | 0.326 |
| | 2 | 1.27 | 1.712 | 0.869 |
| | 3 | 1.35 | 1.936 | 1.143 |
| | 4 | 1.43 | 2.156 | 1.412 |
| | 5 | 1.50 | 2.345 | 1.642 |
| | 6 | 1.56 | 2.491 | 1.821 |

TABLE 5-continued

Analysis of jet ejector for compression ratio of 1.1.

| Area Ratio | Stage | $\frac{P_{outlet}}{P_{inlet}}$ | $\frac{P_{motive}}{P_{inlet}}$ | $\frac{m_{motive}}{m_{inlet}}$ |
|---|---|---|---|---|
| | 7 | 1.60 | 2.595 | 1.948 |
| | 8 | 1.63 | 2.668 | 2.036 |

TABLE 6

Analysis of jet ejector for compression ratio of 1.2

| Area Ratio | Stage | $\frac{P_{outlet}}{P_{inlet}}$ | $\frac{P_{motive}}{P_{inlet}}$ | $\frac{m_{motive}}{m_{inlet}}$ |
|---|---|---|---|---|
| 5 | 1 | 1.20 | 1.848 | 0.528 |
| | 2 | 1.85 | 4.596 | 2.239 |
| | 3 | 2.49 | 7.306 | 3.926 |
| | 4 | 2.94 | 9.215 | 5.115 |
| 4 | 1 | 1.20 | 1.693 | 0.579 |
| | 2 | 1.69 | 3.400 | 2.006 |
| | 3 | 2.01 | 4.491 | 2.917 |
| | 4 | 2.24 | 5.281 | 3.577 |
| | 5 | 2.36 | 5.718 | 3.942 |
| 3 | 1 | 1.20 | 1.534 | 0.652 |
| | 2 | 1.53 | 2.422 | 1.736 |
| | 3 | 1.58 | 2.545 | 1.886 |
| | 4 | 1.61 | 2.630 | 1.990 |
| | 5 | 1.63 | 2.686 | 2.059 |
| | 6 | 1.65 | 2.724 | 2.104 |
| | 7 | 1.66 | 2.748 | 2.134 |

Table 7 illustrates the mass yield for various embodiments. The results indicate that the method works best when the per-stage compression ratio is small, which requires more stages. Further, the method works best when the area ratio is small, which also requires more stages. More stages allow the inlet pressures and motive pressures to be closely matched, thereby allowing streams with similar velocities to be blended. In some embodiments, extraordinarily high mass yields (kg water/kg steam) are possible.

TABLE 7

Case studies for vapor-compression distillation. ($T_{evaporator}$ = 100° C.)

| ΔT (° C.) | Overall Compression Ratio | Per-Stage Compression Ratio | Number of Stages | Area Ratio | Per-Stage Mass Yield (kg water/kg steam) | Overall Mass Yield (kg water/kg steam) |
|---|---|---|---|---|---|---|
| 5 | 1.2 | 1.03 | 6 | 5 | 119 | 19.8 |
| | | | | 4 | 190 | 31.6 |
| | | | | 3 | 425 | 70.8 |
| | | 1.05 | 4 | 5 | 37.1 | 9.3 |
| | | | | 4 | 49.3 | 12.3 |
| | | | | 3 | 138 | 34.5 |
| | | 1.10 | 2 | 5 | 11.1 | 5.55 |
| | | | | 4 | 11.5 | 5.75 |
| | | | | 3 | 18.2 | 9.10 |
| | | 1.20 | 1 | 5 | 3.58 | 3.58 |
| | | | | 4 | 3.72 | 3.72 |
| | | | | 3 | 4.48 | 4.48 |

An advantage of utilizing a cascaded arrangement of jet ejectors, such as jet ejector system 50, is that it blends gas streams of similar pressures; therefore, the velocity of each gas stream is similar. This leads to high efficiencies, even using traditional jet ejectors. Efficiency may be improved further by improving the design of the jet ejector, as is described in further detail below.

Figure 21:
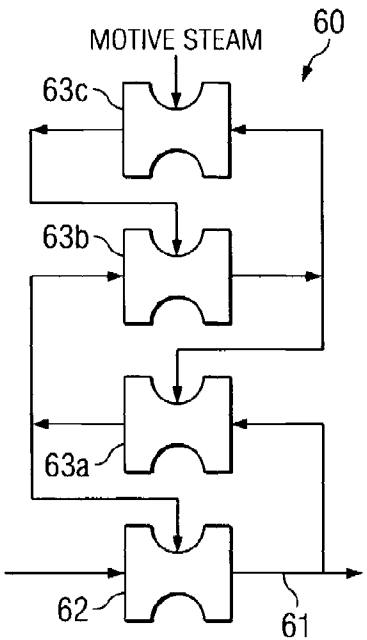
Figure 20:
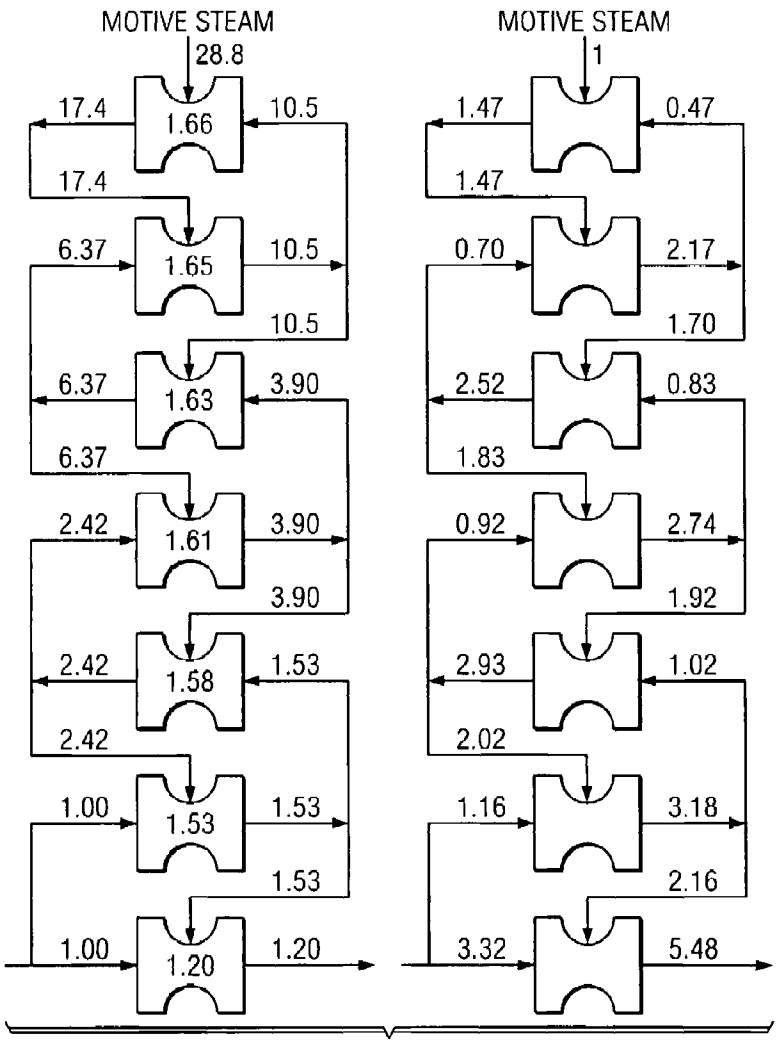

FIG. 21 illustrates a jet ejector system 60 according to another embodiment of the invention. In system 60, a portion of a primary outlet stream 61 from primary jet ejector 62 is bled off and directed to one or more secondary jet ejectors 63. This is in contrast to system 50 of FIG. 8 in which a portion of primary inlet stream 54 was bled off. The rest of system 60 work in a similar manner to system 50.

Figure 22:
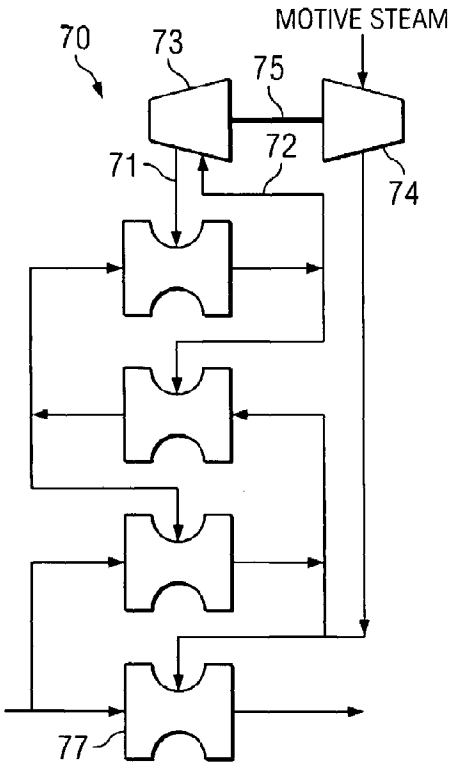
FIGS. 21 through 31 illustrate various jet ejector systems according to various embodiments of the invention.

FIG. 22 illustrates a jet ejector system 70 according to another embodiment of the invention. In system 70, a high-pressure steam, as indicated by reference numeral 71, that powers the cascade of jet ejectors is produced by drawing a side stream 72 from one of the jet ejectors and compressing it with a suitable mechanical compressor 73. In this case, the compressor is powered by a suitable steam turbine 74 via shaft 75 The waste steam 76 from turbine 74 may provide motive power to one or more of the jet ejectors, such as primary jet ejector 77.

Figure 23:
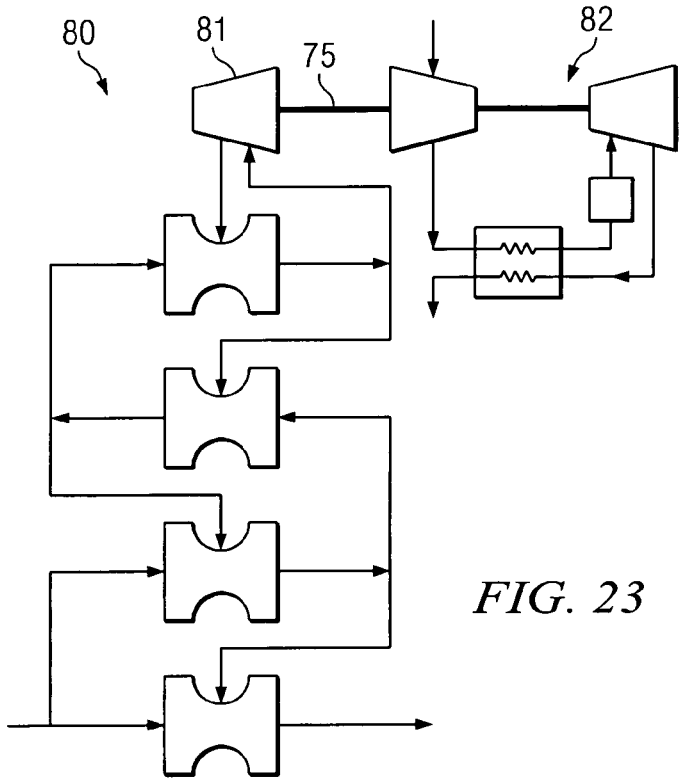

FIG. 23 illustrates a jet ejector system 80 according to another embodiment of the invention. System 80 is similar to system 70 except that in system 80 a compressor 81 is powered by a Brayton cycle engine 82 or other suitable engine. A suitable electric motor may also be utilized to power compressor 81.

Figure 24:
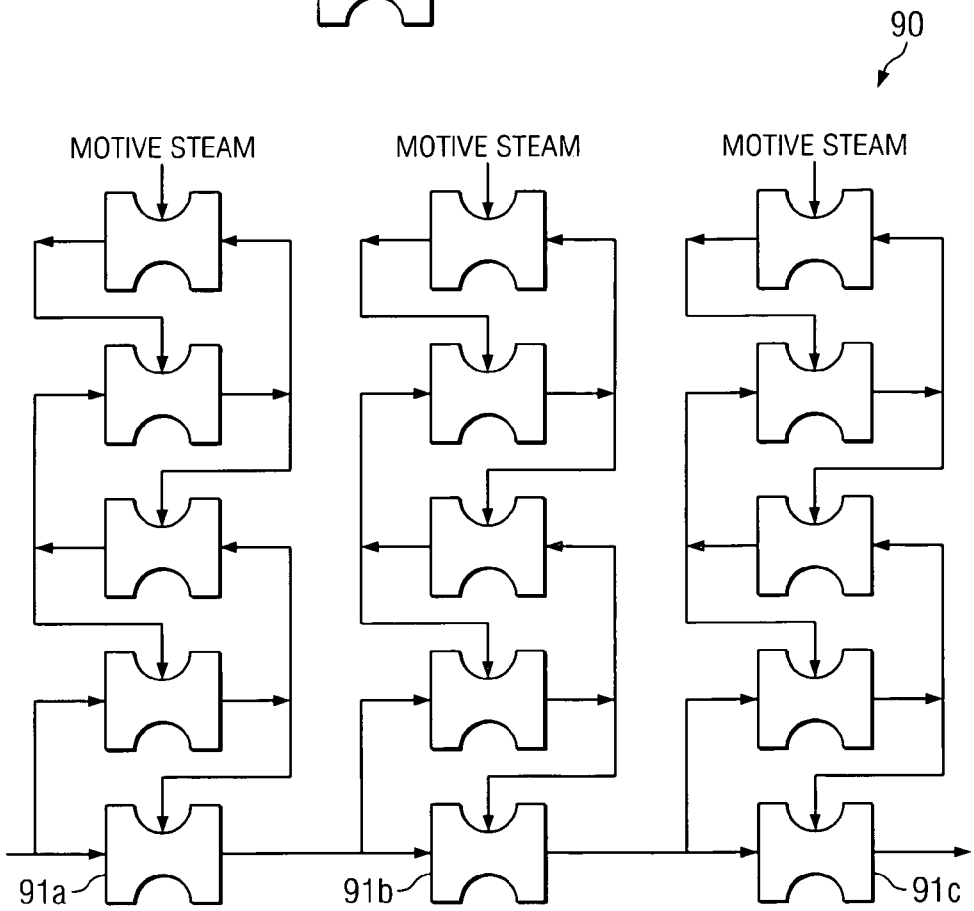

FIG. 24 illustrates a jet ejector system 90 according to another embodiment of the invention. In system 90, multiple compression stages are employed by a plurality of primary jet ejectors 91*a*, 91*b*, 91*c* in series. Each primary jet ejector 91 is supported by its own independent cascade of secondary jet ejectors, which may operate according to one of the embodiments described above in FIGS. 8, 21, 22 and/or 23.

Figure 25:
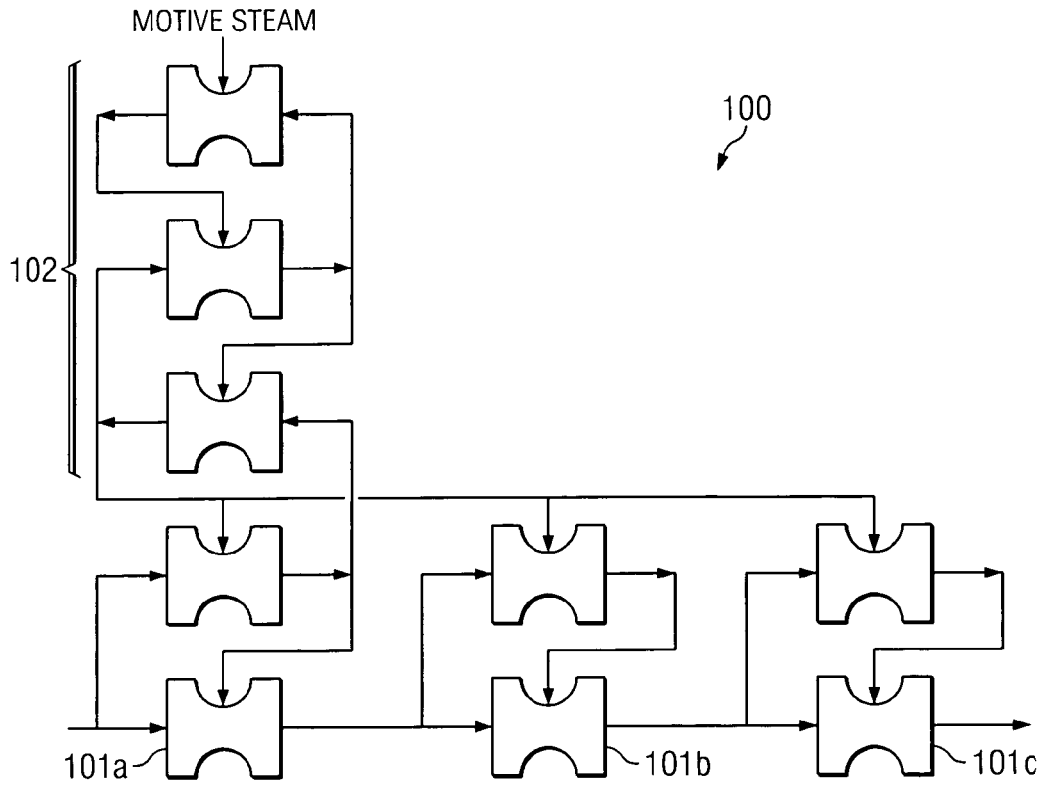

FIG. 25 illustrates a jet ejector system 100 according to another embodiment of the invention. In system 100, multiple compression stages are employed by a plurality of primary jet ejectors 101*a*, 101*b*, 101*c* in series. However, system 100 differs from system 90 of FIG. 24 in that some of the high-pressure secondary jet ejectors 102 from one cascade are shared with other primary jet ejectors 101 in the series. This reduces the number of secondary jet ejectors, thereby saving capital costs.

Figure 26:
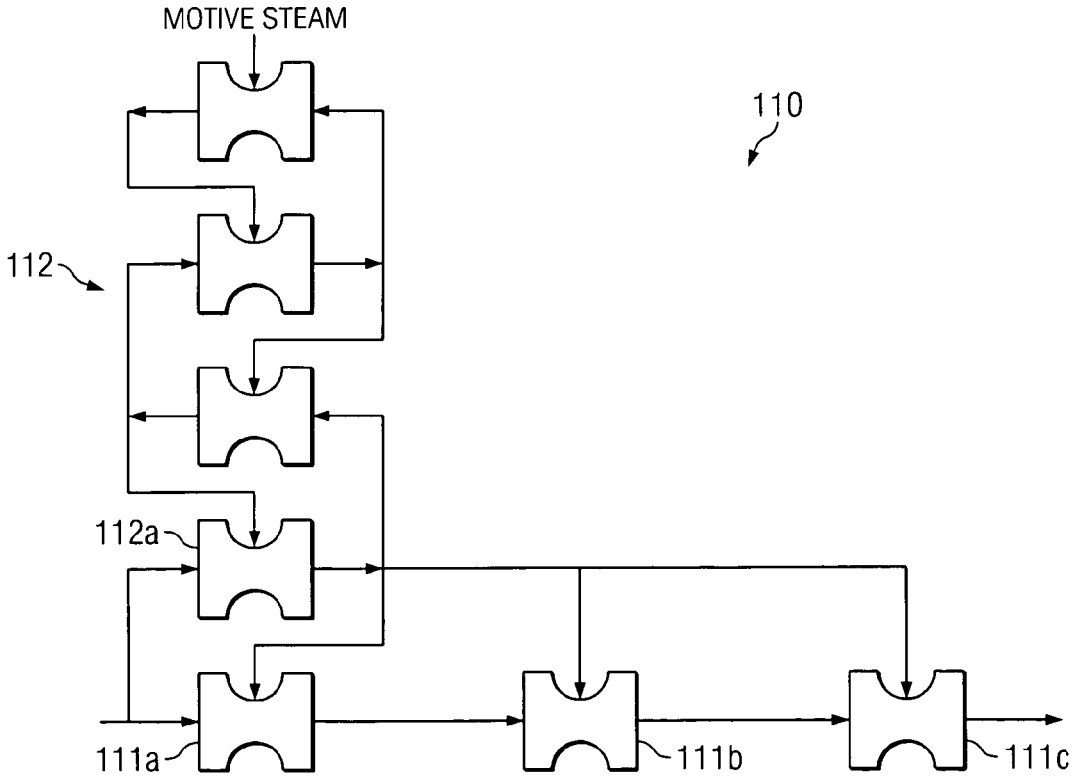

FIG. 26 illustrates a jet ejector system 110 according to another embodiment of the invention. In system 110, multiple compression stages are employed by a plurality of primary jet ejectors 111*a*, 111*b*, 111*c* in series. In this embodiment, only the first primary jet ejector 111*a* in the series includes a cascade 112 of jet ejectors; however, each of the other primary jet ejectors 111*b*, 111*c* receive a stream from one of the secondary jet ejectors from cascade 112 (in this example, secondary jet ejector 112*a*). This again helps reduce the number of jet ejectors, thereby saving capital costs.

Figure 27:
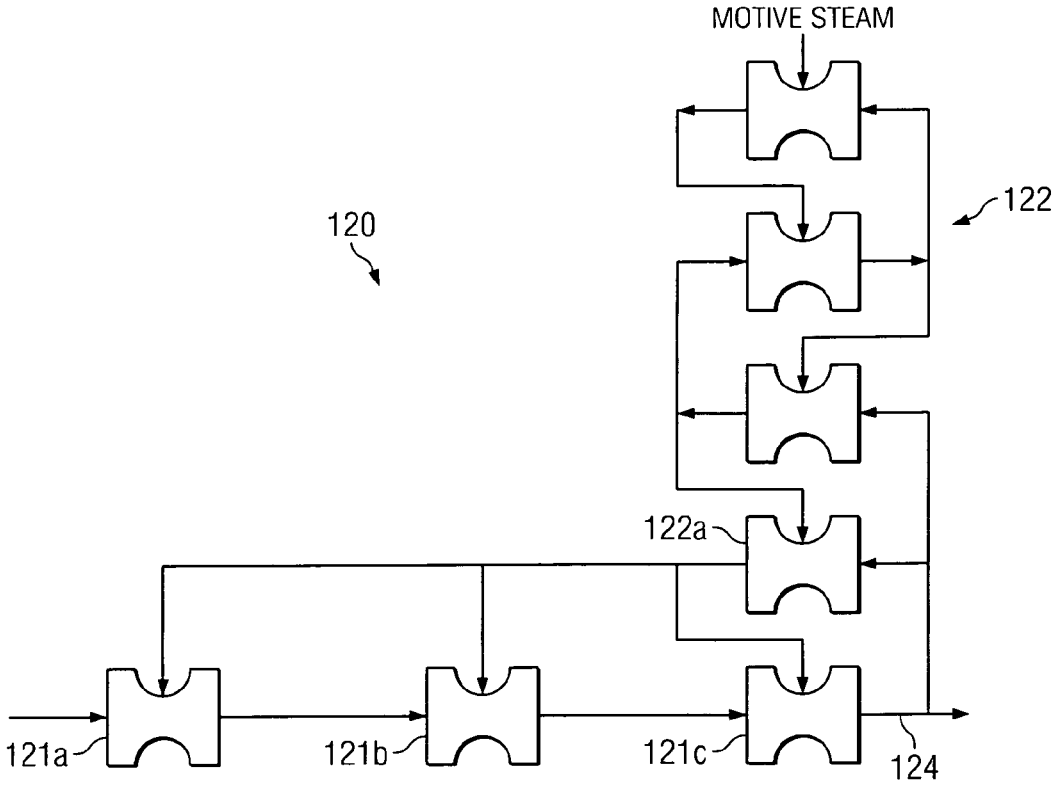

FIG. 27 illustrates a jet ejector system 120 according to another embodiment of the invention. In system 120, multiple compression stages are employed by a plurality of primary jet ejectors 121*a*, 121*b*, 121*c* in series. In this embodiment, only the last primary jet ejector 121*c* in the series includes a cascade 122 of jet ejectors; however, each of the other primary jet ejectors 121*a*, 121*b* receive a stream from one of the secondary jet ejectors from cascade 122 (in this example, secondary jet ejector 122*a*). In addition, secondary jet ejector 122*a* is receiving a portion of outlet stream 124 from primary jet ejector 121*c*.

Figure 28:
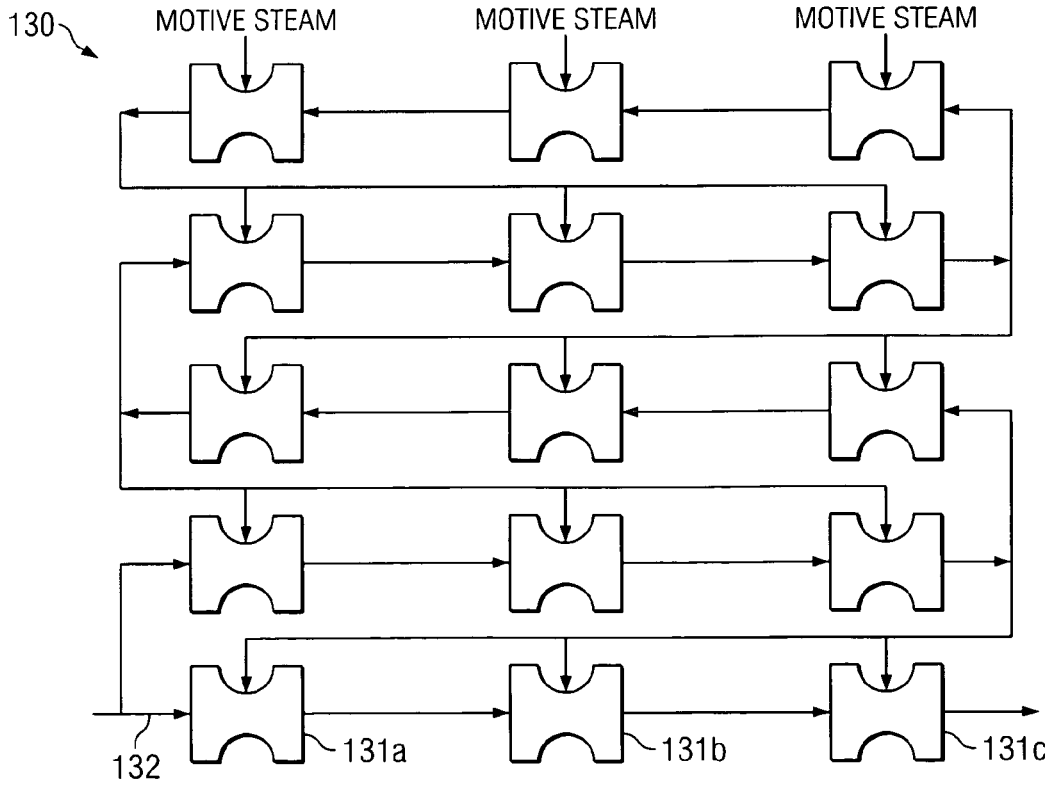

FIG. 28 illustrates a jet ejector system 130 according to another embodiment of the invention. In system 130, multiple compression stages are employed by a plurality of primary jet ejectors 131*a*, 131*b*, 131*c* in series. And an equal number of stages of secondary jet ejectors are included in each cascade. The secondary jet ejectors that comprise a particular stage are in series. In this embodiment, the stream for the cascades is drawn from a primary inlet stream 132 of the first primary jet ejector 131*a*.

Figure 29:
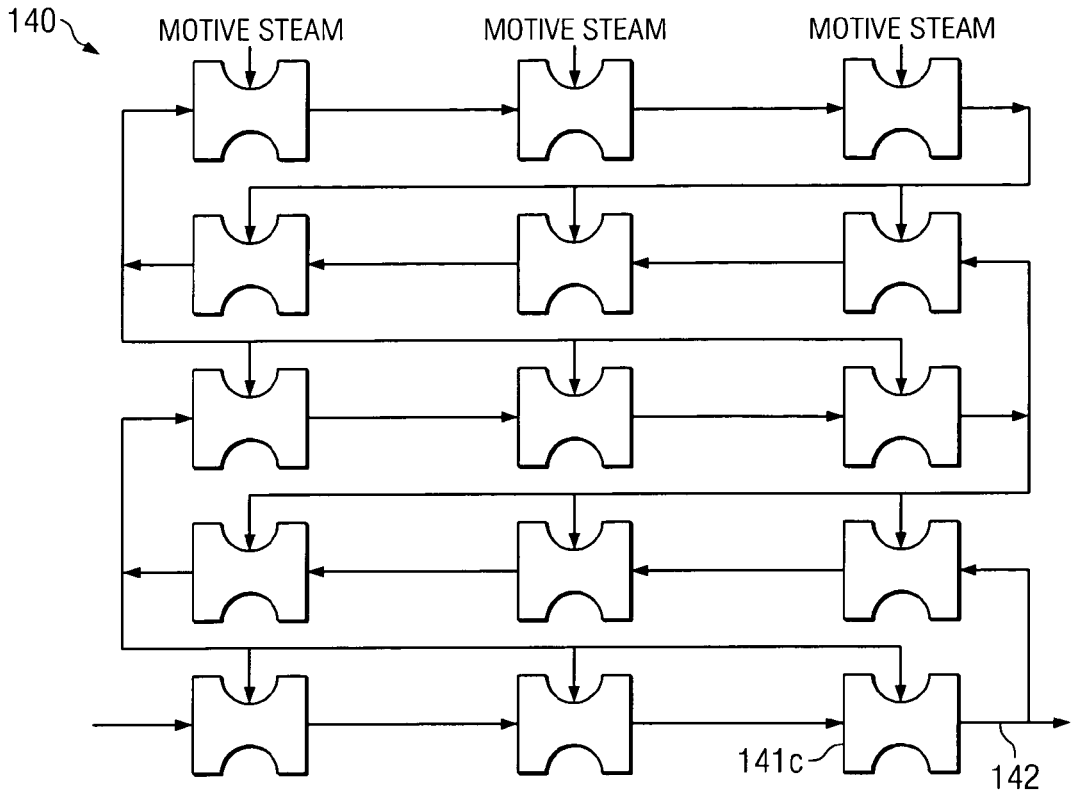

FIG. 29 illustrates a jet ejector system 140 according to another embodiment of the invention. System 140 is similar to system 130, except the stream for the cascades is drawn from a primary outlet stream 142 of a primary jet ejector 141*c* in the series.

Figure 30:
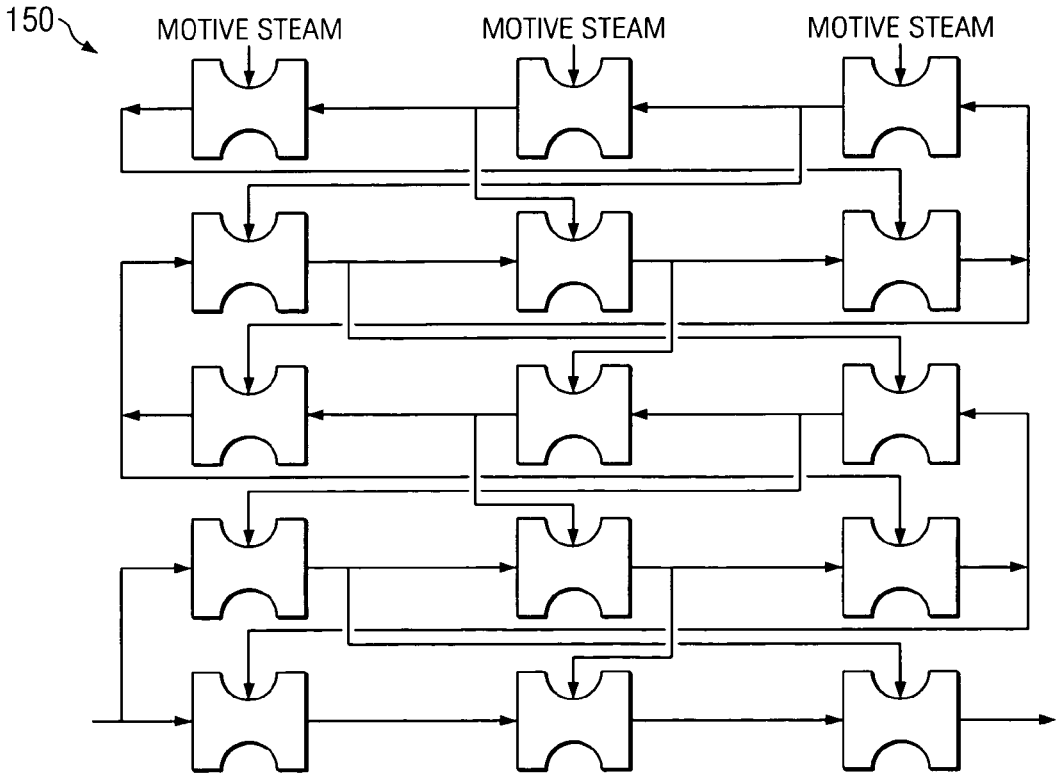
Figure 31:
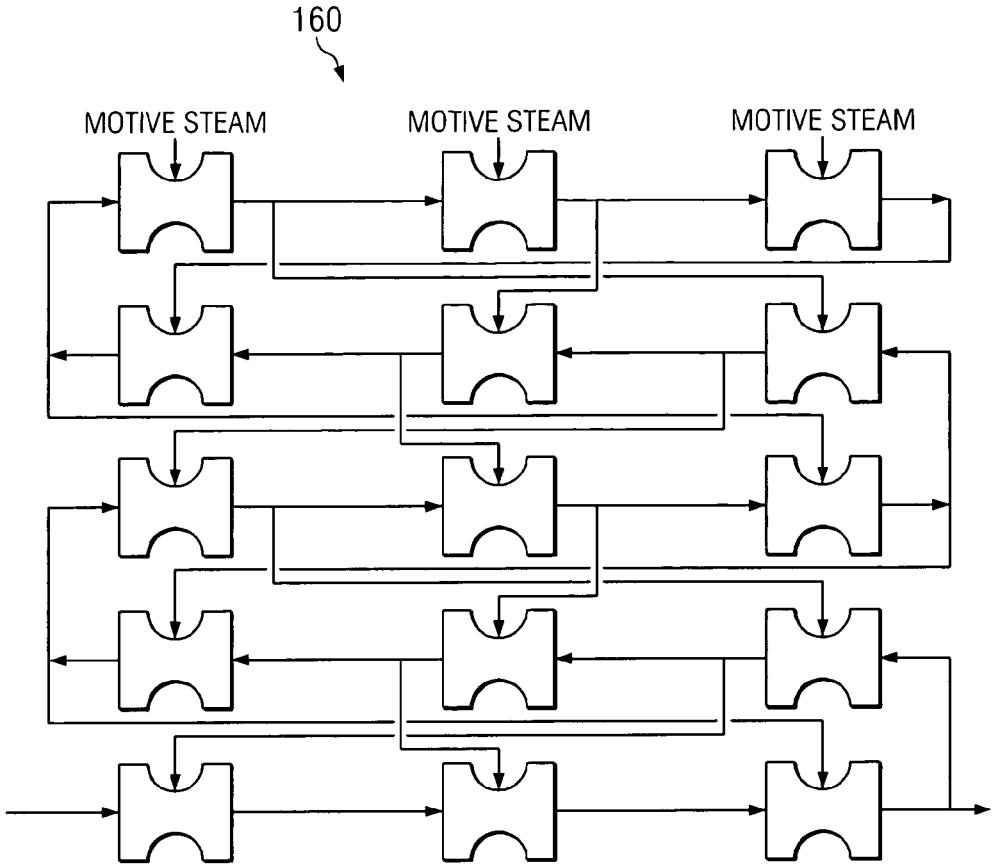

FIGS. 30 and 31 illustrate jet ejector systems 150, 160, respectively, according to other embodiments of the invention. Systems 150, 160 are similar to systems 130, 140, respectively; however, the flow arrangement in systems 150, 160 obtains a closer match of motive pressures to inlet pressures. Other suitable arrangements of both primary and secondary jet ejectors as well as arrangement of cascades are contemplated by the present invention.

Thus, an advantage of the jet ejector systems described above is that they blend gas streams of similar pressures; therefore, the velocity of each gas stream is similar. This leads to high efficiencies, even using traditional jet ejectors. The efficiency may be improved further by improving the design of the jet ejector, some embodiments of which are described below in conjunction with FIGS. 32 through 41.

FIGS. 32 through 36 illustrate various embodiments of an improved design of a jet ejector that allows large volumes of motive fluid to be added to propelled gas without obstructing the flow of the propelled gas.

Figure 32:
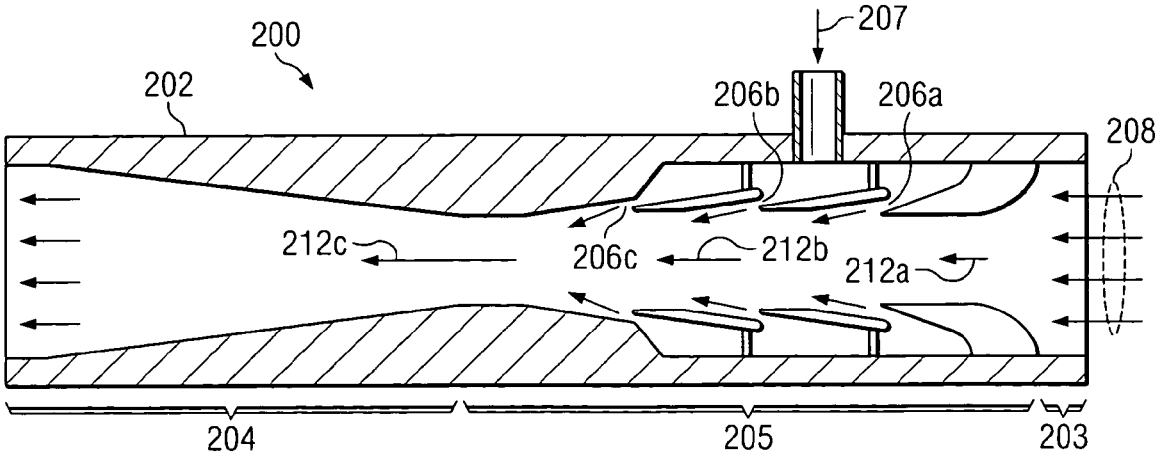
FIG. 32 illustrates a jet ejector according to one embodiment of the invention.

FIG. 32 illustrates a jet ejector 200 according to one embodiment of the invention. Jet ejector 200 may have any suitable size and shape and may be formed from any suitable material. In the illustrated embodiment, jet ejector 200 includes a nozzle 202 having an upstream portion 203, a downstream portion 204, and a throat 205 disposed between upstream portion 203 and downstream portion 204. A plurality of sets of apertures 206 are located in a wall of nozzle 202 in throat 205, in which the plurality of sets are longitudinally spaced along the wall. Each set of apertures 206 has its apertures circumferentially located around the wall in any suitable pattern and spacing. Apertures 206 may be any suitably shaped apertures. For example, in the illustrated embodiment, apertures are in the form of circumferential slots. Jet ejector 200 also includes a device (not explicitly shown) that is operable to inject a motive fluid 207 through apertures 206 and into a first stream 208 flowing through nozzle 202. Motive fluid 207 may be any suitable motive fluid, such as gas, vapor, liquid, and may be supplied through an annular space 211 in the wall of nozzle 202. In such an embodiment, the pressure of motive gas 207 entering each set of apertures 206 is constant. In addition, motive fluid 207 enters first stream 208 at an angle with respect to the flow direction of first stream 208.

In operation, first stream 208, which may be any suitable propelled gas, such as low pressure vapor, enters upstream portion 203 of nozzle 202. Throat 205 then initially accelerates first stream 208 when it enters throat 205. The motive fluid 207 accelerates first stream 208 even further after entering throat 205 via apertures 206. To minimize the velocity difference between motive fluid 207 and first stream 208, it is advantageous to have the upstream most set of apertures 206*a* accelerate first stream 208 first, then the next set of apertures 206*b* accelerate first stream 208 second, and then the next set of apertures 206*c* accelerate first stream 208 last. The size of arrows 212 is meant to illustrate the accelerating of first stream 208 through nozzle 202.

FIG. 33 illustrates a jet ejector 220 according to another embodiment of the invention. Jet ejector 220 is similar to jet ejector 200; however, in this embodiment, jet ejector 220 includes sets of apertures 226 in which each successive set of apertures 226 (as their location is farther downstream) is fed with a motive fluid 227 at increasingly higher pressures, which allows motive gas 227 exiting the later set of apertures 206 to have increasingly larger velocities. Thus, set of apertures 226*c* has a greater pressure than set of apertures 226*b*, which has a greater pressure than set of apertures 226*c*. Because a first stream 228 also has increasingly larger velocities, jet ejector 220 minimizes the velocity difference between the two streams, thereby improving efficiency.

Figure 36:
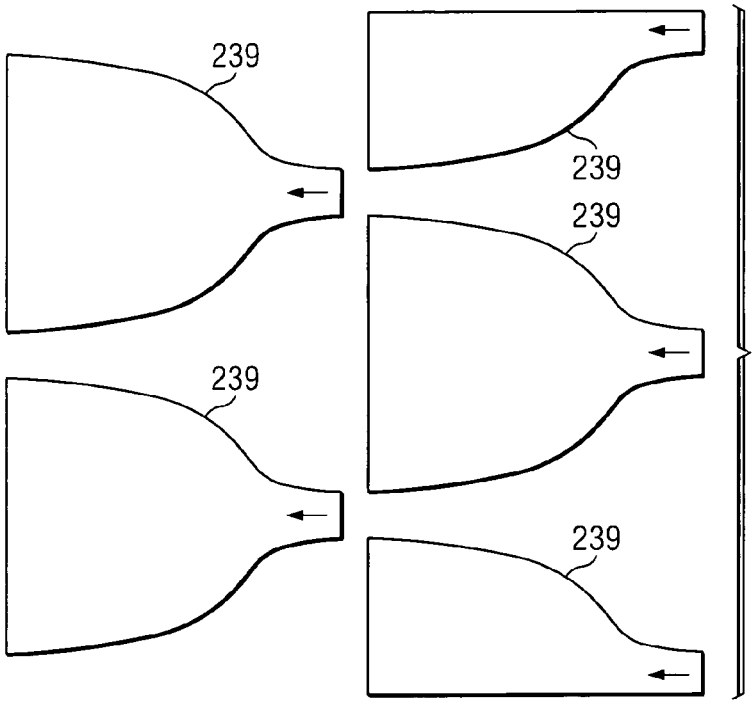
FIG. 36 illustrates a pattern of nozzle ducts according to one embodiment of the invention.

FIGS. 34 through 36 illustrates a jet ejector 230 according to another embodiment of the invention. In this embodiment, a motive gas 237 enters a throat 235 of nozzle 232 through multiple point sources 236, rather than through circumferential slots as in jet ejectors 200, 220. Multiple point sources 236 may have any suitable configuration but are preferably small holes or slots. FIG. 35A is a cross-sectional view through the wall of throat 235 illustrating one of the point sources 236. FIG. 35B illustrates a frontal view of the interior wall of throat 235. As illustrated, point source 236 is coupled to a fan-shaped duct 239 that is defined by walls diverging in a downstream direction in order to introduce motive fluid 237 into throat 235 to entrain first stream 238 (i.e., propelled gas) flowing through nozzle 232. In one embodiment, fan-shaped duct 239 is a NACA duct. FIG. 36 is a two-dimensional view of the interior wall of nozzle 232 showing a staggered arrangement of multiple fan-shaped ducts 239. However, the present invention contemplates any suitable arrangement of fan-shaped ducts 239.

Thus, an advantage of the jet ejectors described in FIGS. 32 through 36 is that they blend gas streams of similar velocities, but do not obstruct the flow of the propelled gas. These jet ejectors may be used in any suitable application, such as compressors, heat pumps, water-based air conditioning, vacuum pumps, and propulsive jets (both for watercraft and aircraft).

FIGS. 37 through 41 illustrate various embodiments of an improved design of a liquid jet ejector that allows motive liquid to be added to the propelled gas without obstructing the flow of the propelled gas. In some embodiments, the motive liquid may be added in stages, which increases efficiency.

Figure 37:
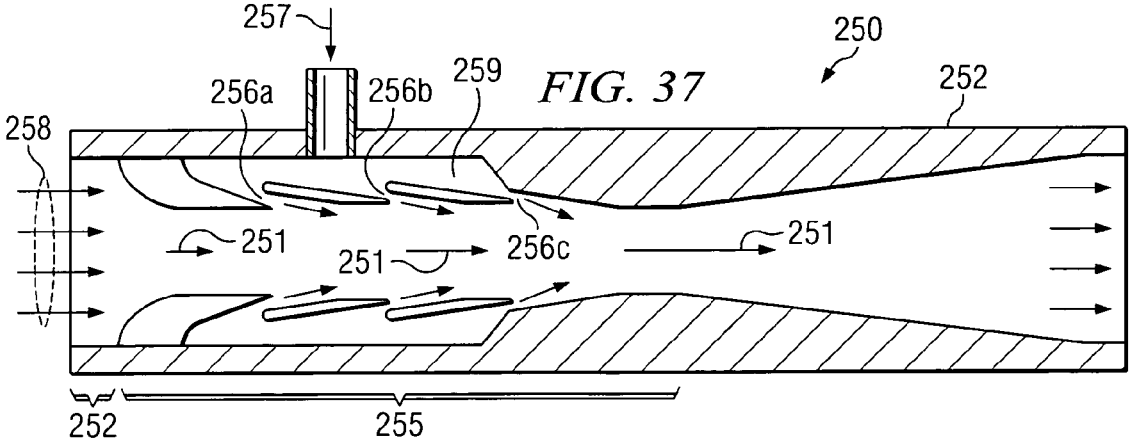
FIG. 37 illustrates a liquid jet ejector according to one embodiment of the invention.

FIG. 37 illustrates a liquid jet ejector 250 according to one embodiment of the invention. Liquid jet ejector 250 is similar to jet ejector 200 (FIG. 32); however, the motive fluid in liquid jet ejector 250 is liquid. In operation, a first stream 258, which may be any suitable propelled gas, such as low pressure vapor, enters an upstream portion 253 of nozzle 252. A throat 255 then initially accelerates first stream 258 when it enters throat 255. The motive fluid 257 accelerates first stream 258 even further after entering throat 255 via nozzles 256. To minimize the velocity difference between motive fluid 257 and first stream 258, it is advantageous to have the upstream most set of nozzles 256*a* accelerate first stream 258 first, then the next set of apertures 256*b* accelerate first stream 258 second, and then the next set of apertures 256*c* accelerate first stream 258 last. The size of arrows 251 is meant to illustrate the accelerating of first stream 258 through nozzle 252. The motive liquid 257 may be supplied via an annular space 259 formed in the wall of nozzle 252. Alternatively, each nozzle 256 could be supplied by its own pipe. In this embodiment, the pressure of the motive fluid 257 entering each nozzle 256 is constant. Similar to apertures 206 of jet ejector 200, nozzles 256 may be circumferentially located around the wall in any suitable pattern and spacing.

Figure 38:
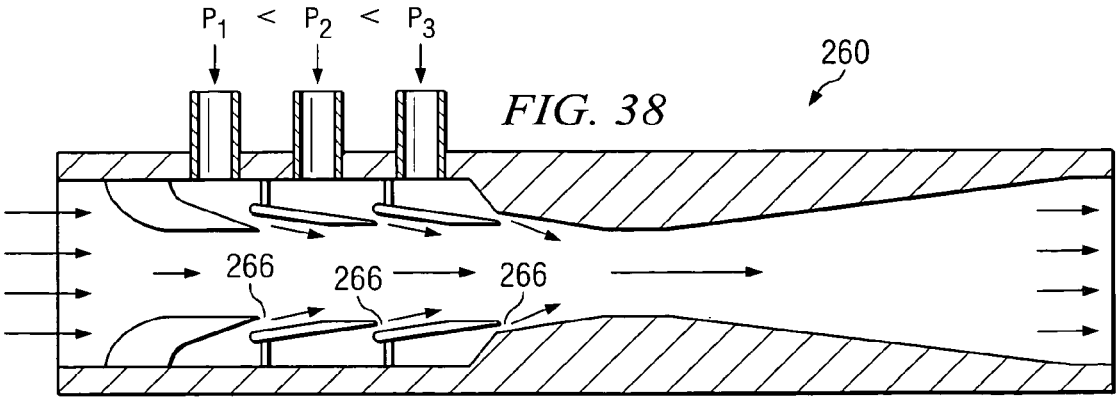
FIG. 38 illustrates a liquid jet ejector according to another embodiment of the invention.

FIG. 38 illustrates a liquid jet ejector 260 according to one embodiment of the invention. Liquid jet ejector 260 is similar to jet ejector 220 (FIG. 33); however, the motive fluid in liquid jet ejector 260 is liquid and liquid jet ejector 260 includes nozzles 266 similar to nozzles 256 of liquid jet ejector 250 of FIG. 37.

Figure 39:
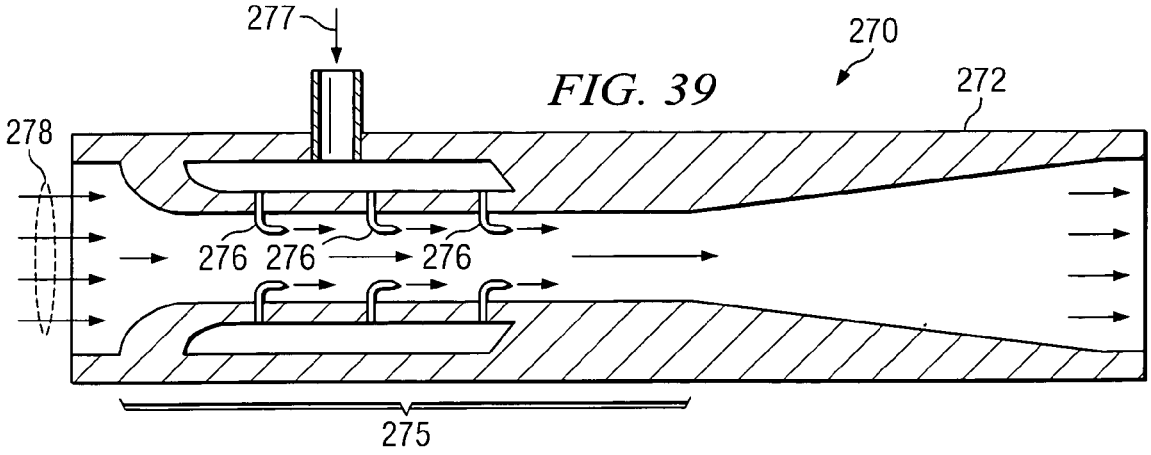
FIG. 39 illustrates a liquid jet ejector according to another embodiment of the invention.

FIG. 39 illustrates a liquid jet ejector 270 according to one embodiment of the invention. Liquid jet ejector 270 is similar to liquid jet ejector 250, except that the motive liquid 277 enters a throat 275 of nozzle 272 through small tubes 276 that are tipped with nozzles. This embodiment facilitates the velocity of motive liquid 277 exiting the nozzles to be parallel to the velocity of a first stream 278 (i.e., the propelled fluid). Any suitable number and arrangement of tubes 276 is contemplated by the present invention.

Figure 40:
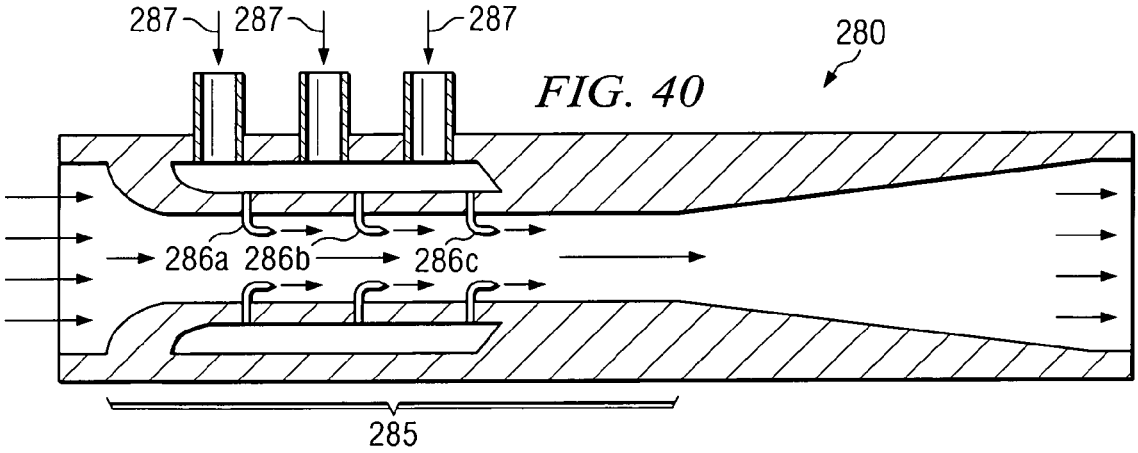
FIG. 40 illustrates a liquid jet ejector according to another embodiment of the invention.

FIG. 40 illustrates a liquid jet ejector 280 according to one embodiment of the invention. Liquid jet ejector 280 is similar to liquid jet ejector 270 except that the motive liquid 287 enters a throat 285 via tubes 286 at increasingly higher pressures as their location is farther downstream, which allows motive fluid 287 exiting the later set of tubes 286*c* to have increasingly larger velocities. Thus, motive fluid 287 exiting tubes 286*c* has a greater pressure than motive fluid 287 exiting tubes 286*b*, which has a greater pressure than motive fluid 287 exiting tubes 286*a*.

Figure 41:
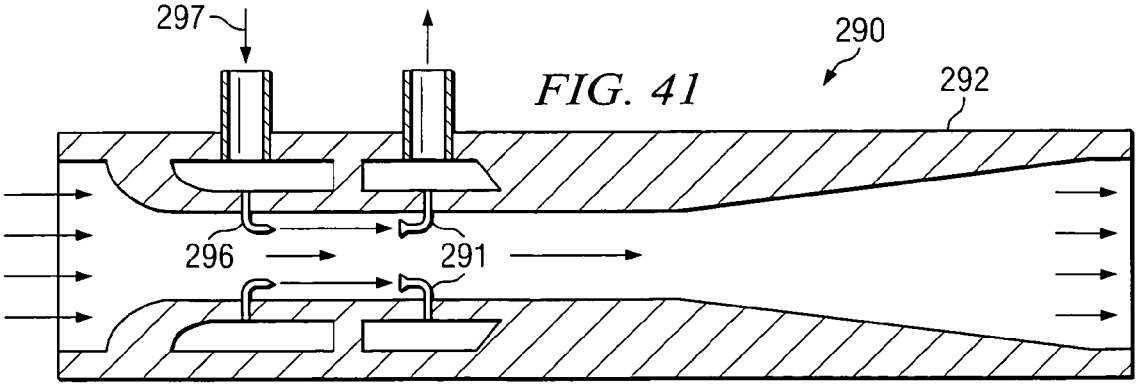
FIG. 41 illustrates a liquid jet ejector according to another embodiment of the invention.

FIG. 41 illustrates a liquid jet ejector 290 according to one embodiment of the invention. Liquid jet ejector 290 includes a plurality of receptacles 291 coupled to the wall of nozzle 292 in order to collect the motive liquid 297, thereby allowing the liquid to be readily collected and recycled. Receptacles 291 may be any suitable size and shape and are preferably located directly downstream from the nozzles of tubes 296. The kinetic energy of the exiting liquid converts to pressure at the inlet to the pump, which reduces the required work input to the pump, thereby increasing efficiency. Although FIG. 41 illustrates only one liquid stage along the axial length of nozzle 292, multiple liquid stages may be employed.

Thus, advantages of the liquid jet ejectors of FIGS. 37 through 41 are as follows: (1) the motive liquid may be added in stages, which increases system efficiency, and (2) the path of the propelled gas may be largely unobstructed by the nozzles that supply the motive liquid. These liquid jet ejectors may be used in any suitable applications, including compressors, heat pumps, water-based air conditioning, vacuum pumps, and vapor compression evaporators. Rather than propelling a gas, they could also be used to propel a liquid. If the outlet area of the jet ejector is less than its inlet area, then it may be used as a propulsive jet for watercraft.

FIGS. 42 through 51 illustrate various embodiments of an evaporator system that incorporates a liquid jet ejector according to various embodiments of the invention.

Figure 42:
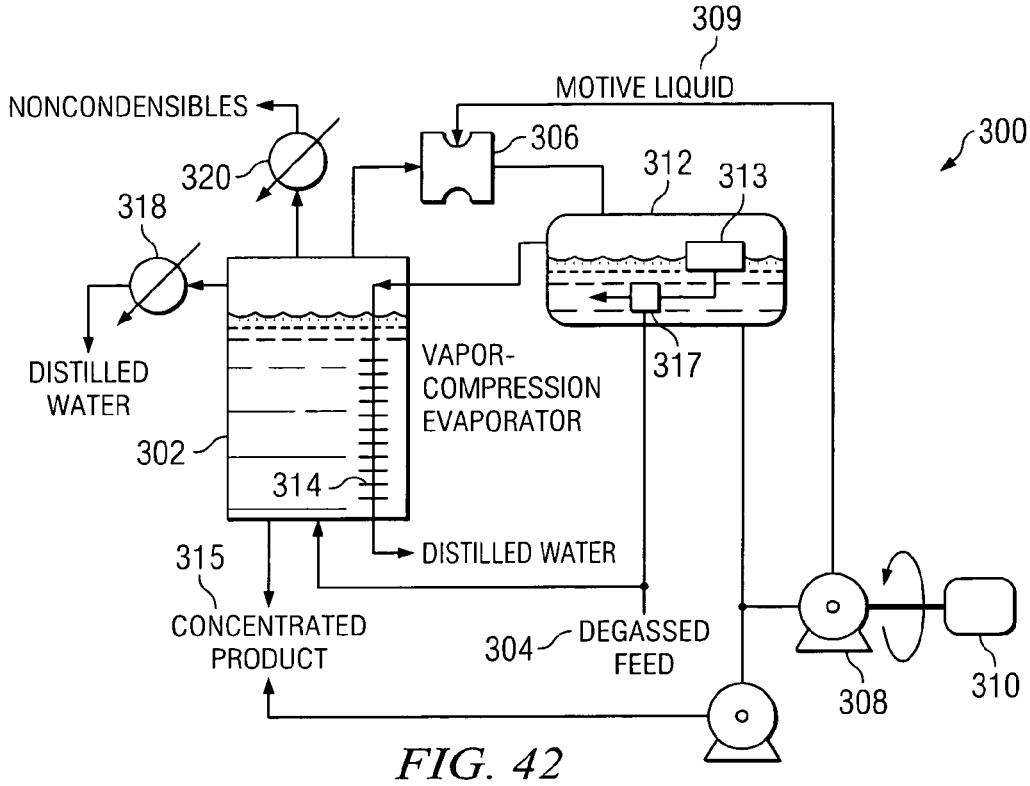
FIGS. 42 through 51 illustrate various embodiments of an evaporator system that incorporates a liquid jet ejector according to various embodiments of the invention.

FIG. 42 illustrates an evaporator system 300 according to one embodiment of the invention. In the illustrated embodiment, system 300 includes a vessel 302 containing a feed 304 having a nonvolatile component (e.g., salt, sugar). The feed 304 may first be degassed by pulling a vacuum on it (equipment not explicitly shown). A liquid jet ejector 306 is coupled to vessel 302 and is operable to receive a vapor from vessel 302. An example of liquid jet ejector 306 is one marketed by Hijet from Houston, Tex. A pump 308, which may be driven by a suitable electric motor 310, is operable to deliver a motive liquid 309 to liquid jet ejector 306. A knock-out tank 312 is coupled to liquid jet ejector 306 and is operable to separate liquid and vapor received from liquid jet ejector 306 with the aid of a float 313 and a valve 317.

A heat exchanger 314 is coupled inside vessel 302 and is operable to receive the vapor from knock-out tank 312, at least some of the vapor condensing within heat exchanger 314, thereby forming a distilled liquid such as distilled water if the feed is, for example, salt water. The heat of condensation provides the heat of evaporation to vessel 302 to evaporate feed 304. Concentrated product 315 is removed from vessel 302 via any suitable method. Energy that is added to system 300 may be removed using a condenser 318. Alternatively, if condenser 318 were eliminated, the energy added to system 300 will increase the temperature of concentrated product 315. This is acceptable if the product is not temperature sensitive. To remove noncondensibles from system 300, a small stream is pulled from vessel 302 and passed through a condenser 320, and then sent to a vacuum pump (not explicitly illustrated).

In system 300, motive liquid 309 may be a nonvolatile, immiscible, nontoxic, low-viscosity liquid (e.g., silicone oil) or it may be water. If it is water, the water will be in near equilibrium with the vapors discharged from jet ejector 306. When this water is pumped, it may easily cavitate in pump 308. In one embodiment, to overcome this problem, knock-out tank 312 is elevated relative to pump 308 so there is no cavitation. Ideally, if the system were perfect, the liquid water could be recycled indefinitely. However, in reality, energy is input into the circulating water (e.g., pump losses, pipe friction). This energy input causes the circulating water to evaporate, so make-up water should be added. In one embodiment, the make-up water is feed water, which has the following benefits: (1) the nonvolatile components increase the fluid density, which improves the efficiency of the jet ejector and (2) the waste thermal energy generated within the circulating fluid causes water to evaporate, which forms more product.

Figure 43:
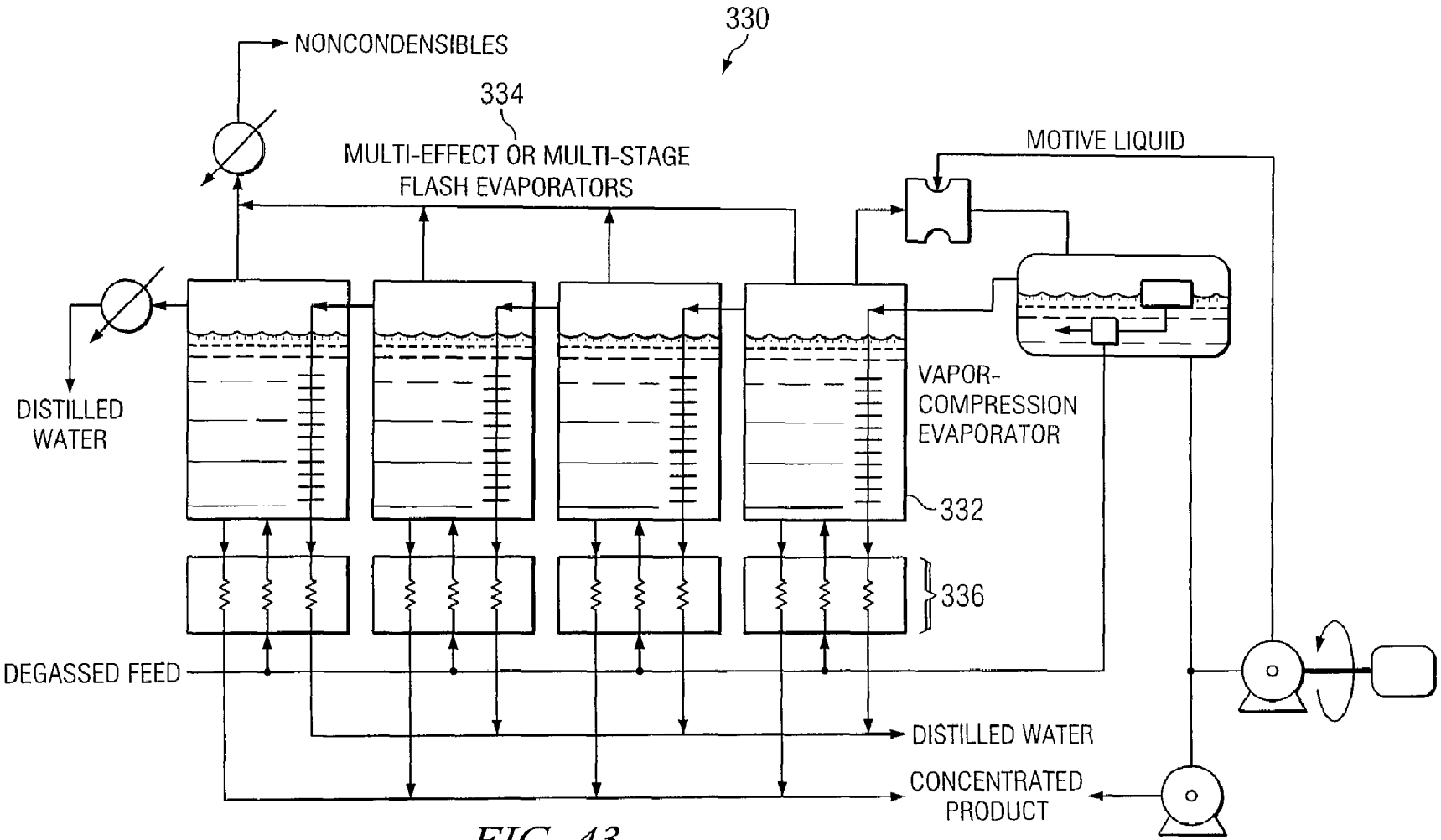

FIG. 43 illustrates an evaporator system 330 according to another embodiment of the invention. System 330 is similar to system 300, except that a vessel 332 is operated at a higher temperature and pressure than vessel 302. In system 330, energy that is added to vessel 332 can cascade through a multi-effect evaporator 334, which allows additional evaporation to occur. Only three stages are shown in FIG. 43, but more or less are contemplated by the present invention. Alternatively, a multi-stage flash evaporator could be employed rather than a multi-effect evaporator. In system 330, noncondensibles may be removed in a manner similar to system 300. A plurality of sensible heat exchangers 336 may be coupled to vessel 332 and the multi-effect evaporators for heating the feed or for other suitable functions.

Figure 44:
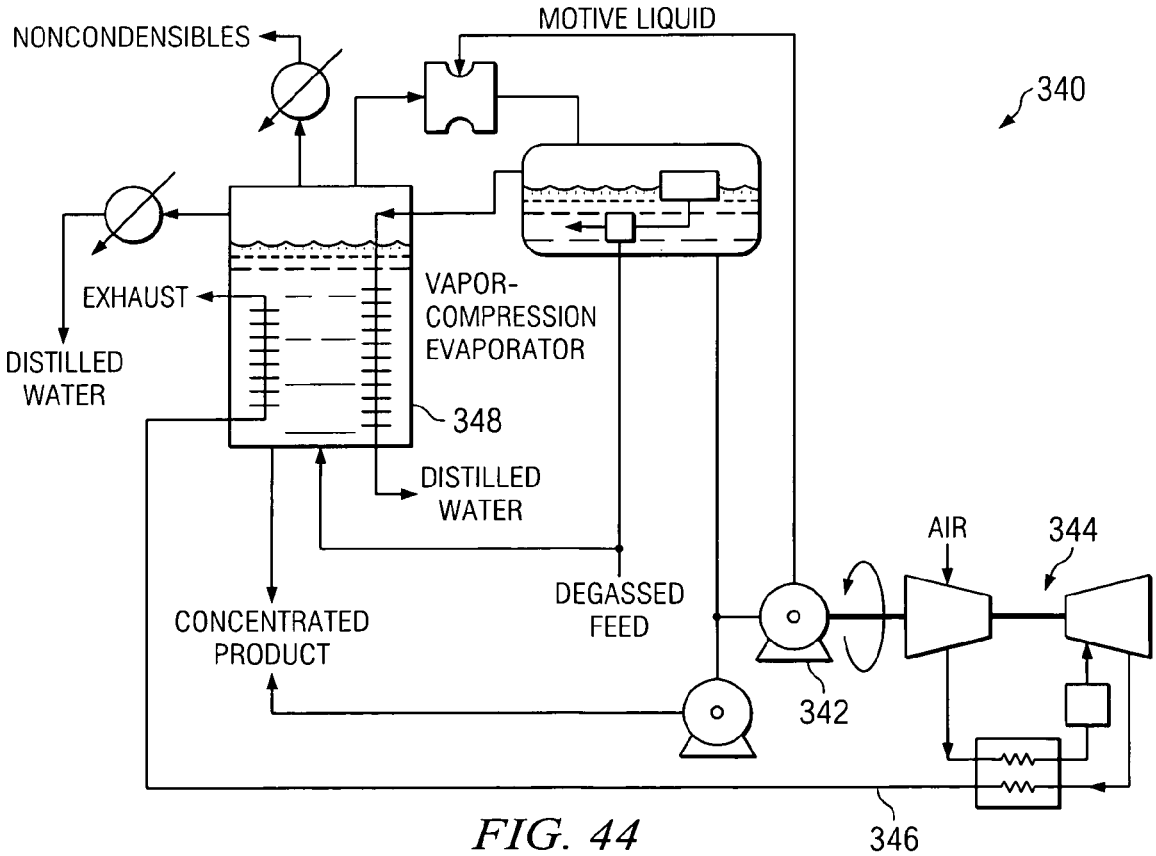

FIG. 44 illustrates an evaporator system 340 according to another embodiment of the invention. System 340 is similar to system 300, except that a pump 342 is driven by a Brayton cycle engine 344 or other suitable engines, such as a Diesel engine or Otto cycle engine. In one embodiment of system 340, hot engine exhaust 346 is thermally contacted with the feed in the vessel 348, which produces more product.

Figure 45:
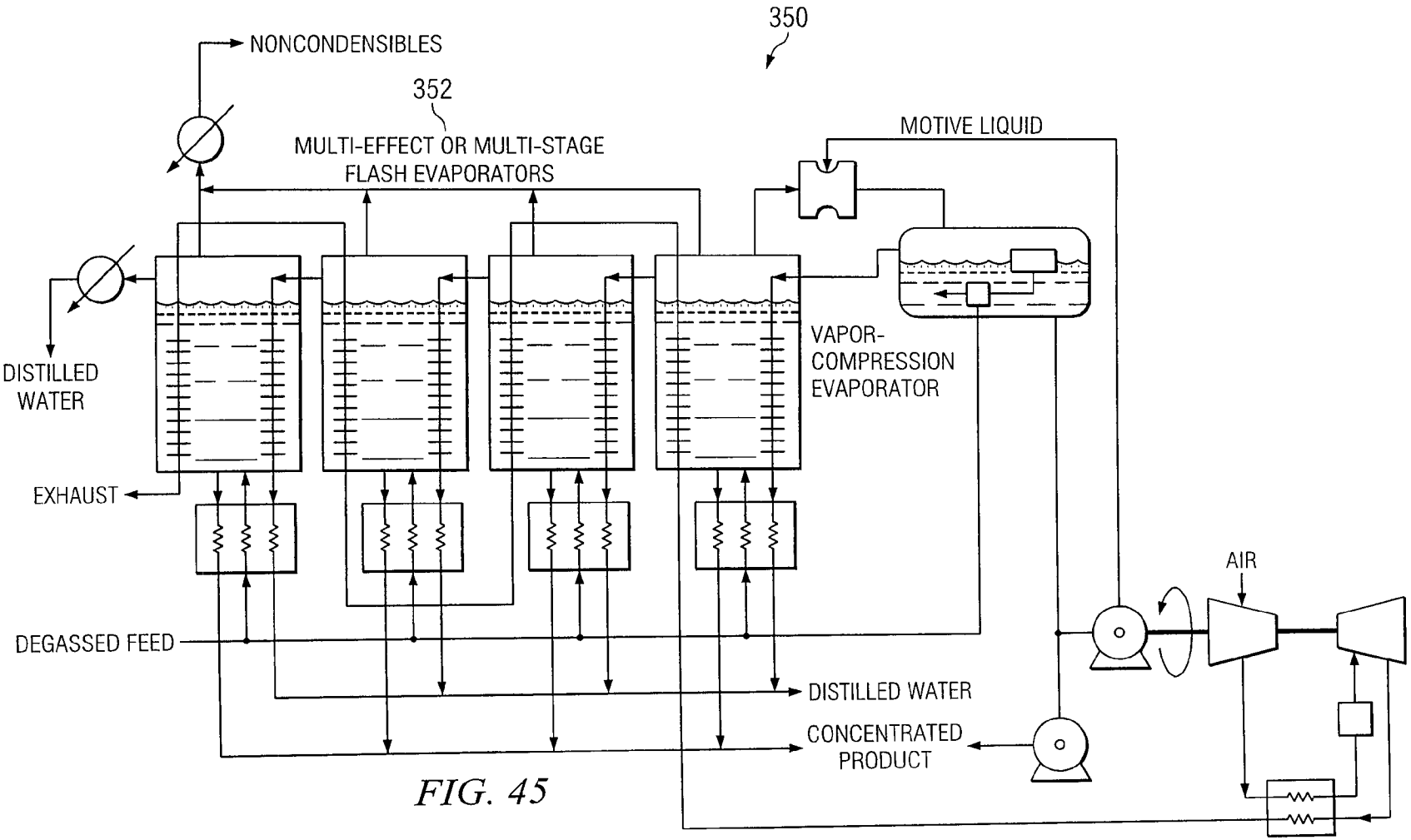

FIG. 45 illustrates an evaporator system 350 according to another embodiment of the invention. System 350 is a combination of system 340 (FIG. 44), but includes a multi-effect evaporator 352, which allows additional evaporation to occur. Only three stages are shown in FIG. 45, but more or fewer are contemplated by the present invention. Alternatively, a multi-stage flash evaporator could be employed rather than a multi-effect evaporator.

Figure 46:
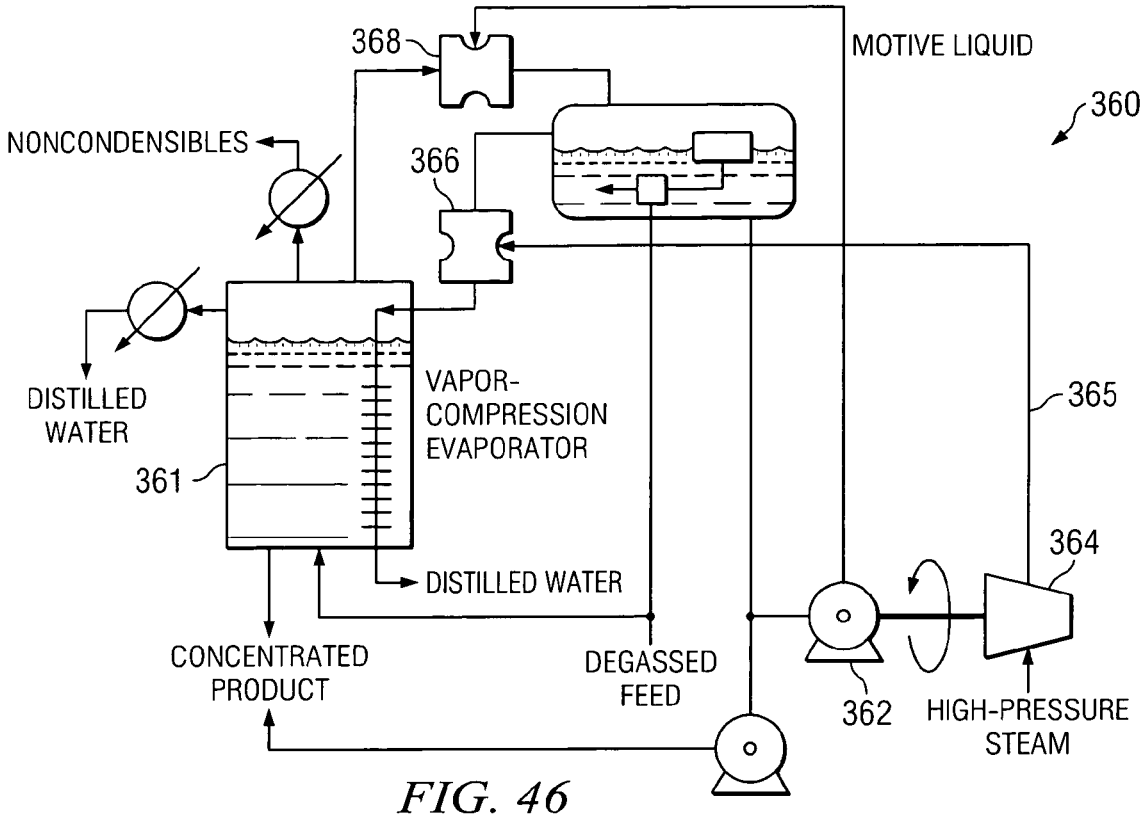

FIG. 46 illustrates an evaporator system 360 according to another embodiment of the invention. System 360 is similar to system 300 (FIG. 42), except that a pump 362 is driven by a steam turbine 364. Steam turbine may be a portion of a Rankine cycle. In this embodiment, the low-pressure steam 365 is sent to a steam jet ejector 366, such as those described above. Although FIG. 46 illustrates a single steam jet ejector 365, system 360 may have multiple stages or it may have a cascade steam jet ejector system, such as those described above. Steam jet ejector 366 is in series with a liquid jet ejector 368. In some embodiments, energy that is added to vessel 361 can cascade through a multi-effect evaporator, which allows additional evaporation to occur, similar to system 330 above.

Figure 47:
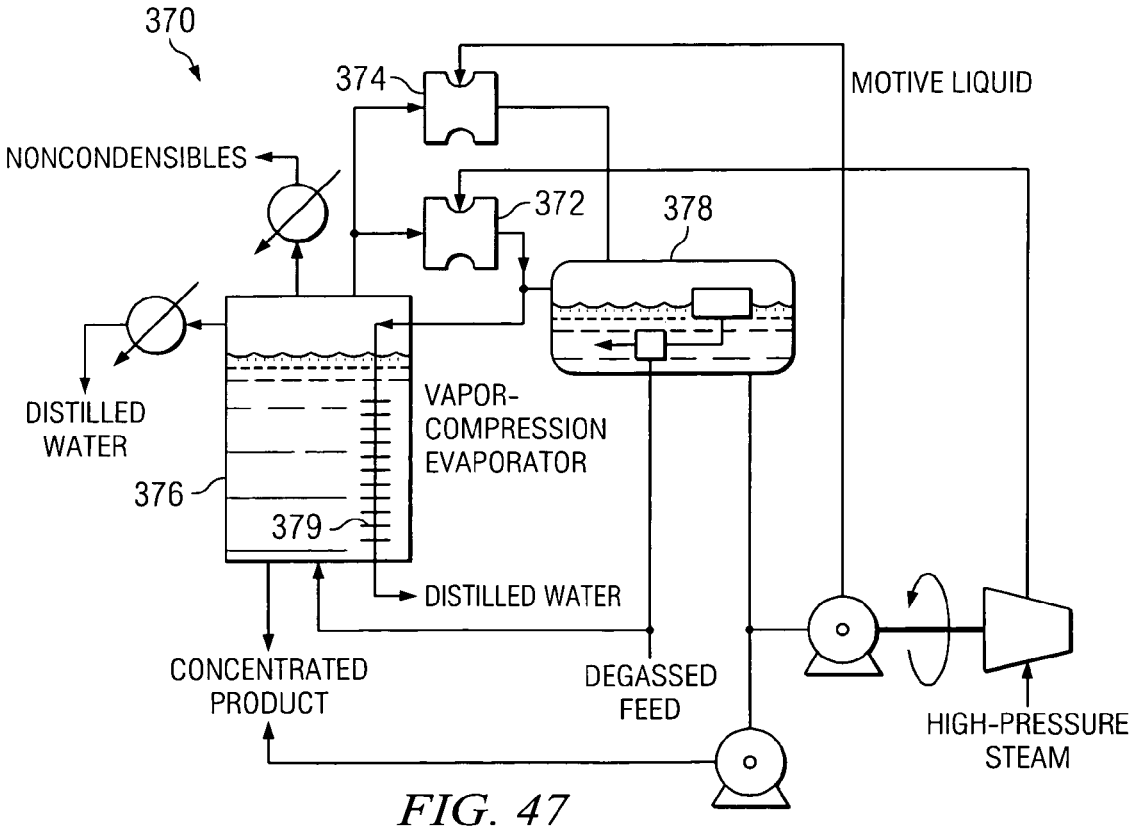

FIG. 47 illustrates an evaporator system 370 according to another embodiment of the invention. System 370 is similar to system 360 (FIG. 46), except that the steam jet ejector 372 is in parallel with the liquid jet ejector 374. As such, steam jet ejector 372 also receives vapor from vessel 376 and compresses it before adding it to the vapor exiting a knock-out tank 378, which then is sent to a heat exchanger 379 in vessel 376. In some embodiments, energy that is added to vessel 376 can cascade through a multi-effect evaporator, which allows additional evaporation to occur, similar to system 330 above.

Figure 48:
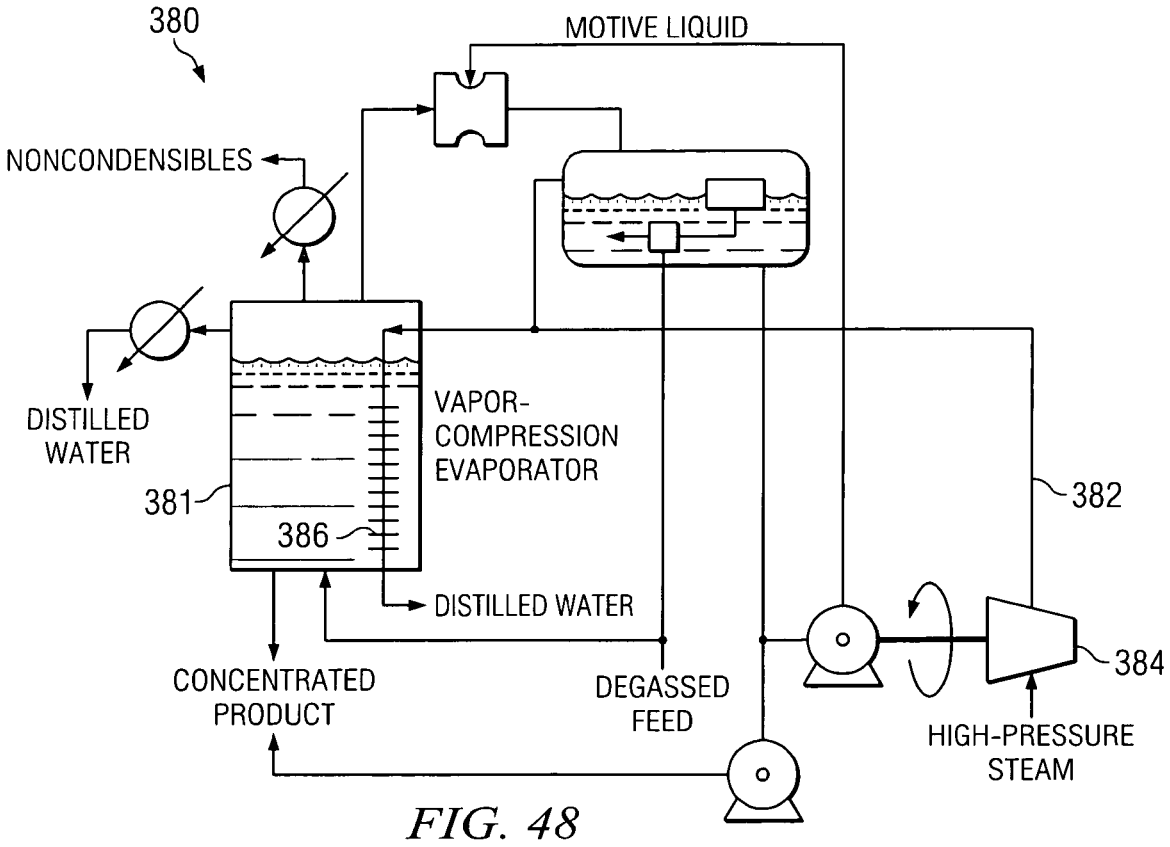

FIG. 48 illustrates an evaporator system 380 according to another embodiment of the invention. System 380 is similar to systems 360 and 370, except that the waste low-pressure steam 382 from a turbine 384 is sent directly to the primary heat exchanger 386. In some embodiments, energy that is added to vessel 381 can cascade through a multi-effect evaporator, which allows additional evaporation to occur, similar to system 330 above.

Figure 49:
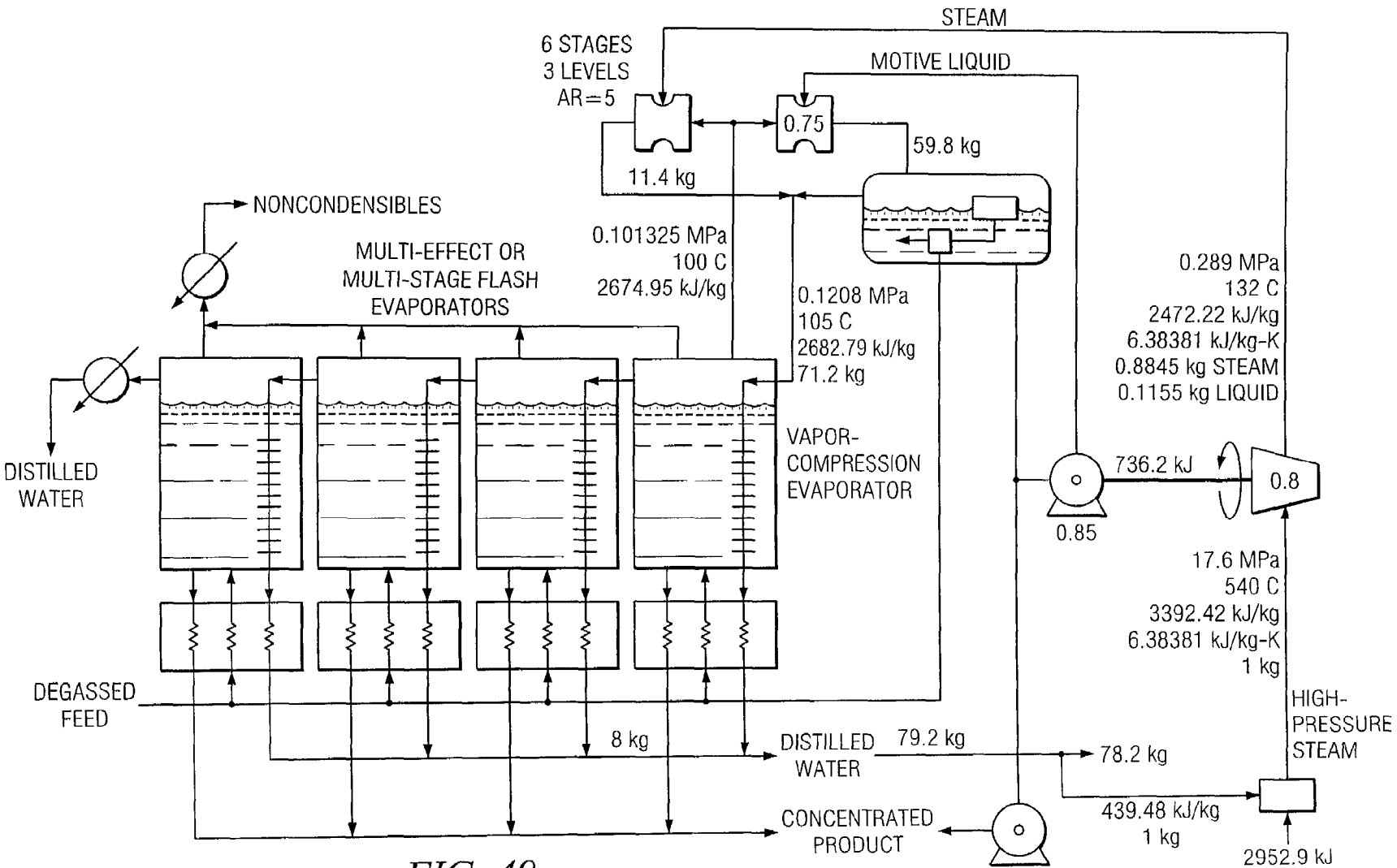

FIG. 49 illustrates an analysis of system 330 using the pump drive mechanism described in system 370. This analysis illustrates that 1 kg of high-pressure steam fed to the turbine produces 78.2 kg of distilled water. The assumptions follow:

- Temperature difference in main heat exchanger=5° C.
- Compression ratio=1.2
- Number of multi-effect evaporators=8 (three shown in FIG. 49)
- Steam jet ejector per-stage compression ratio=1.03
- Steam jet ejector number of stages=6
- Steam jet ejector number of cascade levels=3
- Steam jet ejector area ratio=5
- Liquid jet ejector efficiency=0.75
- Pump efficiency=0.85 (appropriate for large industrial pumps)
- Steam turbine efficiency=0.8 (relative to isentropic turbine)

The mass ratios shown for the cascade steam jet ejector are based upon the analysis presented above.

The mass flow through the liquid jet ejector is calculated as follows:

$$\text{Steam Through Liquid Jet Ejector} = \frac{\eta_{pump}\eta_{ejector}W_{shaft}}{\hat{H}_{cond} - \hat{H}_{evap}}$$

where $\hat{H}_{cond}$ is the specific enthalpy of the condensing steam (1.2 atm), $\hat{H}_{evap}$ is the specific enthalpy of the evaporating steam (1.0 atm), $\eta_{pump}$ is the pump efficiency, $\eta_{ejector}$ is the liquid jet ejector efficiency, and $W_{shaft}$ is the shaft work. The shaft work is calculated as follows:

$$W_{shaft}=\eta_{turbine}(\hat{H}_{high}-\hat{H}_{low})m_{steam}$$

where $m_{steam}$ is the mass of high-pressure steam, $\eta_{turbine}$ is the turbine efficiency (compared to isentropic), $\hat{H}_{high}$ is the specific enthalpy of the high-pressure steam from the boiler, and $\hat{H}_{low}$ is the specific enthalpy of the low-pressure steam exiting the turbine. (Note: The conditions at the exit of the turbine correspond to an isentropic expansion.)

Figure 50:
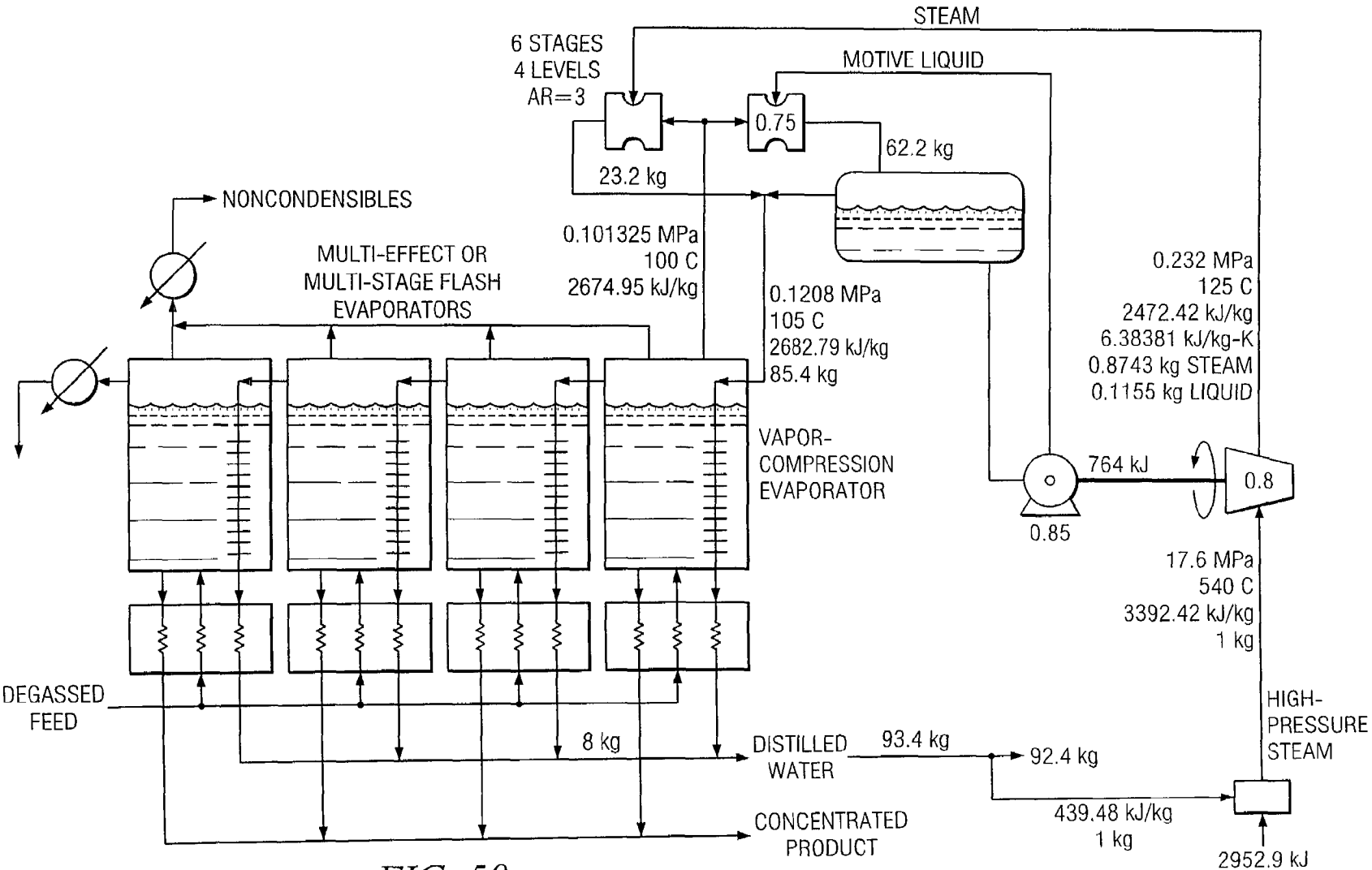

FIG. 50 illustrates an analysis similar to the one shown in FIG. 49. All the assumption are identical, except that the steam jet ejectors use an area ratio of 3, and four cascade levels are employed. In this scenario, 1 kg of high-pressure steam produces 93.4 kg of distilled water.

Figure 51:
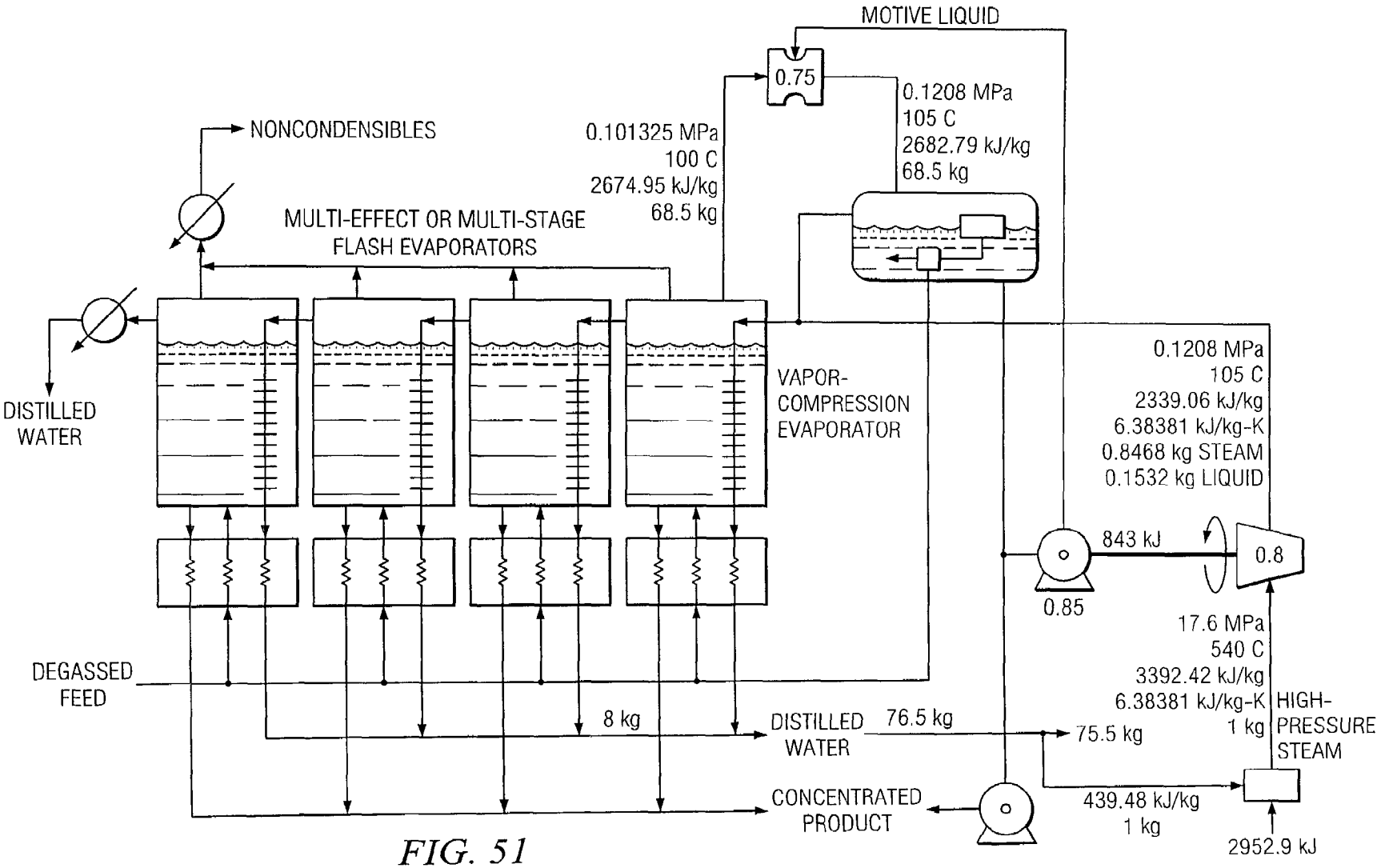

FIG. 51 illustrates an analysis similar to the one shown in FIGS. 49 and 50, except that no steam jet ejector is employed. The waste steam from the turbine is directly sent to the condensing side of the primary heat exchanger. In this case, 1 kg of high-pressure steam produces 75.5 kg of distilled water, which is nearly identical to the case shown in FIG. 49, but not quite as good as the case presented in FIG. 50. This illustrates that there may be a benefit of using the jet ejectors only if they are very efficient (i.e., low area ratio with many stages).

The following table compares various options:

| Option | Energy (kJ/kg distilled water) | Effects* |
|---|---|---|
| Single-effect evaporator (100° C.) | 2,256.58 | 1 |
| FIG. 51 | 39.11 | 57.7 |
| FIG. 49 | 37.80 | 59.7 |
| FIG. 50 | 31.96 | 70.6 |
| FIG. 44 (engine efficiency = 30%) | 40.99 | 55.1 |
| FIG. 44 (engine efficiency = 40%) | 30.75 | 73.4 |
| FIG. 44 (engine efficiency = 50%) | 24.60 | 91.7 |
| FIG. 44 (engine efficiency = 60%) | 20.50 | 110.1 |
| FIG. 45 (engine efficiency = 30%, 8 stages) | 37.29 | 60.5 |
| FIG. 45 (engine efficiency = 40%, 8 stages) | 28.44 | 79.4 |
| FIG. 45 (engine efficiency = 50%, 8 stages) | 23.01 | 98.1 |
| FIG. 45 (engine efficiency = 60%, 8 stages) | 19.32 | 116.8 |

*Effect = Energy of single-effect evapor/Energy of the option

This table illustrates that a simple liquid jet ejector combined with a high-efficiency engine (FIGS. 44 and 45) may be the most attractive option. However, high-efficiency engines often require premium fuels, which can be expensive. The steam-turbine systems (FIG. 46 through 48) may use low-cost fuels (e.g., coal), and may be the most economical system in some situations.

An advantage is it uses a high-efficiency liquid jet ejector in a cost-effective dewatering system. When combined with steam jet ejectors and multi-effect evaporators, any energy inefficiencies of the liquid jet system (liquid jet itself, pump, turbine) produce heat that usefully distills liquid. This liquid jet ejector may be used in water-based air conditioning.

FIGS. 52 through 55 illustrate various embodiments of an improved design of a vapor-compression evaporator system. Some important features of the improved designs are (1) compressor equipment may be smaller due to lower vapor throughput, and (2) the systems may be tuned to the operating regions where the compressors are most efficient.

Figure 52:
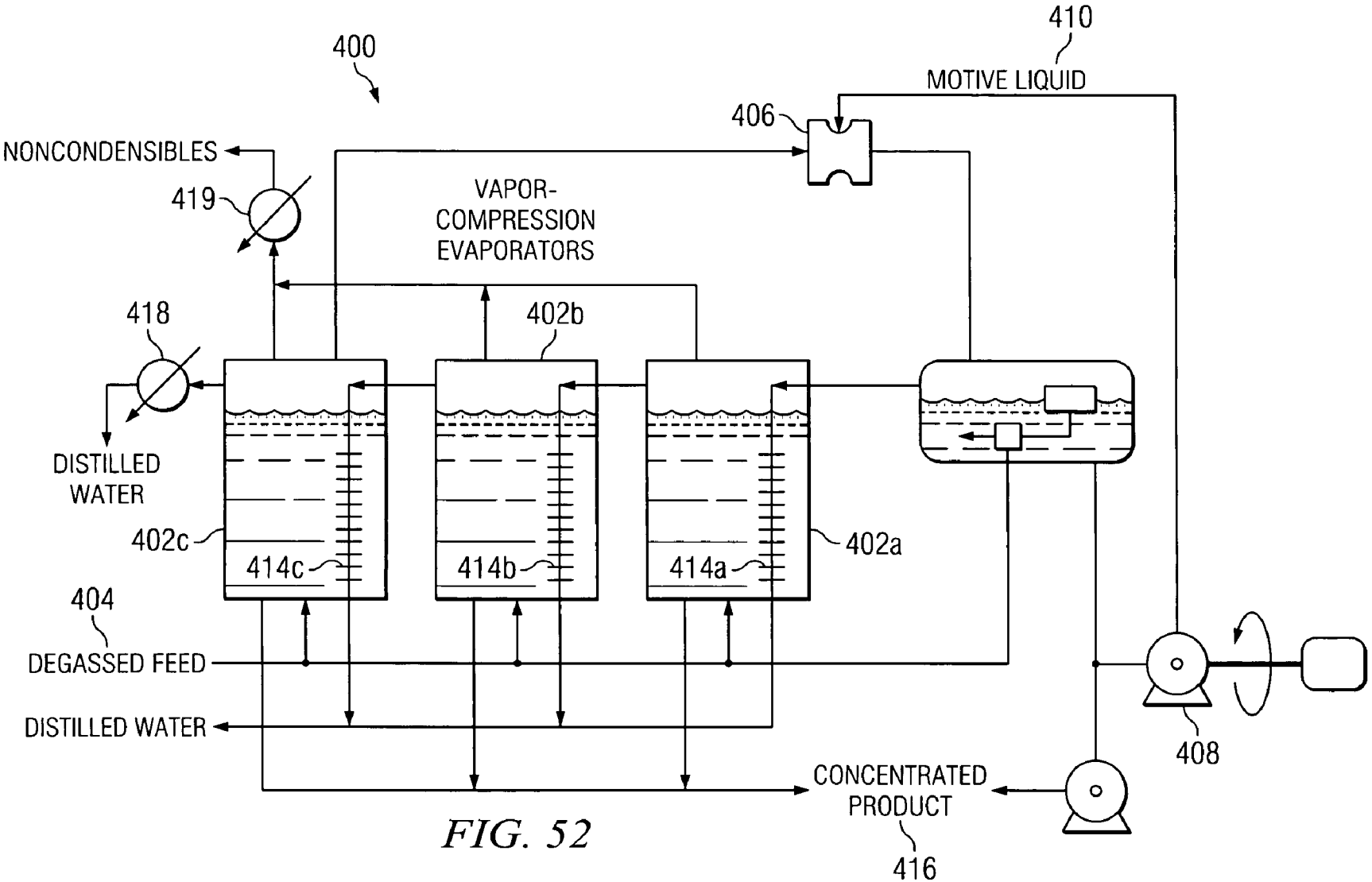
FIGS. 52 through 55 illustrate various embodiments of a vapor-compression evaporator system according to various embodiments of the invention.

FIG. 52 illustrates a vapor-compression evaporator system 400 according to one embodiment of the invention. In the illustrated embodiment, system 400 includes a plurality of vessels 402*a-c* in series to form a multi-effect evaporator system. Each vessel contains a feed 404 having a nonvolatile component (e.g., salt, sugar). The feed 404 may first be degassed by pulling a vacuum on it (equipment not explicitly shown). A liquid jet ejector 406 is coupled to the last vessel in the series (402*c*) and is operable to receive a vapor therefrom. An example of liquid jet ejector 406 is one marketed by Hijet from Houston, Tex. A pump 408 is operable to deliver a motive liquid 410 to the liquid jet ejector 406 for compressing the vapors pulled from the coldest evaporator stage, vessel 402*c*. A knock-out tank 412 is coupled to liquid jet ejector 406 and is operable to separate liquid and vapor received from liquid jet ejector 406. A plurality of heat exchangers 414*a-c* are coupled inside respective vessels 402*a-c*. Heat exchanger 414*a* is operable to receive the vapor from knock-out tank 412, at least some of the vapor condensing therein, whereby the heat of condensation provides the heat of evaporation to vessel 402*a*. At least some of the vapor inside vessel 402*a* is delivered to heat exchanger 414*b*, whereby the condensing, evaporating, and delivering steps continue until the last vessel in the series is reached (in this embodiment, vessel 402*c*).

In FIG. 52, only three stages are shown (i.e., three vessels 402); however, more or fewer could be used. Concentrated product 416 may be removed from each of the vessels 402. Energy that is added to system 400 may be removed using a suitable condenser 418. Alternatively, if condenser 418 were eliminated, the energy added to system 400 will increase the temperature of concentrated product 416. This is acceptable if the product is not temperature sensitive. To remove noncondensibles from system 400, a small stream is pulled from each vessel 402 and passed through a suitable condenser 419 and is sent to a vacuum pump (not shown).

In system 400, motive liquid 410 may be a nonvolatile, immiscible, nontoxic, low-viscosity liquid (e.g., silicone oil) or it may be water. If it is water, the water will be in near equilibrium with the vapors discharged from jet ejector 406. When this water is pumped, it may easily cavitate in pump 408. In one embodiment, to overcome this problem, knock-out tank 412 is elevated relative to pump 408 so there is no cavitation. Ideally, if the system were perfect, the liquid water could be recycled indefinitely. However, in reality, energy is input into the circulating water (e.g., pump losses, pipe friction). This energy input causes the circulating water to evaporate, so make-up water should be added. In one embodiment, the make-up water is feed water, which has the following benefits: (1) the nonvolatile components increase the fluid density, which improves the efficiency of the jet ejector and (2) the waste thermal energy generated within the circulating fluid causes water to evaporate, which forms more product.

Figure 53:
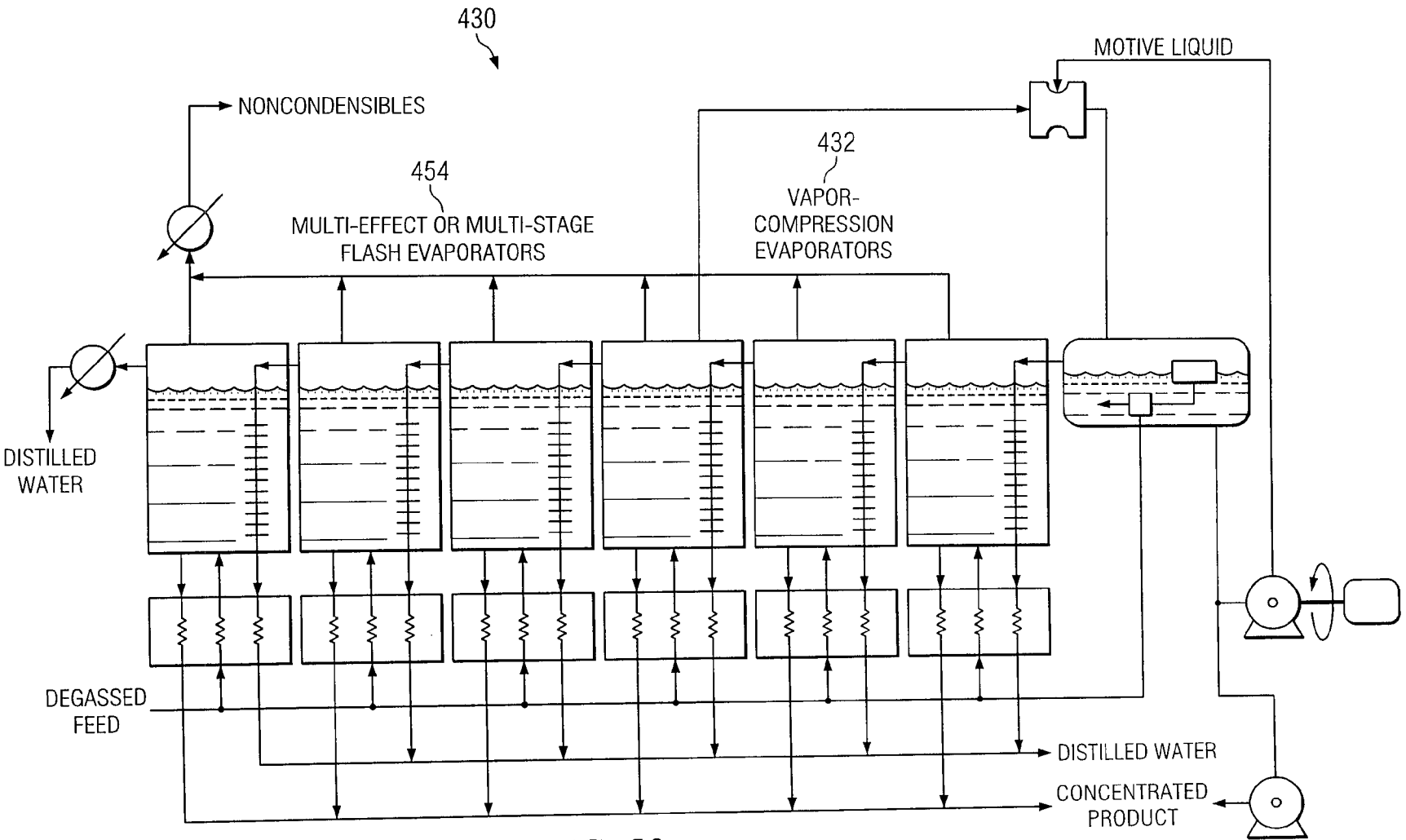

FIG. 53 illustrates a vapor-compression evaporator system 430 according to another embodiment of the invention. System 430 is similar to system 400 above, except that the vapor-compression evaporator vessels 432 are operated at a higher temperature and pressure than in system 400. In system 430, energy that is added to the vapor-compression evaporator vessels 432 may cascade through a multi-effect evaporator 434 (three stages shown), which allows additional evaporation to occur. Alternatively, a multi-stage flash evaporator may be employed rather than a multi-effect evaporator. In system 430, noncondensibles may be removed in a manner similar to system 400.

Figure 54:
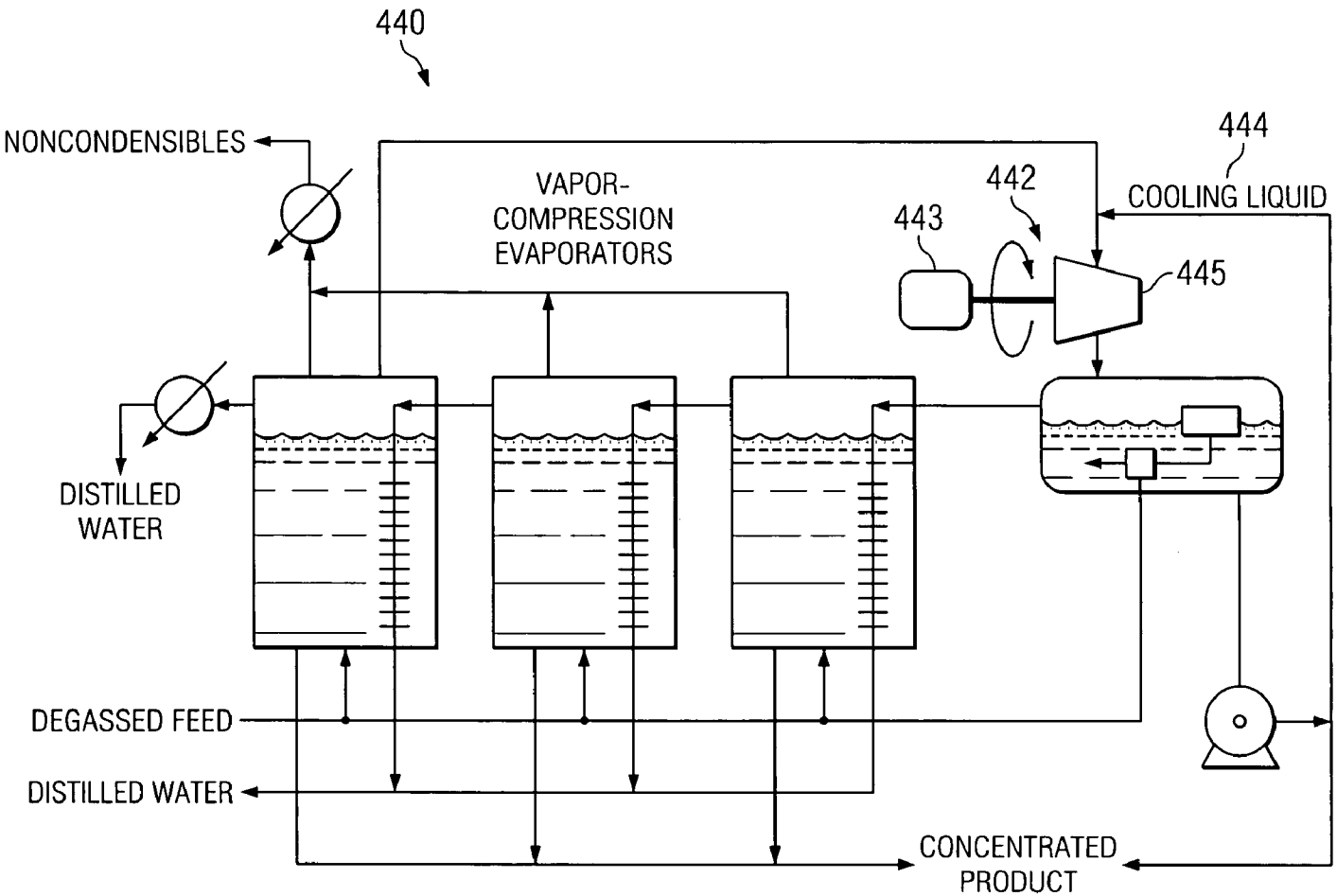

FIG. 54 illustrates a vapor-compression evaporator system 440 according to another embodiment of the invention. System 440 is similar to system 400 above, except that the vapors are compressed using a mechanical compressor 442 driven by a suitable electric motor 443. To reduce the superheat in compressor 445, and thereby increase its efficiency, atomized liquid water 444 is added to compressor 445. Preferably, the liquid water is feed water; as water evaporates from the feed water as it removes the heat of compression, it creates more distilled water and a concentrated product. Alternatively, if the compressor materials do not tolerate the nonvolatile components (e.g., salt) in the circulating cooling liquid 444, then the cooling liquid 445 could be distilled water.

Figure 55:
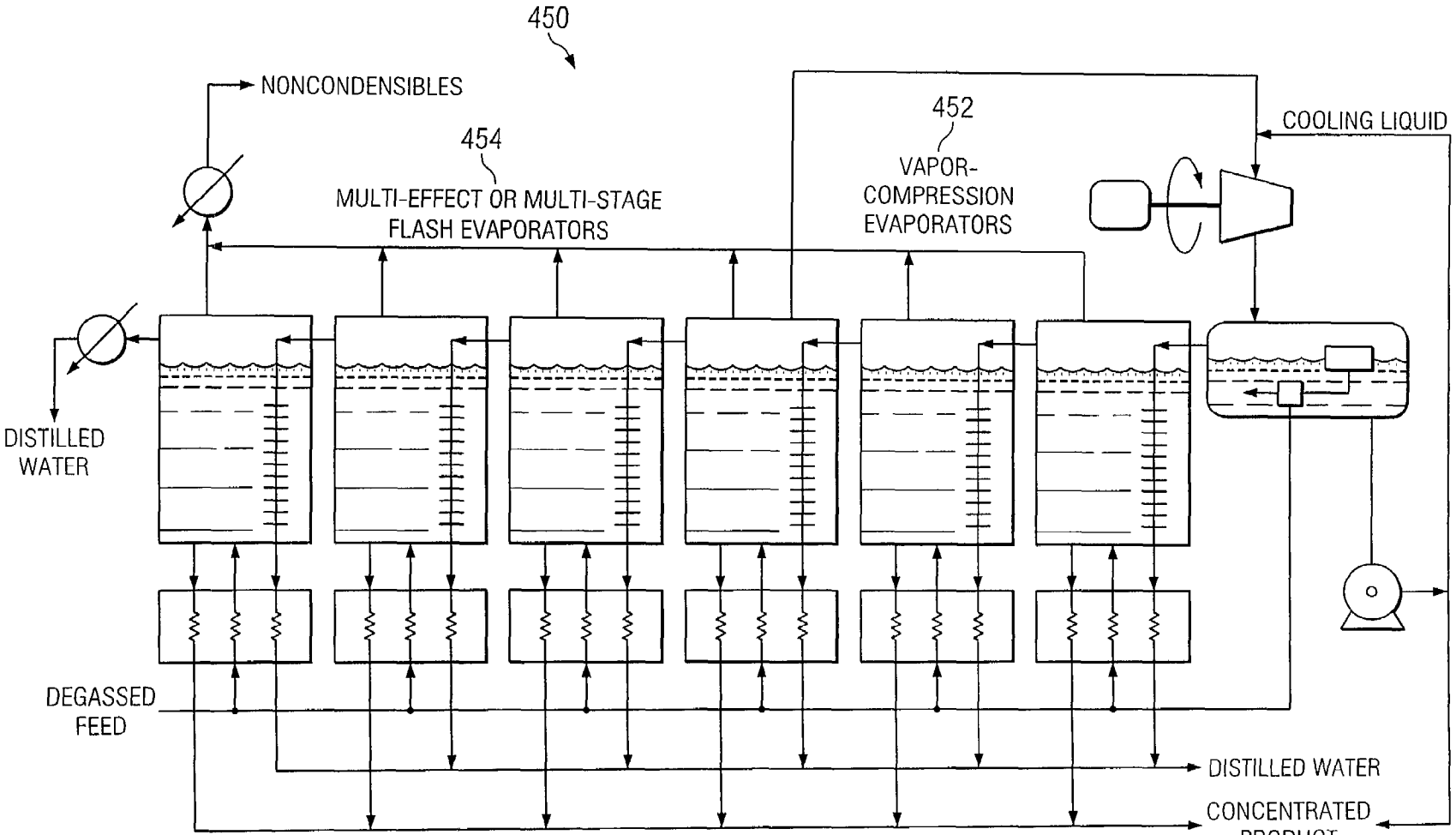

FIG. 55 illustrates a vapor-compression evaporator system 450 according to another embodiment of the invention. System 450 is similar to systems 440 except that energy that is added to vapor-compression evaporators 452 may cascade through a multi-effect evaporator 454, which allows additional evaporation to occur, similar to system 430 above.

Thus, advantages of the vapor-compression evaporator systems of FIGS. 52 through 55 are 1) because the vapor flow through the compressors is smaller, the compressors may be smaller than the compressors described in the evaporator systems above; and 2) the compression ratio may be adjusted so the compressor operates in its most efficient range. This is particularly important for a liquid jet ejector, which has lower efficiency at lower compression ratios.

Referring now to FIGS. 56 through 61, in general, a heat exchanger is provided that includes a shell and a sheet assembly disposed within the shell. The sheet assembly may include a number of substantially parallel rectangular sheets configured such that they define first passageways extending generally in a first direction and second passageways extending generally in a second direction perpendicular to the first direction. The sheet assembly may be configured such that communicating a first fluid through the first passageways and communicating a second fluid through the second passageways causes heat transfer between the first and second fluids. For example, the first fluid may comprise high pressure steam and the second fluid may comprise a liquid solution (such as saltwater, seawater, concentrated fermentation broth, or concentrated brine, for example) such that communicating the high-pressure steam and the liquid solution through the first and second passageways, respectively, causes at least a portion of the high-pressure steam to condense and at least a portion of liquid solution to boil off.

Figure 56:
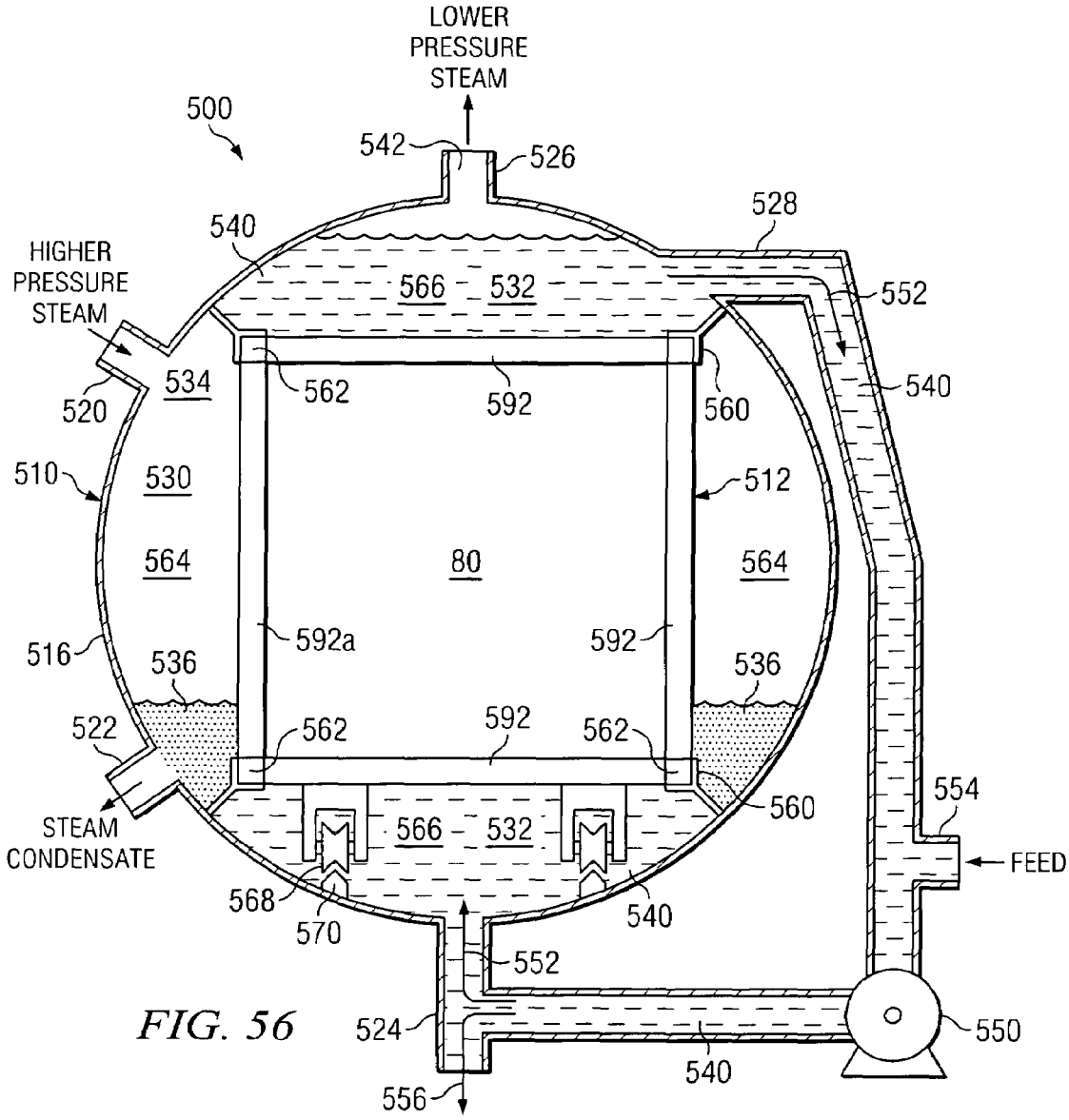
FIG. 56 illustrates a cross-section of an example heat exchanger assembly including a shell and a sheet assembly disposed within the shell in accordance with an embodiment of the invention.

FIG. 56 illustrates a cross-section of an example heat exchanger assembly 500 including a shell 510 and a sheet assembly 512 disposed within shell 510 in accordance with an embodiment of the invention. Shell 510 may comprise any suitable shape and may be formed from any suitable material for housing pressurized gasses and/or liquids. For example, in the embodiment shown in FIG. 56, shell 510 comprises a substantially cylindrical portion 516 and a pair of hemispherical caps (not expressly shown) coupled to each end of cylindrical portion 516. The cross-section shown in FIG. 56 is taken at a particular point along the length of cylindrical portion 516, which length extends in a direction perpendicular to the page.

In general, heat exchanger assembly 500 is configured to allow at least two fluids to be communicated into shell 510, through passageways defined by sheet assembly 512 (such passageways are illustrated and discussed below with reference to FIG. 57A) such that heat is transferred between the at least two fluids, and out of shell 510. Shell 510 may include any number of inlets and outlets for communicating fluids into and out of shell 510. In the embodiment shown in FIG. 56, shell 510 includes a first inlet 520, a first outlet 522, a second inlet 524, a second outlet 526 and a third outlet 528. First inlet 520 and first outlet 522 are configured to communicate a first fluid 530 into and out of shell 510. Second inlet 524, second outlet 526, and third outlet 528 are configured to communicate a second fluid 532 into and out of shell 510.

Due to the transfer of heat between first fluid 530 and second fluid 532, at least a portion of first fluid 530 and/or second fluid 532 may change state within shell 510 and thus exit shell 510 in a different state than such fluids 530 and/or 532 entered shell 510. For example, in a particular embodiment, relatively high-pressure steam 534 enters shell 510 through first inlet 520, enters one or more first passageways within sheet assembly 512, becomes cooled by a liquid 540 flowing through one or more second passageways adjacent to the one or more first passageways within sheet assembly 512, which causes at least a portion of the steam 534 to condense to form steam condensate 536. The steam condensate 536 flows toward and through first outlet 522. Concurrently, liquid 540 (saltwater, seawater, concentrated fermentation broth, or concentrated brine, for example) enters shell 510 through second inlet 524, enters one or more second passageways within sheet assembly 512, becomes heated by steam 534 flowing through the one or more first passageways adjacent to the one or more second passageways within sheet assembly 512, which causes at least a portion of the liquid 540 to boil to form relatively low pressure steam 542. The low pressure steam 542 escapes from shell 510 through second outlet 526, while the unboiled remainder of liquid 540 flows toward and through third outlet 528.

In some embodiments, heat exchanger assembly 500 includes one or more pumps 550 operable to pump liquid 540 that has exited shell 510 through third outlet 528 back into shell 510 through second inlet 524, as indicated by arrows 552. Pump 550 may comprise any suitable device or devices for pumping a fluid through one or more fluid passageways. As shown in FIG. 56, liquid 540 may be supplied to the circuit through a feed input 554. In embodiments in which liquid 540 comprises a solution (such as a seawater solution, for example), a relatively dilute form of such solution (as compared with the solution exiting shell 510 through third output 528) may be supplied through feed input 554. In addition, a portion of liquid 540 being pumped toward second inlet 524 of shell 510 may be redirected away from shell 510, as indicated by arrow 556. In embodiments in which liquid 540 comprises a solution (such as a seawater solution, for example), such redirected liquid 540 may comprise a relatively concentrated form of such solution (as compared with the diluted solution supplied through feed input 554). Although inlets 520, 524 and outlets 522, 526 and 528 are described herein as single inlets and outlets, each inlet 520, 524 and each outlet 522, 526 and 528 may actually include any suitable number of inlets or outlets.

Heat exchanger assembly 500 may also include a plurality of mounting devices 560 coupled to shell 510 and operable to mount sheet assembly 512 within shell 510. Each mounting device 560 may be associated with a particular corner of sheet assembly 512. Each mounting device 560 may be coupled to shell 510 in any suitable manner, such as by welding or using fasteners, for example. In the embodiment shown in FIG. 56, each mounting device 560 comprises a Y-shaped bracket into which a corner of sheet assembly 512 is mounted. Each mounting device 560 may extend along the length of shell 510, or at least along the length of a portion of shell 510 in which fluids 530 and 532 are communicated, in order to create two volumes within shell 510 that are separated from each other. A first volume 564, which includes regions generally to the left and right of sheet assembly 510, as well as one or more first passageways defined by sheet assembly 510 (such first passageways are illustrated and discussed below with reference to FIG. 57A), is used to communicate first fluid 530 through heat exchanger assembly 500. A second volume 566, which includes regions generally above and below sheet assembly 510, as well as one or more second passageways defined by sheet assembly 510 (such second passageways are illustrated and discussed below with reference to FIG. 57A), is used to communicate second fluid 532 through heat exchanger assembly 500.

Since first volume 564 is separated from second volume 566 by the configuration of sheet assembly 512 and mounting devices 560, first fluid 530 is kept separate from second fluid 532 within shell 510. In addition, one or more gaskets 562 may be disposed between each Y-shaped bracket 560 and its corresponding corner of sheet assembly 512 to provide a seal between first volume 564 and second volume 566 at each corner of sheet assembly 512. Gaskets 562 may comprise any suitable type of seal or gasket, may have any suitable shape (such as having a square, rectangular or round cross-section, for example) and may be formed from any material suitable for forming a seal or gasket.

Heat exchanger assembly 500 may also include one or more devices for sliding, rolling, or otherwise positioning sheet assembly 512 within shell 510. Such devices may be particularly useful in embodiments in which sheet assembly 512 is relatively heavy or massive, such as where sheet assembly 512 is formed from metal. In the embodiment shown in FIG. 56, heat exchanger assembly 500 includes wheels 568 coupled to sheet assembly 512 that may be used to roll sheet assembly 512 into shell. Wheels 568 may be aligned with, and roll on, wheel tracks 570 coupled to shell 510 in any suitable manner.

Figure 57A:
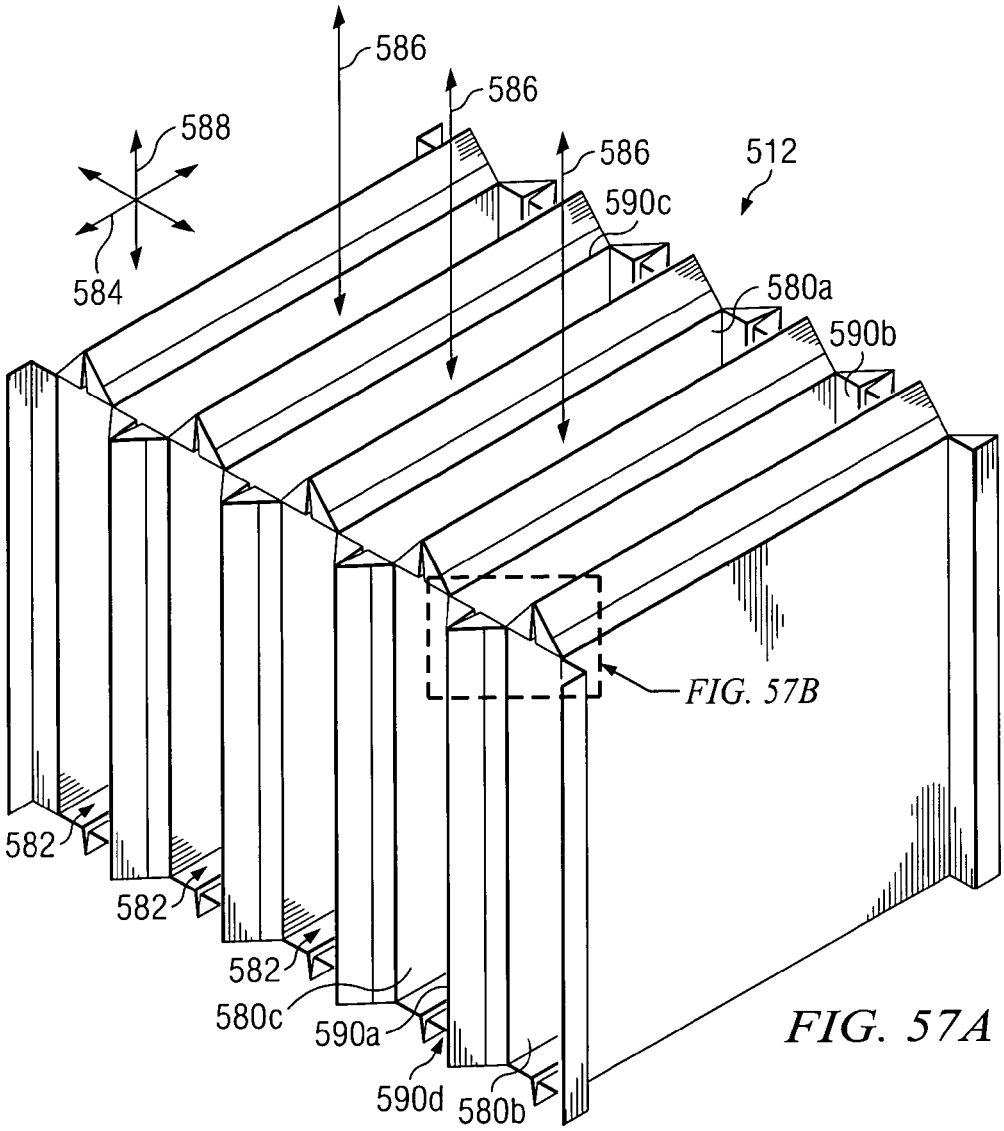
FIG. 57A illustrates a three-dimensional view of the sheet assembly of the heat exchanger assembly of FIG. 56 in accordance with one embodiment of the invention.

FIG. 57A illustrates a three-dimensional view of sheet assembly 512 of heat exchanger assembly 500 in accordance with one embodiment of the invention. Sheet assembly 512 includes a plurality of sheets 580 configured and coupled to each other to form a plurality of first passageways 582 extending in a first direction 584 alternating with a plurality of second passageways 586 extending in a second direction 588 perpendicular to the first direction 584. Each passageway 582 and 586 is substantially defined by an adjacent pair of sheets 580. In this embodiment, sheets 580 are aligned substantially parallel and, when positioned within shell 510, the major surface of each sheet 580 extends in a plane substantially perpendicular to the direction of the length of cylindrical portion 516 of shell 510.

As discussed above with reference to FIG. 56, first passageways 582 form a portion of first volume 564 and are thus used to communicate first fluid 530, while second passageways 586 form a portion of second volume 566 and are thus used to communicate second fluid 532. As fluids 530 and 532 pass through alternating first passageways 582 and second passageways 586, respectively, heat is transferred from the higher temperature fluid 530 or 532 to sheets 580, and then from sheets 580 to the lower temperature fluid 530 or 532. In this manner, heat is transferred between fluids 530 and 532 via sheets 580.

In the embodiments shown in FIG. 57A, each sheet 580 has a substantially square shape having four edges 590. In other embodiments, sheets 580 may comprise any suitable shape and configuration. For example, sheets 580 may have a generally rectangular, hexagonal, circular, or other geometric shape. In order to define alternating passageways 582 and 586, each sheet 580 is coupled to an adjacent sheet 580 on one side at two of the four edges 590 and to an adjacent sheet 580 on the other side at the other two of the four edges 590. For example, sheet 580*a*, which is positioned between adjacent sheet 580*b* and adjacent sheet 580*c*, is coupled to adjacent sheet 580*b* at opposite edges 590*a* and 590*b* of sheet 580*a*, and is coupled to adjacent sheet 580*c* at opposite edges 590*c* and 590*d* of sheet 580*a*.

Figure 57B:
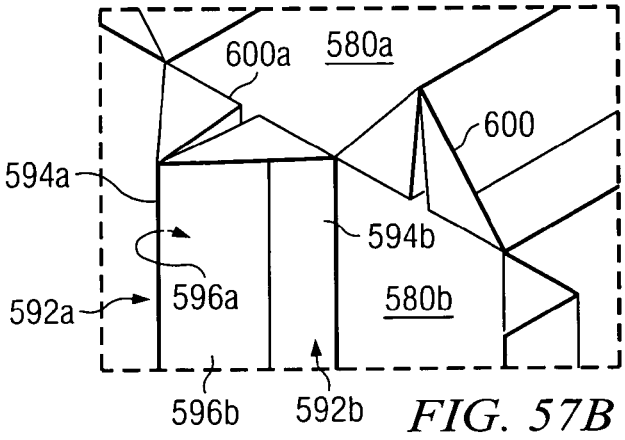
FIG. 57B is a blown-up view of a corner area of the sheet assembly of FIG. 57A in accordance with an embodiment of the invention.

Sheets 580 may be coupled to each other at edges 590 in any suitable manner, as discussed in greater detail below with reference to FIG. 59. In the embodiment shown in FIG. 57A, each sheet 580 is folded near each edge 590 to form flanges 592 at each edge 590 which are then coupled to corresponding flanges 592 of adjacent sheets 580. FIG. 57B is a blown-up view of a corner area of sheet assembly 512, illustrating flanges 592 of adjacent sheets 580 being coupled to each other in accordance with an embodiment of the invention. As shown in FIG. 57B, sheet 580*a* is folded twice at approximately 90 degree angles to form a flange 592*a* including a first flange portion 594*a* and a second flange portion 596*a*. First flange portion 594*a* forms an approximately 90 degree angle with the major portion of sheet 580*a*, indicated as 598*a*, and second flange portion 596*a* forms an approximately 90 degree angle with first flange portion 594*a*. Thus, the surface of second flange portion 596*a* is approximately parallel with the surface of major portion 598*a* of sheet 580*a*. A triangular flap 600*a* is folded from first flange portion 594*a* and may be affixed to second flange portion 596*a* (such as by welding, for example). Similarly, sheet 580*b* is folded twice at approximately 90 degree angles to form a flange 592*b* including a first flange portion 594*b* and a second flange portion 596*b*. First flange portion 594*b* forms an approximately 90 degree angle with the major portion of sheet 580*b*, indicated as 598*b*, and second flange portion 596*b* forms an approximately 90 degree angle with first flange portion 594*b*. Thus, the surface of second flange portion 596*b* is approximately parallel with the surface of major portion 598*b* of sheet 580*b*. A triangular flap 600*b* is folded from first flange portion 594*b* and may be affixed to second flange portion 596*b* (such as by welding, for example).

Figure 57C:
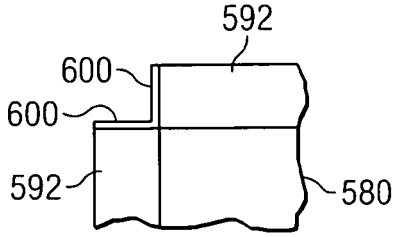
FIG. 57C illustrates a side view of the corner of sheet assembly illustrated in FIG. 57B.

FIG. 57C illustrates a side view of the corner of sheet assembly 512 illustrated in FIG. 57B.

Figure 58A:
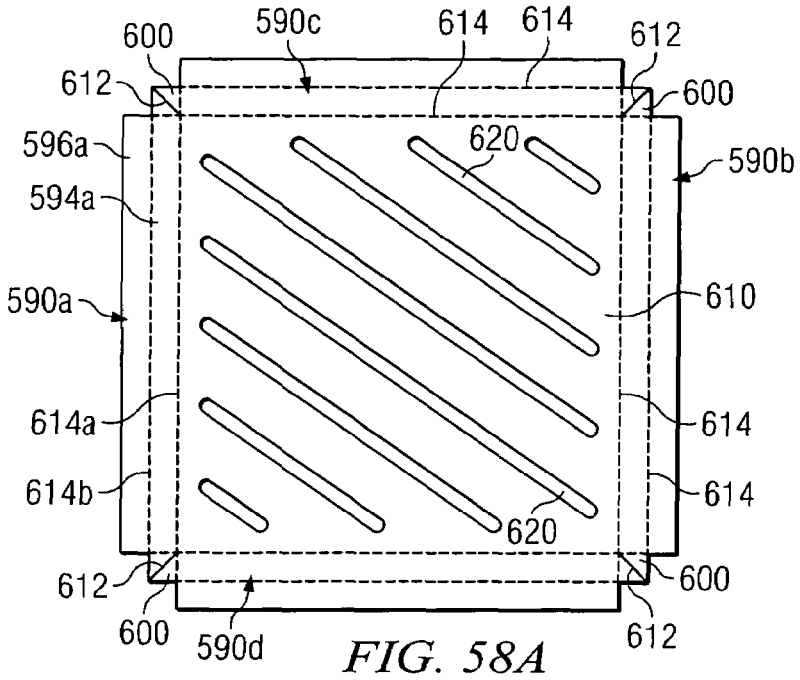
FIGS. 58A-58D illustrate an example method of forming a particular sheet of the sheet assembly shown in FIG. 57A in accordance with one embodiment of the invention.
Figure 58B:
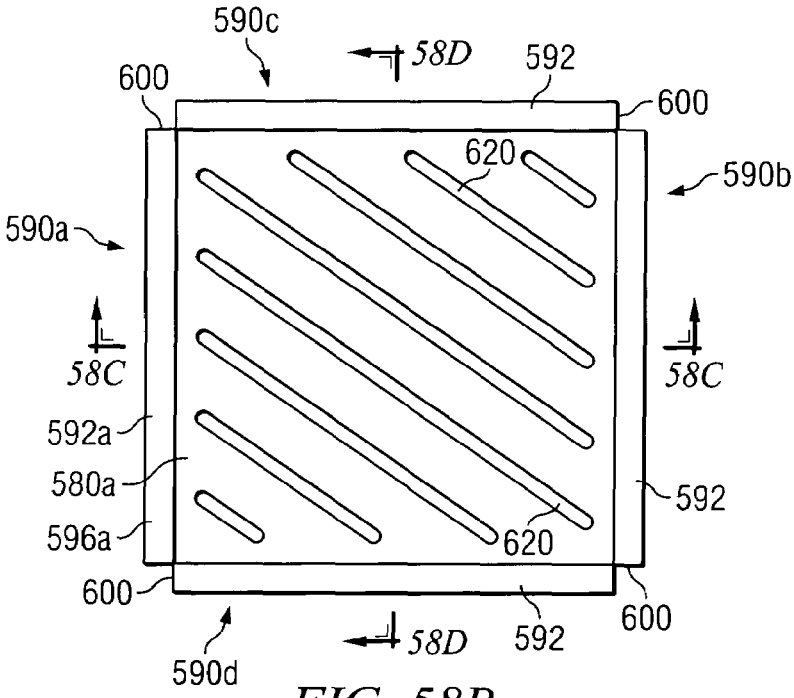

FIGS. 58A-58B illustrate an example method of forming a particular sheet 580*a*, including flanges 592, of sheet assembly 512 in accordance with one embodiment of the invention. FIG. 58A illustrates a generally flat sheet 610 of material, such as sheet metal or one or more polymers, for example. The sheet 610 has a generally square shape including one or more notches removed from each corner. Cuts 612 are formed in each corner at approximately 45 degrees relative to the edges 590 of sheet 610 in order to form triangular flaps 600 in the resulting sheet 580*a*. From sheet 610 formed as shown in FIG. 58A, flanges 592*a* are formed by folding sheet 610 at each fold line 614 (indicated in FIG. 58A by dashed lines) at approximately 90 degree angles. For example, flange 592*a* may be formed by (a) folding the edge portion 590*a* of sheet 610 approximately 90 degree inward (out of the page and toward the center of sheet 610) at fold line 614*a* to form first flange portion 594*a*, and (b) folding the remaining edge portion 590*a* of sheet 610 approximately 90 degree outward (to the left and down toward the page) at fold line 614*b* to form second flange portion 596*a*. Thus, the resulting flange 592*a* extends generally out of the page. The flange 592 at opposing edge 590*b* may be formed in the same manner as flange 592*a*. The flanges 592 at edges 590*c* and 590*d* may be formed in a similar, but opposite, manner such that the flanges 592 at edges 590*c* and 590*d* extend generally into the page. Triangular flaps 600 may then be folded down and connected (such as by welding) to second flange portions 596 to reinforce each flange 592. For example, triangular flap 600*a* may be folded down and welded to second flange portion 596*a* to reinforce flange 592*a*.

FIG. 58B illustrates the resulting sheet 580*a*, including flanges 592 at each edge 590*a*-590*d* of sheet 580*a*. Flanges 592 at edges 590*a* and 590*b* of sheet 580*a* extend in a first direction (out of the page), such that they may be coupled to flanges 592 of adjacent sheet 580*b*, while flanges 592 at edges 590*c* and 590*d* of sheet 580*a* extend in the opposite direction (into the page), such that they may be coupled to flanges 592 of adjacent sheet 580*c*.

Sheets 580 may also include one or more protrusions for preventing passageways 582 or 586 between adjacent sheets 580 from being cut off, such as due to the distortion of sheets 580 during operation of heat exchanger apparatus 500 (such as due to the presence of high-pressure fluids, for example) and/or to provide additional strength or stiffening to sheets 580. In the embodiment shown in FIGS. 58A-58B, sheet 580*a* includes a plurality of stiffening ribs, or corrugations, 620 which strengthen sheet 580*a*, as well as ensure that the second passageway 586 between sheets 580*a* and 580*b* remains intact during the operation of heat exchanger apparatus 500. Sheet 580*b* may also include a plurality of stiffening ribs (not expressly shown) operable to engage stiffening ribs 620 of sheet 580*a*. In a particular embodiment, such stiffening ribs of sheet 580*b* are oriented in a direction perpendicular to that of stiffening ribs 620 of sheet 580*a*.

Figure 58D:
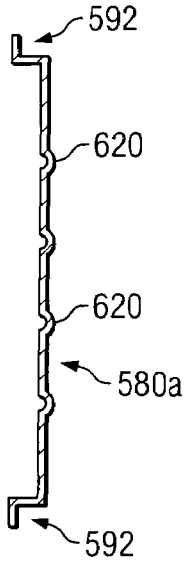
Figure 58C:
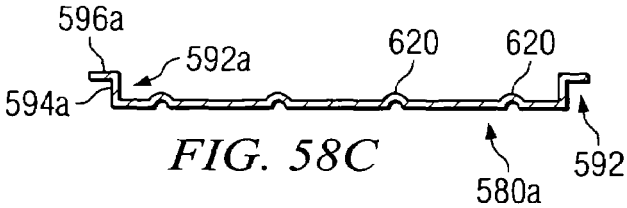
Figure 59A:
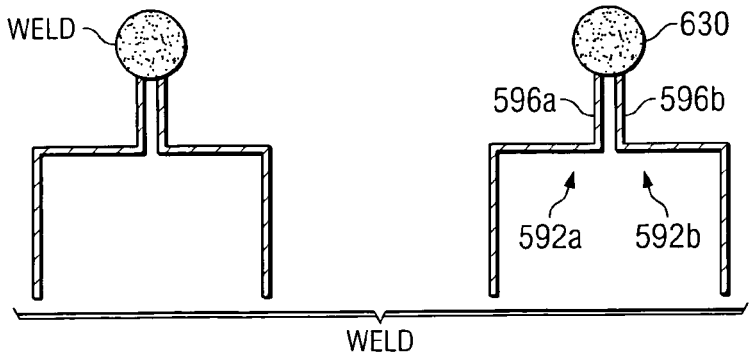
FIG. 59 illustrates various example manners for coupling the flange portions of adjacent sheets of the sheet assembly shown in FIG. 57A in accordance with one embodiment of the invention.
Figure 59B:
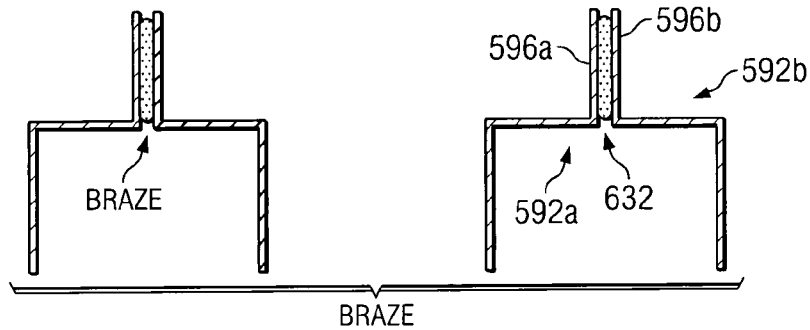
Figure 59C:
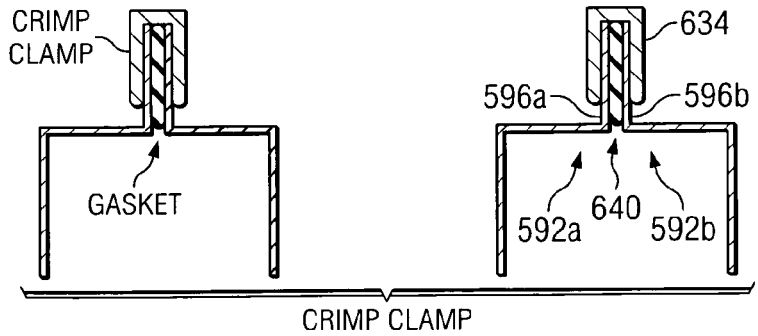
Figure 59D:
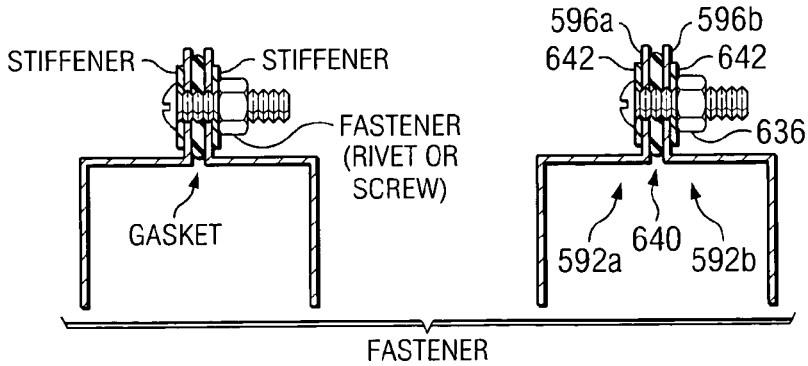
Figure 59E:
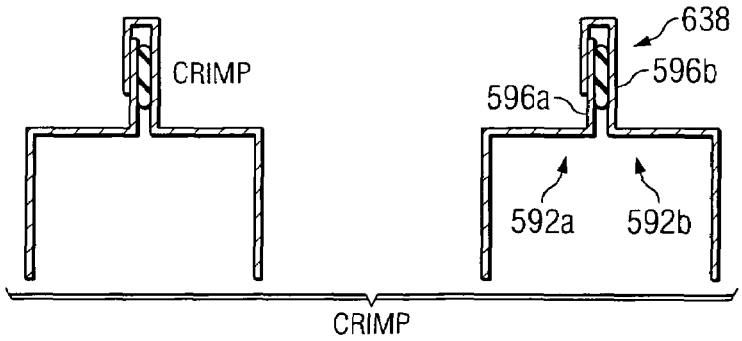

FIG. 58C illustrates a cross-sectional view of sheet 580*a* taken along Cut A shown in FIG. 58B. FIG. 58D illustrates a cross-sectional view of sheet 580*a* taken along Cut B shown in FIG. 58B. Taken together with FIG. 58B, FIGS. 58C and 58D illustrate that, as discussed above, flanges 592 at edges 590*a* and 590*b* of sheet 580*a* extend in a first direction (out of the page), while flanges 592 at edges 590*c* and 590*d* of sheet 580*a* extend in the opposite direction (into the page).

As discussed above, in forming sheet assembly 512, second flange portion 596*a* of flange 592*a* of sheet 580*a* may be coupled to second flange portion 596*b* of flange 592*b* of sheet 580*b* in any suitable manner. FIG. 59 illustrates various example manners in which second flange portion 596*a* may be coupled to second flange portion 596*b*. As shown in FIG. 59, second flange portion 596*a* may be coupled to second flange portion 596*b* by a weld 630; a brazed connection 632; a crimp clamp 634; one or more fasteners 636, such as a rivet or screw for example; or a crimp connection 638, for example. For some types of couplings, a gasket 640 may be inserted in order to assure a seal between second flange portion 596*a* and second flange portion 596*b* (and thus a seal between sheets 580*a* and 580*b* at the relevant edge of 580*a* and 580*b*). In embodiments in which one or more fasteners 636 are used, stiffeners 642 may be provided to strengthen or reinforce the connection.

As discussed above, sheets 580 may be formed from any suitable material, such as sheet metal or one or more polymers, for example. Table 1 compares various polymers that could be used for the sheet-polymer assemblies. The underlined value in Table 1 is used to calculate the overall heat transfer coefficient, U, which is determined as follows:

$$U = \left[\frac{1}{h_i} + \frac{x}{k} + \frac{1}{h_o}\right]^{-1}$$

where $h_i$=inside heat transfer coefficient =3000 Btu/(h·ft$^2$·° F.) (for boiling water)

$h_o$=outside heat transfer coefficient =15,000 Btu/(h·ft$^2$·° F.)(dropwise condensation for polymer) =2,000 Btu/(h·ft$^2$·° F.)(filmwise condensation for metal)

k=thermal conductivity of material (Btu/(h·ft·° F.)

x=material thickness =0.01 in=500 mil=0.00083 ft

The overall heat transfer coefficient U is reported in the fifth column of Table 1. The cost of each polymer per square foot, C, is shown in the fourth column of Table 1. The ratio U/C is reported in the sixth column of Table 1, which is the overall heat transfer coefficient on a dollar basis, rather than an area basis. The ratio U/C may be referred to as the "figure of merit." The polymers are listed in order, with the highest U/C appearing at the top and the lowest U/C appearing at the bottom. In the last column of Table 1, the U/C for each polymer is compared to that of stainless steel (SS) and titanium (Ti). Stainless steel resists corrosion for many solutions (e.g., sugar, calcium acetate), but titanium may be used for particularly corrosive solutions, such as seawater, for example.

The polymer with the highest U/C is HDPE (high-density polyethylene). Polypropylene is also very good, and it may perform well at slightly higher temperatures. Other polymers (polystyrene, PVC) may also be considered, but their U/C performance may not be quite as good as polyethylene or polypropylene. As a general rule, the thermal conductivity of the polymers is much lower than metals, but their U/C performance may be superior because of their low material cost relative to metals. In addition, polymers are typically less expensive to form into the final shape of sheets 580 and sheet assembly 512 than metals. Further, polymer structures may be easier to seal, providing an additional benefit over metals.

Figure 60A:
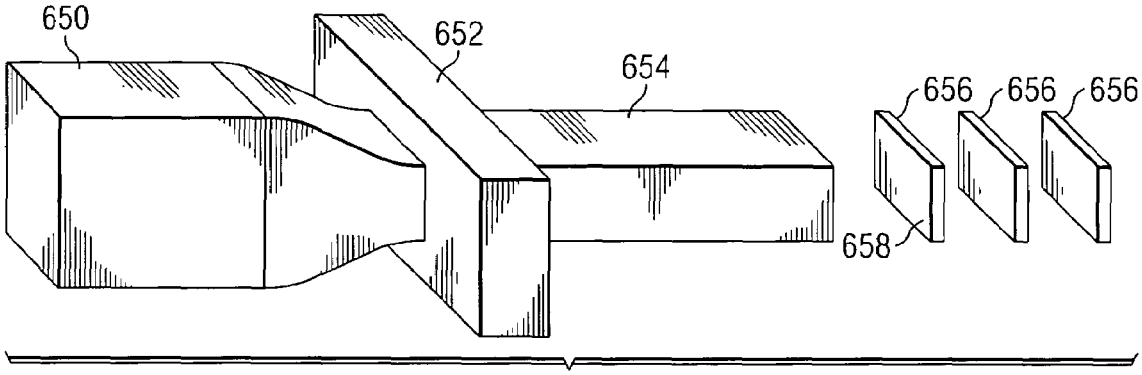
FIG. 60A illustrates a method of aligning the molecules in a polymer for making polymer sheets in accordance with one embodiment of the invention.

HDPE has a thermal conductivity comparable to stainless steel if the polymer molecules are aligned in the direction of heat flow (see third column, first row, Table 1). FIG. 60A illustrates an example method of aligning the molecules in a sample 650 of HDPE by drawing the polymer melt through a die 652. The shear orients the HDPE molecules in the flow direction, thus forming a molecularly-oriented HDPE block 654. By cutting polymer sheets 656 from such molecularly-oriented HDPE block 554 in which the molecules are aligned perpendicular to the sheet surface 658, the heat transfer performance of the HDPE sheet may be increased or maximized.

Figure 60B:
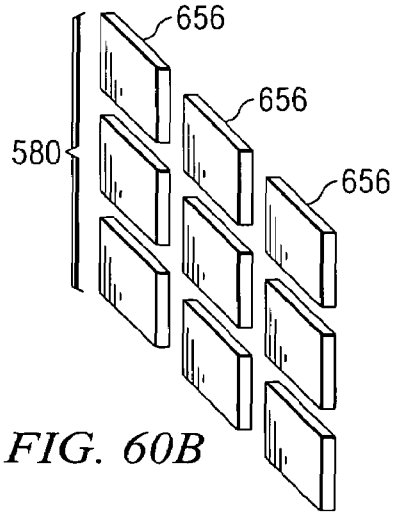
FIG. 60B illustrates a method of forming a sheet for a sheet assembly by joining a number of polymer sheets in accordance with one embodiment of the invention.

In some situations, the desired size of sheets 580 for a sheet assembly 512 may be larger than the molecularly-oriented polymer (e.g., HDPE) block 654 that may be produced due to available manufacturing equipment, equipment limitations, cost or some other reason. FIG. 60B illustrates a method of forming a sheet 580 (e.g., a relatively large sheet 580) by joining a number of polymer sheets 656. Such polymer sheets 656 may be joined in any suitable manner to form sheet 580, such as welding or heating to a relatively low temperature, for example.

In addition to providing increased heat transfer per cost as compared with metal, polymers may be more corrosion-resistant, more pliable, and more easily formed into sheets 580 and sheet assembly 512.

TABLE 1

Comparison of polymers.

| Material | Max. Working Temp. ° F. | k Thermal Conductivity Btu/(h · ft · ° F.) | C $/ft$^2$ (10 mil thickness) | U[b] Btu/(h · ft$^2$ · ° F.) | U/C Btu/(h · $ · ° F.) | $\frac{(U/C)_{plastic}}{(U/C)_{metal}}$ |
|---|---|---|---|---|---|---|
| HDPE (high-density polyethylene) | 160[c]<br>175-250[e] | 0.29[i]<br>0.25 @ 70° F.[k]<br>0.20 @ 212° F.[k]<br>4.9-8.1[m] | 0.12[a]<br>0.11[d] | 220 | 2,000 | 2.64 (SS)<br>5.93 (Ti) |

TABLE 1-continued

Comparison of polymers.

| Material | Max. Working Temp. ° F. | k Thermal Conductivity Btu/(h · ft · ° F.) | C $/ft$^2$ (10 mil thickness) | U[b] Btu/(h · ft$^2$ · ° F.) | U/C Btu/(h · $ · ° F.) | $\frac{(U/C)_{plastic}}{(U/C)_{metal}}$ |
|---|---|---|---|---|---|---|
| LDPE (low-density polyethylene) | 185-214[d]<br>180-212[e] | 0.19i<br>0.17-0.24[j]<br>0.20 @ 70° F.[k]<br>0.14 @ 212° F.[k] | 0.10[d] | 158 | 1,500 | 1.98 (SS)<br>4.45 (Ti) |
| Polypropylene | 225[d]<br>225-300[e] | 0.12[i]<br>0.083-0.12[j]<br>0.12 @ 70° F.[k]<br>0.11 @ 212° F.[k] | 0.09[a]<br>0.10[d] | 126 | 1,400 | 1.84 (SS)<br>4.15 (Ti) |
| HIPS (high-impact polystyrene) | 190[c]<br>140-175[e] | 0.083[l] | 0.09[a] | 104 | 1,156 | 1.52 (SS)<br>3.43 (Ti) |
| Ultra-high MW polyethylene | 180[d] | 0.24[r] | 0.50[a]<br>0.25[d] | 260 | 1,037 | 1.37 (SS)<br>3.08 (Ti) |
| PVC (polyvinyl chloride) | 140[d]<br>150-175[e] | 0.11[j]<br>0.10[k] | 0.14[d] | 126 | 900 | 1.19 (SS)<br>2.67 (Ti) |
| Acrylic | 209[c]<br>180[d]<br>175-225[e] | 0.12[j] | 0.28[a]<br>0.40[d] | 137 | 489 | 0.64 (SS)<br>1.45 (Ti) |
| ABS | 180[c]<br>185[d]<br>160-200[e] | 0.074-0.11[p] | 0.62[a]<br>0.52[d] | 126 | 242 | 0.32 (SS)<br>0.72 (Ti) |
| Acetal | 280[c]<br>195[e] | 0.25 @ 70° F.[k]<br>0.21 @ 212° F.[k] | 1.03[d] | 230 | 223 | 0.29 (SS)<br>0.66 (Ti) |
| PET (polyethylene terephthalate) | 230[d]<br>175[e] | 0.08[w] | 0.54[d] | 93 | 172 | 0.23 (SS)<br>0.51 (Ti) |
| PBT (polybutylene teraphalate polyester, Hydex) | 240[f] | 0.17[t] | 1.21[a] | 189 | 156 | 0.21 (SS)<br>0.46 (Ti) |
| CPVC | 215[d]<br>230[e] | 0.08[q] | 1.92[a]<br>0.74[d] | 93 | 125 | 0.17 (SS)<br>0.37 (Ti) |
| Noryl (polyphenylene oxide) | 175-220[e] | 0.11[s] | 1.07[a] | 126 | 117 | 0.15 (SS)<br>0.35 (Ti) |
| Polycarbonate | 280[o]<br>190[d]<br>250[e] | 0.13 @ 70° F.[k]<br>0.14 @ 212° F.[k] | 1.86[a] | 158 | 85 | 0.11 (SS)<br>0.25 (Ti) |
| Teflon | 500[d]<br>550[e] | 0.14[j] | 2.35[a]<br>2.21[d] | 158 | 71 | 0.094 (SS)<br>0.21 (Ti) |
| Polysulfone | 3400<br>300e | 0.15[u] | 3.42[a] | 169 | 49 | 0.065 (SS)<br>0.15 (Ti) |
| Polyurethane | | 0.13[v] | 3.25[a] | 147 | 45 | 0.060 (SS)<br>0.13 (Ti) |
| Nylon | 230[d]<br>180-300[e] | 0.14[j] | 6.45[a] | 158 | 24 | 0.032 (SS)<br>0.071 (Ti) |
| PEEK | 480[d] | 0.15[q] | 25.49[a] | 168 | 6.6 | 0.009 (SS)<br>0.02 (Ti) |
| Stainless Steel | | 9.4[y] | 1.68[g]<br>1.49[d]<br>1.43[n] | 1,085 | 759 | 1.00 (SS) |

TABLE 1-continued

Comparison of polymers.

| Material | Max. Working Temp. ° F. | k Thermal Conductivity Btu/(h · ft · ° F.) | C $/ft$^2$ (10 mil thickness) | U[b] Btu/(h · ft$^2$ · ° F.) | U/C Btu/(h · $ · ° F.) | $\frac{(U/C)_{plastic}}{(U/C)_{metal}}$ |
|---|---|---|---|---|---|---|
| Titanium | | 12[x] | 7.4[h]<br>3.29[o] | 1,108 | 337 | 1.00 (Ti) |

[a]K-mac Plastics (www.k-mac-plastics.net)
[b]$h_i$ = 3000 BtU/(h · ft$^2$ · ° F.)
$h_o$ = 15,000 BtU/(h · ft$^2$ · ° F.) (dropwise condensation for plastic)
$h_o$ = 2,000 BtU/(h · ft$^2$ · ° F.) (filmwise condensation for metal)
$h_m$ = k/x
x = 0.01 in = 0.00083 ft
[c]Hubert Interactive
[d]McMaster-Carr
[e]Perry's Handbook of Chemical Engineering (Table 23-22)
[f]K-mac Plastics
[g]www.metalsdepot.com
[h]www.halpemtitanium.com
[i]R. M. Ogorkiewicz, Thermoplastics: Properties and Design, Wiley, London (1974) p. 133-135
[j]R. M. Ogorkiewicz, Engineering Properties of Thermoplastics, Wiley, London (1970)
[k]P. E. Powell, Engineering with Polymers, Chapman and Hall, London (1983), p. 242
[l]Building Research Institute, Plastics in Building, National Academy of Sciences, 1955.
[m]In the direction of molecular orientation, draw direction ratio of 25 www.electronics-cooling.com/html/2001_august_techdata.html Choy C. L., Luk W. H., and Chen, F. C., 1978, Thermal Conductivity of Highly Oriented Polyethylene, Polymer, Vol. 19, pp. 155-162.
[n]Rickard Metals, rickardmetals.com ($3.50/lb)
[o]Astro Cosmos, 888-402-7876 ($14/lb, Grade 2)
[p]3d-cam.com
[q]boedeker.com
[r]bayplastics.co.uk
[s]sdplastics.com
[t]tstar.com
[u]plasticsusa.com
[v]zae-bayern.de
[w]toray.fr
[x]efunda.com
[y]Perry's Handbook of Chemical Engineering (Table 3-322)

Figure 61A:
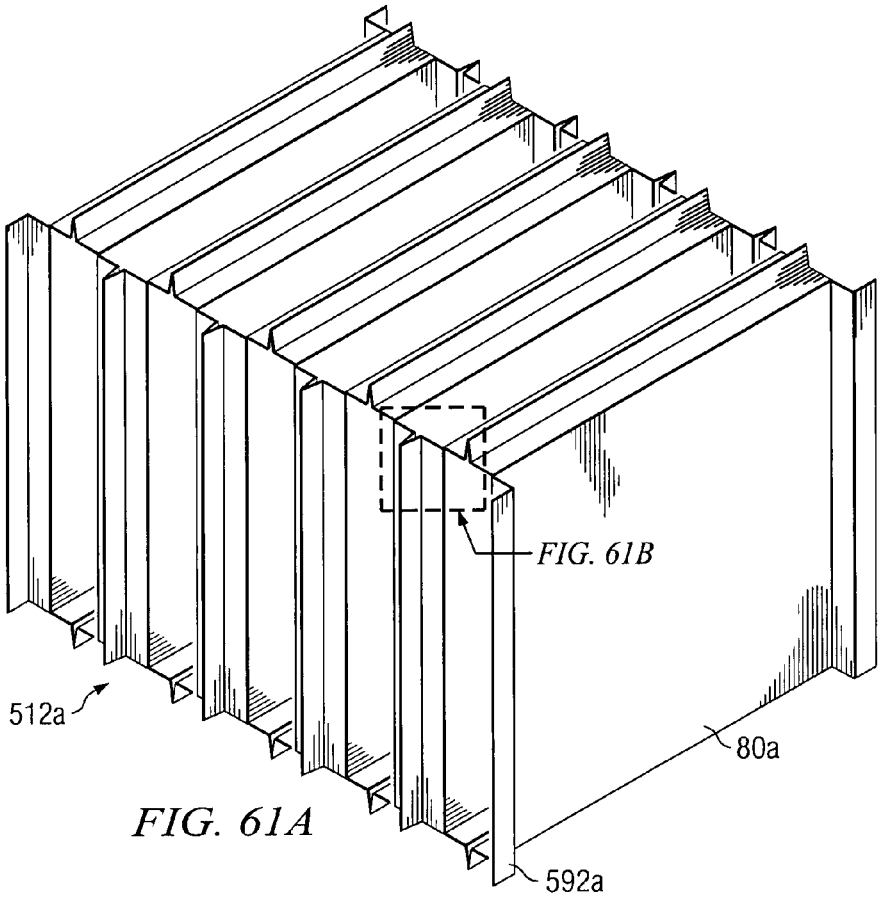
FIGS. 61A-61D illustrates another example sheet assembly in accordance with another embodiment of the invention.
Figure 61B:
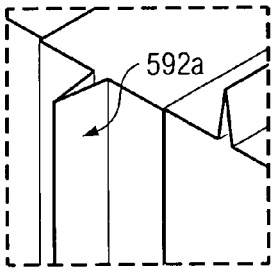
Figure 61C:
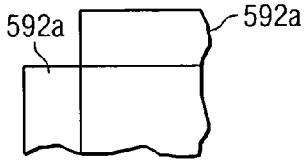
Figure 61D:
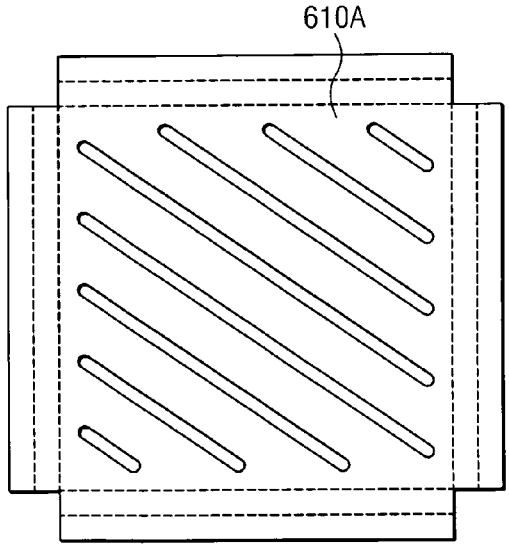

FIGS. 61A-61D illustrates another example sheet assembly 512A in accordance with another embodiment of the invention. FIG. 61A illustrates a three-dimensional view of sheet assembly 512A. FIG. 61B is a blown-up view of a corner area of sheet assembly 512A, illustrating flanges 592A of adjacent sheets 580A being coupled to each other in accordance with an embodiment of the invention. FIG. 61C illustrates a side view of the corner of sheet assembly 512A illustrated in FIG. 61B. FIG. 61D illustrates the configuration of a flat sheet 610A of material, such as sheet metal or one or more polymers, for example, that may be used to form each sheet 580A of sheet assembly 512A (such as by folding sheet 610A, such as described above with regard to FIGS. 3A-3B). As shown in FIGS. 61A-61D, sheet assembly 512A is substantially similar to sheet assembly 512 shown in FIG. 57A. However, unlike sheet assembly 512, sheet assembly 512A does not include triangular flaps 600 at the corners of each sheet 580A. Thus, sheet assembly 512A may be more simple to construct, and thus less expensive, than sheet assembly 512.

Although embodiments of the invention and their advantages are described in detail, a person skilled in the art could make various alterations, additions, and omissions without departing from the spirit and scope of the present invention.

What is claimed is:

1. A vapor-compression evaporation system, comprising:

a plurality of vessels in series each containing a feed having a nonvolatile component;

a mechanical compressor coupled to the last vessel in the series and operable to receive a vapor from the last vessel in the series;

a pump operable to deliver a cooling liquid to the mechanical compressor;

a tank coupled to the mechanical compressor and operable to separate liquid and vapor received from the mechanical compressor;

a plurality of heat exchangers coupled inside respective ones of the vessels, the heat exchanger in the first vessel in the series operable to receive the vapor from the tank, at least some of the vapor condensing therein, whereby the heat of condensation provides the heat of evaporation to the first vessel in the series;

wherein at least some of the vapor inside the first vessel in the series is delivered to the heat exchanger in the next vessel in the series, whereby the condensing, evaporating, and delivering steps continue until the last vessel in the series is reached; and a multi-effect or a multi-stage flash evaporator coupled to the last vessel in the series for additional evaporation of the feed.

2. The vapor-compression evaporation system of claim 1, wherein the nonvolatile component is selected from the group consisting of salt and sugar.

3. The vapor-compression evaporation system of claim 1, further comprising a condenser coupled to the last vessel in the series for removing energy from the last vessel in the series.

4. The vapor-compression evaporation system of claim 1, further comprising a plurality of devices coupled to respective ones of the vessels for removing concentrated feed from respective ones of the vessels.

5. The vapor-compression evaporation system of claim 1, wherein the cooling liquid comprises atomized liquid water.

6. The vapor-compression evaporation system of claim 5, wherein the liquid water of the atomized liquid water comprises feed water.

7. The vapor-compression evaporation system of claim 5, wherein the liquid water of the atomized liquid water comprises distilled water.

8. A vapor-compression evaporation system, comprising:

a plurality of vessels in series each containing a feed having a nonvolatile component;

a mechanical compressor coupled to the last vessel in the series and operable to receive a vapor from the last vessel in the series;

a pump operable to deliver atomized liquid water to the mechanical compressor;

a tank coupled to the mechanical compressor and operable to separate liquid and vapor received from the mechanical compressor;

a plurality of heat exchangers coupled inside respective ones of the vessels, the heat exchanger in the first vessel in the series operable to receive the vapor from the tank, at least some of the vapor condensing therein, whereby the heat of condensation provides the heat of evaporation to the first vessel in the series;

wherein at least some of the vapor inside the first vessel in the series is delivered to the heat exchanger in the next vessel in the series, whereby the condensing, evaporating, and delivering steps continue until the last vessel in the series is reached; and a multi-effect evaporator coupled to the last vessel in the series for additional evaporation of the feed.

9. The vapor-compression evaporation system of claim 8, wherein the nonvolatile component is selected from the group consisting of salt and sugar.

10. The vapor-compression evaporation system of claim 8, further comprising a condenser coupled to the last vessel in the series for removing energy from the last vessel in the series.

11. The vapor-compression evaporation system of claim 8, further comprising a plurality of devices coupled to respective ones of the vessels for removing concentrated feed from respective ones of the vessels.

12. The vapor-compression evaporation system of claim 8, wherein the liquid water of the atomized liquid water comprises feed water.

13. The vapor-compression evaporation system of claim 8, wherein the liquid water of the atomized liquid water comprises distilled water.

14. A vapor-compression evaporation method, comprising:

delivering a feed having a nonvolatile component to a plurality of vessels in series;

coupling a mechanical compressor to the last vessel in the series:

receiving, by the mechanical compressor a vapor from the last vessel in the series;

delivering a cooling liquid to the mechanical compressor;

separating liquid and vapor received from the mechanical compressor;

receiving, by a heat exchanger coupled to the first vessel in the series, the separated vapor, at least some of the vapor condensing therein, whereby the heat of condensation provides the heat of evaporation to the first vessel in the series;

delivering at least some of the vapor inside the first vessel in the series to a heat exchanger coupled to the next vessel in the series, whereby the condensing, evaporating, and delivering continue until the last vessel in the series is reached; and additionally evaporating the feed, by one of a multi-effect or a multi-stage flash evaporator coupled to the last vessel in series.

15. The vapor-compression evaporation method of claim 14, wherein the nonvolatile component is selected from the group consisting of salt and sugar.

16. The vapor-compression evaporation method of claim 14, further comprising removing energy from the last vessel in the series.

17. The vapor-compression evaporation method of claim 14, further comprising removing concentrated feed from respective ones of the vessels.

18. The vapor-compression evaporation method of claim 14, wherein the cooling liquid comprises atomized liquid water.

* * * * *